US010244915B2

(12) United States Patent
Schnittman et al.

(10) Patent No.: US 10,244,915 B2
(45) Date of Patent: Apr. 2, 2019

(54) COVERAGE ROBOTS AND ASSOCIATED CLEANING BINS

(71) Applicant: iRobot Corporation, Bedford, MA (US)

(72) Inventors: Mark Steven Schnittman, Somerville, MA (US); Daniel N. Ozick, Newton, MA (US); Gregg W. Landry, Gloucester, MA (US)

(73) Assignee: iRobot Corporation, Bedford, MA (US)

( * ) Notice: Subject to any disclaimer, the term of this patent is extended or adjusted under 35 U.S.C. 154(b) by 412 days.

(21) Appl. No.: 13/892,453

(22) Filed: May 13, 2013

(65) Prior Publication Data

US 2013/0298350 A1 Nov. 14, 2013

Related U.S. Application Data

(63) Continuation of application No. 11/751,267, filed on May 21, 2007.

(Continued)

(51) Int. Cl.
*A47L 11/40* (2006.01)
*A47L 9/10* (2006.01)

(Continued)

(52) U.S. Cl.
CPC ..... *A47L 11/4091* (2013.01); *A47L 9/106* (2013.01); *A47L 9/108* (2013.01); *A47L 11/24* (2013.01);

(Continued)

(58) Field of Classification Search
CPC .... A47L 2201/024; A47L 9/1683; A47L 9/19; A47L 9/28; A47L 9/16

(Continued)

(56) References Cited

U.S. PATENT DOCUMENTS 1,755,054 A 4/1930 Darst
1,780,221 A 11/1930 Buchmann (Continued)

FOREIGN PATENT DOCUMENTS

DE 2128842 C3 12/1980
DE 3317376 C2 12/1987

(Continued)

OTHER PUBLICATIONS

Machine Translation of JP 2002306387.*

(Continued)

*Primary Examiner* — Sean K Hunter
*Assistant Examiner* — Stephanie R Berry
(74) *Attorney, Agent, or Firm* — Fish & Richardson P.C.

(57) ABSTRACT

An autonomous coverage robot includes a chassis, a drive system configured to maneuver the robot, and a cleaning assembly. The cleaning assembly includes a cleaning assembly housing and at least one driven sweeper brush. The robot includes a controller and a removable sweeper bin configured to receive debris agitated by the driven sweeper brush. The sweeper bin includes an emitter disposed on an interior surface of the bin and a receiver disposed remotely from the emitter on the interior surface of the bin and configured to receive an emitter signal. The emitter and the receiver are disposed such that a threshold level of accumulation of debris in the sweeper bin blocks the receiver from receiving emitter emissions. The robot includes a bin controller disposed in the sweeper bin and monitoring a detector signal and initiating a bin full routine upon determining a bin debris accumulation level requiring service.

23 Claims, 21 Drawing Sheets

Related U.S. Application Data

(60) Provisional application No. 60/747,791, filed on May 19, 2006, provisional application No. 60/807,442, filed on Jul. 14, 2006, provisional application No. 60/803,504, filed on May 30, 2006.

(51) Int. Cl.
*A47L 11/33* (2006.01)
*A47L 11/24* (2006.01)

(52) U.S. Cl.
CPC ..... *A47L 11/33* (2013.01); *A47L 11/4002* (2013.01); *A47L 11/4008* (2013.01); *A47L 11/4011* (2013.01); *A47L 11/4013* (2013.01); *A47L 11/4025* (2013.01); *A47L 11/4041* (2013.01); *A47L 11/4044* (2013.01); *A47L 11/4066* (2013.01); *A47L 11/4069* (2013.01); *A47L 2201/02* (2013.01); *A47L 2201/024* (2013.01); *A47L 2201/028* (2013.01); *A47L 2201/04* (2013.01)

(58) Field of Classification Search
USPC ..... 15/319, 339, 347, 352, 353; 700/245; 701/23, 28; 702/150; 340/901; 310/323.21
See application file for complete search history.

(56) References Cited

U.S. PATENT DOCUMENTS 1,970,302 A 8/1934 Gerhardt
2,136,324 A 11/1938 John
2,302,111 A 11/1942 Dow et al.
2,353,621 A 7/1944 Sav et al.
2,770,825 A 11/1956 Pullen
2,930,055 A 3/1960 Fallen et al.
3,119,369 A 1/1964 Harland et al.
3,166,138 A 1/1965 Dunn
3,333,564 A 8/1967 Waters
3,375,375 A 3/1968 Robert et al.
3,381,652 A 5/1968 Schaefer et al.
3,457,575 A 7/1969 Bienek
3,550,714 A 12/1970 Bellinger
3,569,727 A 3/1971 Aggarwal et al.
3,649,981 A 3/1972 Woodworth
3,674,316 A 7/1972 De Bray
3,678,882 A 7/1972 Kinsella
3,690,559 A 9/1972 Rudloff
3,744,586 A 7/1973 Leinauer
3,756,667 A 9/1973 Bombardier et al.
3,809,004 A 5/1974 Leonheart
3,816,004 A 6/1974 Bignardi
3,845,831 A 11/1974 James
RE28,268 E 12/1974 Autrand
3,851,349 A 12/1974 Lowder
3,853,086 A 12/1974 Asplund
3,863,285 A 2/1975 Hukuba
3,888,181 A 6/1975 Kups
3,937,174 A 2/1976 Haaga
3,952,361 A 4/1976 Wilkins
3,989,311 A 11/1976 Debrey
3,989,931 A 11/1976 Phillips
4,004,313 A 1/1977 Capra
4,012,681 A 3/1977 Finger et al.
4,070,170 A 1/1978 Leinfelt
4,099,284 A 7/1978 Shinozaki et al.
4,119,900 A 10/1978 Kremnitz
4,175,589 A 11/1979 Nakamura et al.
4,175,892 A 11/1979 De bray
4,196,727 A 4/1980 Verkaart et al.
4,198,727 A 4/1980 Farmer
4,199,838 A 4/1980 Simonsson
4,209,254 A 6/1980 Reymond et al.
D258,901 S 4/1981 Keyworth
4,297,578 A 10/1981 Carter
4,305,234 A 12/1981 Pichelman
4,306,329 A 12/1981 Yokoi
4,309,758 A 1/1982 Halsall et al.
4,328,545 A 5/1982 Halsall et al.
4,367,403 A 1/1983 Miller
4,369,543 A 1/1983 Chen et al.
4,401,909 A 8/1983 Gorsek
4,416,033 A 11/1983 Specht
4,445,245 A 5/1984 Lu
4,465,370 A 8/1984 Yuasa et al.
4,477,998 A 10/1984 You
4,481,692 A 11/1984 Kurz
4,482,960 A 11/1984 Pryor
4,492,058 A 1/1985 Goldfarb et al.
4,513,469 A 4/1985 Godfrey et al.
D278,732 S 5/1985 Ohkado
4,518,437 A 5/1985 Sommer
4,534,637 A 8/1985 Suzuki et al.
4,556,313 A 12/1985 Miller et al.
4,575,211 A 3/1986 Matsumura et al.
4,580,311 A 4/1986 Kurz
4,601,082 A 7/1986 Kurz
4,618,213 A 10/1986 Chen
4,620,285 A 10/1986 Perdue
4,624,026 A 11/1986 Olson et al.
4,626,995 A 12/1986 Lofgren et al.
4,628,454 A 12/1986 Ito
4,638,445 A 1/1987 Mattaboni
4,644,156 A 2/1987 Takahashi et al.
4,649,504 A 3/1987 Krouglicof et al.
4,652,917 A 3/1987 Miller
4,654,492 A 3/1987 Koerner et al.
4,654,924 A 4/1987 Getz et al.
4,660,969 A 4/1987 Sorimachi et al.
4,662,854 A 5/1987 Fang
4,674,048 A 6/1987 Okumura
4,679,152 A 7/1987 Perdue
4,680,827 A 7/1987 Hummel
4,696,074 A 9/1987 Cavalli
D292,223 S 10/1987 Trumbull
4,700,301 A 10/1987 Dyke
4,700,427 A 10/1987 Knepper
4,703,820 A 11/1987 Reinaud
4,709,773 A 12/1987 Clement et al.
4,710,020 A 12/1987 Maddox et al.
4,712,740 A 12/1987 Duncan et al.
4,716,621 A 1/1988 Zoni
4,728,801 A 3/1988 O'Connor
4,733,343 A 3/1988 Yoneda et al.
4,733,430 A 3/1988 Westergren
4,733,431 A 3/1988 Martin
4,735,136 A 4/1988 Lee et al.
4,735,138 A 4/1988 Gawler et al.
4,748,336 A 5/1988 Fujie et al.
4,748,833 A 6/1988 Nagasawa
4,756,049 A 7/1988 Uehara
4,767,213 A 8/1988 Hummel
4,769,700 A 9/1988 Pryor
4,777,416 A 10/1988 George et al.
D298,766 S 11/1988 Tann et al.
4,782,550 A 11/1988 Jacobs
4,796,198 A 1/1989 Boultinghouse et al.
4,806,751 A 2/1989 Abe et al.
4,811,228 A 3/1989 Hyyppa
4,813,906 A 3/1989 Matsuyama et al.
4,815,157 A 3/1989 Tsuchiya
4,817,000 A 3/1989 Eberhardt
4,818,875 A 4/1989 Weiner
4,829,442 A 5/1989 Kadonoff et al.
4,829,626 A 5/1989 Harkonen et al.
4,832,098 A 5/1989 Palinkas et al.
4,851,661 A 7/1989 Everett
4,854,000 A 8/1989 Takimoto
4,854,006 A 8/1989 Nishimura et al.
4,855,915 A 8/1989 Dallaire
4,857,912 A 8/1989 Everett et al.
4,858,132 A 8/1989 Holmquist
4,867,570 A 9/1989 Sorimachi et al.

(56) References Cited

U.S. PATENT DOCUMENTS 4,880,474 A 11/1989 Koharagi et al.
4,887,415 A 12/1989 Martin
4,891,762 A 1/1990 Chotiros
4,893,025 A 1/1990 Lee
4,901,394 A 2/1990 Nakamura et al.
4,905,151 A 2/1990 Weiman et al.
4,909,972 A 3/1990 Britz
4,912,643 A 3/1990 Beirne
4,918,441 A 4/1990 Bohman
4,919,224 A 4/1990 Shyu et al.
4,919,489 A 4/1990 Kopsco
4,920,060 A 4/1990 Parrent et al.
4,920,605 A 5/1990 Takashima
4,933,864 A 6/1990 Evans et al.
4,937,912 A 7/1990 Kurz
4,953,253 A 9/1990 Fukuda et al.
4,954,962 A 9/1990 Evans et al.
4,955,714 A 9/1990 Stotler et al.
4,956,891 A 9/1990 Wulff
4,961,303 A 10/1990 McCarty et al.
4,961,304 A 10/1990 Ovsborn et al.
4,962,453 A 10/1990 Pong et al.
4,967,862 A 11/1990 Pong et al.
4,971,591 A 11/1990 Raviv et al.
4,973,912 A 11/1990 Kaminski et al.
4,974,283 A 12/1990 Holsten et al.
4,977,618 A 12/1990 Allen
4,977,639 A 12/1990 Takahashi et al.
4,986,663 A 1/1991 Cecchi et al.
5,001,635 A 3/1991 Yasutomi et al.
5,002,145 A 3/1991 Wakaumi et al.
5,012,886 A 5/1991 Jonas et al.
5,018,240 A 5/1991 Holman
5,020,186 A 6/1991 Lessig et al.
5,022,812 A 6/1991 Coughlan et al.
5,023,788 A 6/1991 Kitazume et al.
5,024,529 A 6/1991 Svetkoff et al.
D318,500 S 7/1991 Malewicki et al.
5,032,775 A 7/1991 Mizuno et al.
5,033,151 A 7/1991 Kraft et al.
5,033,291 A 7/1991 Podoloff et al.
5,040,116 A 8/1991 Evans et al.
5,045,769 A 9/1991 Everett
5,049,802 A 9/1991 Mintus et al.
5,051,906 A 9/1991 Evans et al.
5,062,819 A 11/1991 Mallory
5,070,567 A 12/1991 Holland
5,084,934 A 2/1992 Lessig et al.
5,086,535 A 2/1992 Grossmeyer et al.
5,090,321 A 2/1992 Abouav
5,093,955 A 3/1992 Blehert et al.
5,094,311 A 3/1992 Akeel
5,098,262 A 3/1992 Wecker et al.
5,105,502 A * 4/1992 Takashima ..... A47L 9/04 15/319
5,105,550 A 4/1992 Shenoha
5,109,566 A 5/1992 Kobayashi et al.
5,111,401 A 5/1992 Everett, Jr. et al.
5,115,538 A 5/1992 Cochran et al.
5,127,128 A 7/1992 Lee
5,136,675 A 8/1992 Hodson
5,136,750 A 8/1992 Takashima et al.
5,142,985 A 9/1992 Stearns et al.
5,144,471 A 9/1992 Takanashi et al.
5,144,714 A 9/1992 Mori et al.
5,144,715 A 9/1992 Matsuyo et al.
5,152,028 A 10/1992 Hirano
5,152,202 A 10/1992 Strauss
5,154,617 A 10/1992 Suman et al.
5,155,684 A 10/1992 Burke et al.
5,163,202 A 11/1992 Kawakami et al.
5,163,320 A 11/1992 Goshima et al.
5,164,579 A 11/1992 Pryor et al.
5,165,064 A 11/1992 Mattaboni
5,170,352 A 12/1992 McTamaney et al.
5,173,881 A 12/1992 Sindle
5,182,833 A 2/1993 Yamaguchi et al.
5,187,662 A 2/1993 Kamimura et al.
5,202,742 A 4/1993 Frank et al.
5,204,814 A 4/1993 Noonan et al.
5,206,500 A 4/1993 Decker et al.
5,208,521 A 5/1993 Aoyama
5,216,777 A 6/1993 Moro et al.
5,222,786 A 6/1993 Sovis et al.
5,227,985 A 7/1993 DeMenthon
5,233,682 A 8/1993 Abe et al.
5,239,720 A 8/1993 Wood et al.
5,251,358 A 10/1993 Moro et al.
5,261,139 A 11/1993 Lewis
5,276,618 A 1/1994 Everett
5,276,939 A 1/1994 Uenishi
5,277,064 A 1/1994 Knigga et al.
5,279,672 A 1/1994 Betker et al.
5,284,452 A 2/1994 Corona
5,284,522 A 2/1994 Kobayashi et al.
5,293,955 A 3/1994 Lee
D345,707 S 4/1994 Alister
5,303,448 A 4/1994 Hennessey et al.
5,307,273 A 4/1994 Oh et al.
5,309,592 A 5/1994 Hiratsuka
5,310,379 A 5/1994 Hippely et al.
5,315,227 A 5/1994 Pierson et al.
5,319,827 A 6/1994 Yang
5,319,828 A 6/1994 Waldhauser et al.
5,321,614 A 6/1994 Ashworth
5,323,483 A 6/1994 Baeg
5,324,948 A 6/1994 Dudar et al.
5,331,713 A 7/1994 Tipton
5,341,186 A 8/1994 Kato
5,341,540 A 8/1994 Soupert et al.
5,341,549 A 8/1994 Wirtz et al.
5,345,649 A 9/1994 Whitlow
5,352,901 A 10/1994 Poorman
5,353,224 A 10/1994 Lee et al.
5,363,305 A 11/1994 Cox et al.
5,363,935 A 11/1994 Schempf et al.
5,369,347 A 11/1994 Yoo
5,369,838 A 12/1994 Wood et al.
5,386,862 A 2/1995 Glover et al.
5,399,951 A 3/1995 Lavallee et al.
5,400,244 A 3/1995 Watanabe et al.
5,404,612 A 4/1995 Ishikawa
5,410,479 A 4/1995 Coker
5,435,405 A 7/1995 Schempf et al.
5,440,216 A 8/1995 Kim
5,442,358 A 8/1995 Keeler et al.
5,444,965 A 8/1995 Colens
5,446,356 A 8/1995 Kim
5,446,445 A 8/1995 Bloomfield et al.
5,451,135 A 9/1995 Schempf et al.
5,454,129 A 10/1995 Kell
5,455,982 A 10/1995 Armstrong et al.
5,465,525 A 11/1995 Mifune et al.
5,465,619 A 11/1995 Sotack et al.
5,467,273 A 11/1995 Faibish et al.
5,471,560 A 11/1995 Allard et al.
5,491,670 A 2/1996 Weber
5,497,529 A 3/1996 Boesi
5,498,948 A 3/1996 Bruni et al.
5,502,638 A 3/1996 Takenaka
5,505,072 A 4/1996 Oreper
5,507,067 A 4/1996 Hoekstra et al.
5,510,893 A 4/1996 Suzuki
5,511,147 A 4/1996 Abdel
5,515,572 A 5/1996 Hoekstra et al.
5,534,762 A 7/1996 Kim
5,535,476 A 7/1996 Kresse et al.
5,537,017 A 7/1996 Feiten et al.
5,537,711 A 7/1996 Tseng
5,539,953 A 7/1996 Kurz
5,542,146 A 8/1996 Hoekstra et al.
5,542,148 A 8/1996 Young
5,546,631 A 8/1996 Chambon
5,548,511 A 8/1996 Bancroft

(56) References Cited

U.S. PATENT DOCUMENTS

| | | | |
|---|---|---|---|
| 5,551,119 | A | 9/1996 | Wörwag |
| 5,551,525 | A | 9/1996 | Pack et al. |
| 5,553,349 | A | 9/1996 | Kilstrom et al. |
| 5,555,587 | A | 9/1996 | Guha |
| 5,560,077 | A | 10/1996 | Crotchett |
| 5,568,589 | A | 10/1996 | Hwang |
| D375,592 | S | 11/1996 | Ljunggren |
| 5,608,306 | A | 3/1997 | Rybeck et al. |
| 5,608,894 | A | 3/1997 | Kawakami et al. |
| 5,608,944 | A | 3/1997 | Gordon |
| 5,610,488 | A | 3/1997 | Miyazawa |
| 5,611,106 | A | 3/1997 | Wulff |
| 5,611,108 | A | 3/1997 | Knowlton et al. |
| 5,613,261 | A | 3/1997 | Kawakami et al. |
| 5,613,269 | A | 3/1997 | Miwa |
| 5,621,291 | A | 4/1997 | Lee |
| 5,622,236 | A | 4/1997 | Azumi et al. |
| 5,634,237 | A | 6/1997 | Paranjpe |
| 5,634,239 | A | 6/1997 | Tuvin et al. |
| 5,636,402 | A | 6/1997 | Kubo et al. |
| 5,642,299 | A | 6/1997 | Hardin et al. |
| 5,646,494 | A | 7/1997 | Han |
| 5,647,554 | A | 7/1997 | Ikegami et al. |
| 5,650,702 | A | 7/1997 | Azumi |
| 5,652,489 | A | 7/1997 | Kawakami |
| 5,682,313 | A | 10/1997 | Edlund et al. |
| 5,682,839 | A | 11/1997 | Grimsley et al. |
| 5,696,675 | A | 12/1997 | Nakamura et al. |
| 5,698,861 | A | 12/1997 | Oh |
| 5,709,007 | A | 1/1998 | Chiang |
| 5,710,506 | A | 1/1998 | Broell et al. |
| 5,714,119 | A | 2/1998 | Kawagoe et al. |
| 5,717,169 | A | 2/1998 | Liang et al. |
| 5,717,484 | A | 2/1998 | Hamaguchi et al. |
| 5,720,077 | A | 2/1998 | Nakamura et al. |
| 5,732,401 | A | 3/1998 | Conway |
| 5,735,017 | A | 4/1998 | Barnes et al. |
| 5,735,959 | A | 4/1998 | Kubo et al. |
| 5,742,975 | A | 4/1998 | Knowlton et al. |
| 5,745,235 | A | 4/1998 | Vercammen et al. |
| 5,752,871 | A | 5/1998 | Tsuzuki |
| 5,756,904 | A | 5/1998 | Oreper et al. |
| 5,761,762 | A | 6/1998 | Kubo |
| 5,764,888 | A | 6/1998 | Bolan et al. |
| 5,767,437 | A | 6/1998 | Rogers |
| 5,767,960 | A | 6/1998 | Orman |
| 5,770,936 | A | 6/1998 | Hirai et al. |
| 5,777,596 | A | 7/1998 | Herbert |
| 5,778,486 | A | 7/1998 | Kim |
| 5,781,697 | A | 7/1998 | Jeong |
| 5,781,960 | A | 7/1998 | Kilstrom et al. |
| 5,784,755 | A | 7/1998 | Karr et al. |
| 5,786,602 | A | 7/1998 | Pryor et al. |
| 5,787,545 | A | 8/1998 | Colens |
| 5,793,900 | A | 8/1998 | Nourbakhsh et al. |
| 5,794,297 | A | 8/1998 | Muta |
| 5,802,665 | A | 9/1998 | Knowlton et al. |
| 5,812,267 | A | 9/1998 | Everett et al. |
| 5,814,808 | A | 9/1998 | Takada et al. |
| 5,815,880 | A | 10/1998 | Nakanishi |
| 5,815,884 | A | 10/1998 | Imamura et al. |
| 5,819,008 | A | 10/1998 | Asama et al. |
| 5,819,360 | A | 10/1998 | Fujii |
| 5,819,936 | A | 10/1998 | Saveliev et al. |
| 5,820,821 | A | 10/1998 | Kawagoe et al. |
| 5,821,730 | A | 10/1998 | Drapkin |
| 5,825,981 | A | 10/1998 | Matsuda |
| 5,828,770 | A | 10/1998 | Leis et al. |
| 5,831,597 | A | 11/1998 | West et al. |
| 5,836,045 | A | 11/1998 | Anthony et al. |
| 5,839,156 | A | 11/1998 | Park et al. |
| 5,839,532 | A | 11/1998 | Yoshiji et al. |
| 5,841,259 | A | 11/1998 | Kim et al. |
| 5,867,800 | A | 2/1999 | Leif |
| 5,867,861 | A | 2/1999 | Kasen et al. |
| 5,869,910 | A | 2/1999 | Colens |
| 5,894,621 | A | 4/1999 | Kubo |
| 5,896,611 | A | 4/1999 | Haaga |
| 5,903,124 | A | 5/1999 | Kawakami |
| 5,905,209 | A | 5/1999 | Oreper |
| 5,907,886 | A | 6/1999 | Buscher |
| 5,910,700 | A | 6/1999 | Crotzer |
| 5,911,260 | A | 6/1999 | Suzuki |
| 5,916,008 | A | 6/1999 | Wong |
| 5,924,167 | A | 7/1999 | Wright et al. |
| 5,926,909 | A | 7/1999 | McGee |
| 5,933,102 | A | 8/1999 | Miller et al. |
| 5,933,913 | A | 8/1999 | Wright et al. |
| 5,935,179 | A | 8/1999 | Kleiner et al. |
| 5,935,333 | A | 8/1999 | Davis |
| 5,940,346 | A | 8/1999 | Sadowsky et al. |
| 5,940,927 | A | 8/1999 | Haegermarck et al. |
| 5,940,930 | A | 8/1999 | Oh et al. |
| 5,942,869 | A | 8/1999 | Katou et al. |
| 5,943,730 | A | 8/1999 | Boomgaarden |
| 5,943,733 | A | 8/1999 | Tagliaferri |
| 5,943,933 | A | 8/1999 | Evans et al. |
| 5,947,225 | A | 9/1999 | Kawakami et al. |
| 5,950,408 | A | 9/1999 | Schaedler |
| 5,959,423 | A | 9/1999 | Nakanishi et al. |
| 5,968,281 | A | 10/1999 | Wright et al. |
| 5,974,348 | A | 10/1999 | Rocks |
| 5,974,365 | A | 10/1999 | Mitchell |
| 5,983,448 | A | 11/1999 | Wright et al. |
| 5,984,880 | A | 11/1999 | Lander et al. |
| 5,987,383 | A | 11/1999 | Keller et al. |
| 5,989,700 | A | 11/1999 | Krivopal |
| 5,991,951 | A | 11/1999 | Kubo et al. |
| 5,995,883 | A | 11/1999 | Nishikado |
| 5,995,884 | A | 11/1999 | Allen et al. |
| 5,996,167 | A | 12/1999 | Close |
| 5,998,953 | A | 12/1999 | Nakamura et al. |
| 5,998,971 | A | 12/1999 | Corbridge |
| 6,000,088 | A | 12/1999 | Wright et al. |
| 6,009,358 | A | 12/1999 | Angott et al. |
| 6,012,618 | A | 1/2000 | Matsuo et al. |
| 6,021,545 | A | 2/2000 | Delgado et al. |
| 6,023,813 | A | 2/2000 | Thatcher et al. |
| 6,023,814 | A | 2/2000 | Imamura |
| 6,025,687 | A | 2/2000 | Himeda et al. |
| 6,026,539 | A | 2/2000 | Mouw et al. |
| 6,030,464 | A | 2/2000 | Azevedo |
| 6,030,465 | A | 2/2000 | Marcussen et al. |
| 6,032,327 | A | 3/2000 | Oka et al. |
| 6,032,542 | A | 3/2000 | Warnick et al. |
| 6,036,572 | A | 3/2000 | Sze |
| 6,038,501 | A | 3/2000 | Kawakami |
| 6,040,669 | A | 3/2000 | Hog |
| 6,041,471 | A | 3/2000 | Charky et al. |
| 6,041,472 | A | 3/2000 | Kasen et al. |
| 6,046,800 | A | 4/2000 | Ohtomo et al. |
| 6,049,620 | A | 4/2000 | Dickinson et al. |
| 6,050,648 | A | 4/2000 | Keleny |
| 6,052,821 | A | 4/2000 | Chouly et al. |
| 6,055,042 | A | 4/2000 | Sarangapani |
| 6,055,702 | A | 5/2000 | Imamura et al. |
| 6,061,868 | A | 5/2000 | Moritsch et al. |
| 6,065,182 | A | 5/2000 | Wright et al. |
| 6,070,290 | A | 6/2000 | Schwarze et al. |
| 6,073,432 | A | 6/2000 | Schaedler |
| 6,076,025 | A | 6/2000 | Ueno et al. |
| 6,076,026 | A | 6/2000 | Jambhekar et al. |
| 6,076,226 | A | 6/2000 | Reed |
| 6,076,227 | A | 6/2000 | Schallig et al. |
| 6,081,257 | A | 6/2000 | Zeller |
| 6,088,020 | A | 7/2000 | Mor |
| 6,094,775 | A | 8/2000 | Behmer |
| 6,099,091 | A | 8/2000 | Campbell |
| 6,101,670 | A | 8/2000 | Song |
| 6,101,671 | A | 8/2000 | Wright et al. |
| 6,108,031 | A | 8/2000 | King et al. |
| 6,108,067 | A | 8/2000 | Okamoto |
| 6,108,076 | A | 8/2000 | Hanseder |
| 6,108,269 | A | 8/2000 | Kabel |

(56) References Cited

U.S. PATENT DOCUMENTS

| | | | |
|---|---|---|---|
| 6,108,597 | A | 8/2000 | Kirchner et al. |
| 6,108,859 | A | 8/2000 | Burgoon |
| 6,112,143 | A | 8/2000 | Allen et al. |
| 6,112,996 | A | 9/2000 | Matsuo |
| 6,119,057 | A | 9/2000 | Kawagoe |
| 6,122,798 | A | 9/2000 | Kobayashi et al. |
| 6,124,694 | A | 9/2000 | Bancroft et al. |
| 6,125,498 | A | 10/2000 | Roberts et al. |
| 6,131,237 | A | 10/2000 | Kasper et al. |
| 6,138,063 | A | 10/2000 | Himeda |
| 6,142,252 | A | 11/2000 | Kinto et al. |
| 6,146,041 | A | 11/2000 | Chen et al. |
| 6,146,278 | A | 11/2000 | Kobayashi |
| 6,154,279 | A | 11/2000 | Thayer |
| 6,154,694 | A | 11/2000 | Aoki et al. |
| 6,160,479 | A | 12/2000 | Ahlen et al. |
| 6,167,332 | A | 12/2000 | Kurtzberg et al. |
| 6,167,587 | B1 | 1/2001 | Kasper et al. |
| 6,192,548 | B1 | 2/2001 | Huffman |
| 6,192,549 | B1 | 2/2001 | Kasen et al. |
| 6,202,243 | B1 | 3/2001 | Beaufoy et al. |
| 6,216,307 | B1 | 4/2001 | Kaleta et al. |
| 6,220,865 | B1 | 4/2001 | Macri et al. |
| 6,226,830 | B1 | 5/2001 | Hendriks et al. |
| 6,230,362 | B1 | 5/2001 | Kasper et al. |
| 6,237,741 | B1 | 5/2001 | Guidetti |
| 6,240,342 | B1 | 5/2001 | Fiegert et al. |
| 6,243,913 | B1 | 6/2001 | Frank et al. |
| 6,255,793 | B1 | 7/2001 | Peless et al. |
| 6,259,979 | B1 | 7/2001 | Holmquist |
| 6,261,379 | B1 | 7/2001 | Conrad et al. |
| 6,263,539 | B1 | 7/2001 | Baig |
| 6,263,989 | B1 | 7/2001 | Won |
| 6,272,936 | B1 | 8/2001 | Oreper et al. |
| 6,276,478 | B1 | 8/2001 | Hopkins et al. |
| 6,278,918 | B1 | 8/2001 | Dickson et al. |
| 6,279,196 | B2 | 8/2001 | Kasen et al. |
| 6,282,526 | B1 | 8/2001 | Ganesh |
| 6,283,034 | B1 | 9/2001 | Miles |
| 6,285,778 | B1 | 9/2001 | Nakajima et al. |
| 6,285,930 | B1 | 9/2001 | Dickson et al. |
| 6,286,181 | B1 | 9/2001 | Kasper et al. |
| 6,300,737 | B1 | 10/2001 | Bergvall et al. |
| 6,321,337 | B1 | 11/2001 | Reshef et al. |
| 6,321,515 | B1 | 11/2001 | Colens |
| 6,323,570 | B1 | 11/2001 | Nishimura et al. |
| 6,324,714 | B1 | 12/2001 | Walz et al. |
| 6,327,741 | B1 | 12/2001 | Reed |
| 6,332,400 | B1 | 12/2001 | Meyer |
| 6,339,735 | B1 | 1/2002 | Peless et al. |
| 6,362,875 | B1 | 3/2002 | Burkley |
| 6,370,453 | B2 | 4/2002 | Sommer |
| 6,374,155 | B1 | 4/2002 | Wallach et al. |
| 6,374,157 | B1 | 4/2002 | Takamura |
| 6,381,802 | B2 | 5/2002 | Park |
| 6,385,515 | B1 | 5/2002 | Dickson et al. |
| 6,388,013 | B1 | 5/2002 | Saraf et al. |
| 6,389,329 | B1 | 5/2002 | Colens |
| 6,397,429 | B1 | 6/2002 | Legatt et al. |
| 6,400,048 | B1 | 6/2002 | Nishimura et al. |
| 6,401,294 | B2 | 6/2002 | Kasper |
| 6,408,226 | B1 | 6/2002 | Byrne et al. |
| 6,412,141 | B2 | 7/2002 | Kasper et al. |
| 6,415,203 | B1 | 7/2002 | Inoue et al. |
| 6,418,586 | B2 | 7/2002 | Fulghum |
| 6,421,870 | B1 | 7/2002 | Basham et al. |
| 6,427,285 | B1 | 8/2002 | Legatt et al. |
| 6,430,471 | B1 | 8/2002 | Kintou et al. |
| 6,431,296 | B1 | 8/2002 | Won |
| 6,437,227 | B1 | 8/2002 | Theimer |
| 6,437,465 | B1 | 8/2002 | Nishimura et al. |
| 6,438,456 | B1 | 8/2002 | Feddema et al. |
| 6,438,793 | B1 | 8/2002 | Miner et al. |
| 6,442,476 | B1 | 8/2002 | Poropat |
| 6,442,789 | B1 | 9/2002 | Legatt et al. |
| 6,443,509 | B1 | 9/2002 | Levin et al. |
| 6,444,003 | B1 | 9/2002 | Sutcliffe |
| 6,446,302 | B1 | 9/2002 | Kasper et al. |
| 6,454,036 | B1 | 9/2002 | Airey et al. |
| D464,091 | S | 10/2002 | Christianson |
| 6,457,206 | B1 | 10/2002 | Judson |
| 6,459,955 | B1 | 10/2002 | Bartsch et al. |
| 6,463,368 | B1 | 10/2002 | Feiten et al. |
| 6,465,982 | B1 | 10/2002 | Bergvall et al. |
| 6,473,167 | B1 | 10/2002 | Odell |
| 6,480,762 | B1 | 11/2002 | Uchikubo et al. |
| 6,481,515 | B1 | 11/2002 | Kirkpatrick et al. |
| 6,482,252 | B1 | 11/2002 | Conrad et al. |
| 6,490,539 | B1 | 12/2002 | Dickson et al. |
| 6,491,127 | B1 | 12/2002 | Holmberg et al. |
| 6,493,612 | B1 | 12/2002 | Bisset et al. |
| 6,493,613 | B2 | 12/2002 | Peless et al. |
| 6,496,754 | B2 | 12/2002 | Song et al. |
| 6,496,755 | B2 | 12/2002 | Wallach et al. |
| 6,502,657 | B2 | 1/2003 | Kerrebrock et al. |
| 6,504,610 | B1 | 1/2003 | Bauer et al. |
| 6,507,773 | B2 | 1/2003 | Parker et al. |
| 6,519,808 | B2 | 2/2003 | Legatt et al. |
| 6,525,509 | B1 | 2/2003 | Petersson et al. |
| D471,243 | S | 3/2003 | Cioffi et al. |
| 6,530,102 | B1 | 3/2003 | Pierce et al. |
| 6,530,117 | B2 | 3/2003 | Peterson |
| 6,532,404 | B2 | 3/2003 | Colens |
| 6,535,793 | B2 | 3/2003 | Allard |
| 6,540,424 | B1 | 4/2003 | Hall et al. |
| 6,540,607 | B2 | 4/2003 | Mokris et al. |
| 6,548,982 | B1 | 4/2003 | Papanikolopoulos et al. |
| 6,553,612 | B1 | 4/2003 | Dyson et al. |
| 6,556,722 | B1 | 4/2003 | Russell et al. |
| 6,556,892 | B2 | 4/2003 | Kuroki et al. |
| 6,557,104 | B2 | 4/2003 | Vu et al. |
| D474,312 | S | 5/2003 | Stephens et al. |
| 6,563,130 | B2 | 5/2003 | Dworkowski et al. |
| 6,571,415 | B2 | 6/2003 | Gerber et al. |
| 6,571,422 | B1 | 6/2003 | Gordon et al. |
| 6,572,711 | B2 | 6/2003 | Sclafani et al. |
| 6,574,536 | B1 | 6/2003 | Kawagoe et al. |
| 6,580,246 | B2 | 6/2003 | Jacobs |
| 6,584,376 | B1 | 6/2003 | Van Kommer |
| 6,586,908 | B2 | 7/2003 | Petersson et al. |
| 6,587,573 | B1 | 7/2003 | Stam et al. |
| 6,590,222 | B1 | 7/2003 | Bisset et al. |
| 6,594,551 | B2 | 7/2003 | McKinney et al. |
| 6,594,844 | B2 | 7/2003 | Jones |
| 6,597,076 | B2 | 7/2003 | Scheible et al. |
| D478,884 | S | 8/2003 | Slipy et al. |
| 6,601,265 | B1 | 8/2003 | Burlington |
| 6,604,021 | B2 | 8/2003 | Imai et al. |
| 6,604,022 | B2 | 8/2003 | Parker et al. |
| 6,605,156 | B1 | 8/2003 | Clark et al. |
| 6,609,269 | B2 | 8/2003 | Kasper |
| 6,611,120 | B2 | 8/2003 | Song et al. |
| 6,611,734 | B2 | 8/2003 | Parker et al. |
| 6,611,738 | B2 | 8/2003 | Ruffner |
| 6,615,108 | B1 | 9/2003 | Peless et al. |
| 6,615,434 | B1 | 9/2003 | Davis et al. |
| 6,615,885 | B1 | 9/2003 | Ohm |
| 6,622,465 | B2 | 9/2003 | Jerome et al. |
| 6,624,744 | B1 | 9/2003 | Wilson et al. |
| 6,625,843 | B2 | 9/2003 | Kim et al. |
| 6,629,028 | B2 | 9/2003 | Paromtchik et al. |
| 6,633,150 | B1 | 10/2003 | Wallach et al. |
| 6,637,546 | B1 | 10/2003 | Wang |
| 6,639,659 | B2 | 10/2003 | Granger |
| 6,658,325 | B2 | 12/2003 | Zweig |
| 6,658,354 | B2 | 12/2003 | Lin |
| 6,658,692 | B2 | 12/2003 | Lenkiewicz et al. |
| 6,658,693 | B1 | 12/2003 | Reed |
| 6,661,239 | B1 | 12/2003 | Ozick |
| 6,662,889 | B2 | 12/2003 | De Fazio et al. |
| 6,668,951 | B2 | 12/2003 | Won |
| 6,670,817 | B2 | 12/2003 | Fournier et al. |
| 6,671,592 | B1 | 12/2003 | Bisset et al. |
| 6,671,925 | B2 | 1/2004 | Field et al. |

(56) References Cited

U.S. PATENT DOCUMENTS

| | | | |
|---|---|---|---|
| 6,677,938 | B1 | 1/2004 | Maynard |
| 6,687,571 | B1 | 2/2004 | Byrne et al. |
| 6,690,134 | B1 | 2/2004 | Jones et al. |
| 6,690,993 | B2 | 2/2004 | Foulke et al. |
| 6,697,147 | B2 | 2/2004 | Ko et al. |
| 6,705,332 | B2 | 3/2004 | Field et al. |
| 6,711,280 | B2 | 3/2004 | Stafsudd et al. |
| 6,732,826 | B2 | 5/2004 | Song et al. |
| 6,735,811 | B2 | 5/2004 | Field et al. |
| 6,735,812 | B2 | 5/2004 | Hekman et al. |
| 6,737,591 | B1 | 5/2004 | Lapstun et al. |
| 6,741,054 | B2 | 5/2004 | Koselka et al. |
| 6,741,364 | B2 | 5/2004 | Lange et al. |
| 6,748,297 | B2 | 6/2004 | Song et al. |
| 6,756,703 | B2 | 6/2004 | Chang |
| 6,760,647 | B2 | 7/2004 | Nourbakhsh et al. |
| 6,764,373 | B1 | 7/2004 | Osawa et al. |
| 6,769,004 | B2 | 7/2004 | Barrett |
| 6,774,596 | B1 | 8/2004 | Bisset |
| 6,779,380 | B1 | 8/2004 | Nieuwkamp |
| 6,781,338 | B2 | 8/2004 | Jones et al. |
| 6,809,490 | B2 | 10/2004 | Jones et al. |
| 6,810,305 | B2 | 10/2004 | Kirkpatrick |
| 6,810,350 | B2 | 10/2004 | Blakley |
| 6,830,120 | B1 | 12/2004 | Yashima et al. |
| 6,832,407 | B2 | 12/2004 | Salem et al. |
| 6,836,701 | B2 | 12/2004 | McKee |
| 6,841,963 | B2 | 1/2005 | Song et al. |
| 6,845,297 | B2 | 1/2005 | Allard |
| 6,848,146 | B2 | 2/2005 | Wright et al. |
| 6,854,148 | B1 | 2/2005 | Rief et al. |
| 6,856,811 | B2 | 2/2005 | Burdue et al. |
| 6,859,010 | B2 | 2/2005 | Jeon et al. |
| 6,859,682 | B2 | 2/2005 | Naka et al. |
| 6,860,206 | B1 | 3/2005 | Rudakevych et al. |
| 6,865,447 | B2 | 3/2005 | Lau et al. |
| 6,870,792 | B2 | 3/2005 | Chiappetta |
| 6,871,115 | B2 | 3/2005 | Huang et al. |
| 6,883,201 | B2 | 4/2005 | Jones et al. |
| 6,886,651 | B1 | 5/2005 | Slocum et al. |
| 6,888,333 | B2 | 5/2005 | Laby |
| 6,901,624 | B2 | 6/2005 | Mori et al. |
| 6,906,702 | B1 | 6/2005 | Tanaka et al. |
| 6,914,403 | B2 | 7/2005 | Tsurumi |
| 6,917,854 | B2 | 7/2005 | Bayer |
| 6,925,357 | B2 | 8/2005 | Wang et al. |
| 6,925,679 | B2 | 8/2005 | Wallach et al. |
| 6,929,548 | B2 | 8/2005 | Wang |
| D510,066 | S | 9/2005 | Hickey et al. |
| 6,938,298 | B2 | 9/2005 | Aasen |
| 6,940,291 | B1 | 9/2005 | Ozick |
| 6,941,199 | B1 | 9/2005 | Bottomley et al. |
| 6,956,348 | B2 | 10/2005 | Landry et al. |
| 6,957,712 | B2 | 10/2005 | Song et al. |
| 6,960,986 | B2 | 11/2005 | Asama et al. |
| 6,965,209 | B2 | 11/2005 | Jones et al. |
| 6,965,211 | B2 | 11/2005 | Tsurumi |
| 6,968,592 | B2 | 11/2005 | Takeuchi et al. |
| 6,971,140 | B2 | 12/2005 | Kim |
| 6,975,246 | B1 | 12/2005 | Trudeau |
| 6,980,229 | B1 | 12/2005 | Ebersole |
| 6,985,556 | B2 | 1/2006 | Shanmugavel et al. |
| 6,993,954 | B1 | 2/2006 | George et al. |
| 6,999,850 | B2 | 2/2006 | McDonald |
| 7,013,527 | B2 | 3/2006 | Thomas et al. |
| 7,024,278 | B2 | 4/2006 | Chiappetta et al. |
| 7,024,280 | B2 | 4/2006 | Parker et al. |
| 7,027,893 | B2 | 4/2006 | Perry et al. |
| 7,030,768 | B2 | 4/2006 | Wanie |
| 7,031,805 | B2 | 4/2006 | Lee et al. |
| 7,032,469 | B2 | 4/2006 | Bailey |
| 7,040,869 | B2 | 5/2006 | Beenker |
| 7,041,029 | B2 | 5/2006 | Fulghum et al. |
| 7,051,399 | B2 | 5/2006 | Field et al. |
| 7,053,578 | B2 | 5/2006 | Diehl et al. |
| 7,054,716 | B2 | 5/2006 | McKee et al. |
| 7,055,210 | B2 | 6/2006 | Keppler et al. |
| 7,057,120 | B2 | 6/2006 | Ma et al. |
| 7,057,643 | B2 | 6/2006 | Iida et al. |
| 7,059,012 | B2 | 6/2006 | Song et al. |
| 7,065,430 | B2 | 6/2006 | Naka et al. |
| 7,066,291 | B2 | 6/2006 | Martins et al. |
| 7,069,124 | B1 | 6/2006 | Whittaker et al. |
| 7,079,923 | B2 | 7/2006 | Abramson et al. |
| 7,085,623 | B2 | 8/2006 | Siegers |
| 7,085,624 | B2 | 8/2006 | Aldred et al. |
| 7,113,847 | B2 | 9/2006 | Chmura et al. |
| 7,133,746 | B2 | 11/2006 | Abramson et al. |
| 7,142,198 | B2 | 11/2006 | Lee |
| 7,148,458 | B2 | 12/2006 | Schell et al. |
| 7,155,308 | B2 | 12/2006 | Jones |
| 7,167,775 | B2 | 1/2007 | Abramson et al. |
| 7,171,285 | B2 | 1/2007 | Kim et al. |
| 7,173,391 | B2 | 2/2007 | Jones et al. |
| 7,174,238 | B1 | 2/2007 | Zweig |
| 7,188,000 | B2 | 3/2007 | Chiappetta et al. |
| 7,193,384 | B1 | 3/2007 | Norman et al. |
| 7,196,487 | B2 | 3/2007 | Jones et al. |
| 7,201,786 | B2 | 4/2007 | Wegelin et al. |
| 7,206,677 | B2 | 4/2007 | Hulden |
| 7,211,980 | B1 | 5/2007 | Bruemmer et al. |
| 7,225,500 | B2 | 6/2007 | Diehl et al. |
| 7,246,405 | B2 | 7/2007 | Yan |
| 7,248,951 | B2 | 7/2007 | Hulden |
| 7,275,280 | B2 | 10/2007 | Haegermarck et al. |
| 7,283,892 | B1 | 10/2007 | Boillot et al. |
| 7,288,912 | B2 | 10/2007 | Landry et al. |
| 7,318,248 | B1 | 1/2008 | Yan |
| 7,320,149 | B1 | 1/2008 | Huffman et al. |
| 7,321,807 | B2 | 1/2008 | Laski |
| 7,324,870 | B2 | 1/2008 | Lee |
| 7,328,196 | B2 | 2/2008 | Peters |
| 7,332,890 | B2 | 2/2008 | Cohen et al. |
| 7,346,428 | B1 | 3/2008 | Huffman et al. |
| 7,352,153 | B2 | 4/2008 | Yan |
| 7,359,766 | B2 | 4/2008 | Jeon et al. |
| 7,360,277 | B2 | 4/2008 | Moshenrose et al. |
| 7,363,108 | B2 | 4/2008 | Noda et al. |
| 7,388,879 | B2 | 6/2008 | Sabe et al. |
| 7,389,156 | B2 | 6/2008 | Ziegler et al. |
| 7,389,166 | B2 | 6/2008 | Harwig et al. |
| 7,408,157 | B2 | 8/2008 | Yan |
| 7,418,762 | B2 | 9/2008 | Arai et al. |
| 7,430,455 | B2 | 9/2008 | Casey et al. |
| 7,430,462 | B2 | 9/2008 | Chiu et al. |
| 7,441,298 | B2 | 10/2008 | Svendsen et al. |
| 7,444,206 | B2 | 10/2008 | Abramson et al. |
| 7,448,113 | B2 | 11/2008 | Jones et al. |
| 7,459,871 | B2 | 12/2008 | Landry et al. |
| 7,467,026 | B2 | 12/2008 | Sakagami et al. |
| 7,474,941 | B2 | 1/2009 | Kim et al. |
| 7,503,096 | B2 | 3/2009 | Lin |
| 7,515,991 | B2 | 4/2009 | Egawa et al. |
| 7,539,557 | B2 | 5/2009 | Yamauchi |
| 7,555,363 | B2 | 6/2009 | Augenbraun et al. |
| 7,557,703 | B2 | 7/2009 | Yamada et al. |
| 7,568,259 | B2 | 8/2009 | Yan |
| 7,571,511 | B2 | 8/2009 | Jones et al. |
| 7,578,020 | B2 | 8/2009 | Jaworski et al. |
| 7,600,521 | B2 | 10/2009 | Woo |
| 7,603,744 | B2 | 10/2009 | Reindle |
| 7,611,583 | B2 | 11/2009 | Buckley et al. |
| 7,617,557 | B2 | 11/2009 | Reindle |
| 7,620,476 | B2 | 11/2009 | Morse et al. |
| 7,636,928 | B2 | 12/2009 | Uno |
| 7,636,982 | B2 | 12/2009 | Jones et al. |
| 7,647,144 | B2 | 1/2010 | Haegermarck |
| 7,650,666 | B2 | 1/2010 | Jang |
| 7,660,650 | B2 | 2/2010 | Kawagoe et al. |
| 7,663,333 | B2 | 2/2010 | Jones et al. |
| 7,693,605 | B2 | 4/2010 | Park |
| 7,706,917 | B1 | 4/2010 | Chiappetta et al. |
| 7,761,954 | B2 | 7/2010 | Ziegler et al. |
| 7,765,635 | B2 | 8/2010 | Park |

(56) References Cited

U.S. PATENT DOCUMENTS 7,784,147 B2 8/2010 Burkholder et al.
7,801,645 B2 9/2010 Taylor et al.
7,805,220 B2 9/2010 Taylor et al.
7,809,944 B2 10/2010 Kawamoto
7,832,048 B2 11/2010 Harwig et al.
7,849,555 B2 12/2010 Hahm et al.
7,853,645 B2 12/2010 Brown et al.
7,860,680 B2 12/2010 Arms et al.
7,920,941 B2 4/2011 Park et al.
7,937,800 B2 5/2011 Yan
7,957,836 B2 6/2011 Myeong et al.
8,087,117 B2 1/2012 Kapoor et al.
8,528,157 B2 * 9/2013 Schnittman et al. ..... 15/319
2001/0004719 A1 6/2001 Sommer
2001/0013929 A1 8/2001 Torsten
2001/0020200 A1 9/2001 Das et al.
2001/0025183 A1 9/2001 Shahidi
2001/0037163 A1 11/2001 Allard
2001/0043509 A1 11/2001 Green et al.
2001/0045883 A1 11/2001 Holdaway et al.
2001/0047231 A1 11/2001 Peless et al.
2001/0047895 A1 12/2001 De Fazio et al.
2002/0011367 A1 1/2002 Kolesnik
2002/0011813 A1 1/2002 Koselka et al.
2002/0016649 A1 2/2002 Jones
2002/0021219 A1 2/2002 Edwards
2002/0027652 A1 3/2002 Paromtchik et al.
2002/0036779 A1 3/2002 Kiyoi et al.
2002/0081937 A1 6/2002 Yamada et al.
2002/0095239 A1 7/2002 Wallach et al.
2002/0097400 A1 7/2002 Jung et al.
2002/0104963 A1 8/2002 Mancevski
2002/0108209 A1 8/2002 Peterson
2002/0112742 A1 8/2002 Bredo et al.
2002/0113973 A1 8/2002 Ge
2002/0116089 A1 8/2002 Kirkpatrick
2002/0120364 A1 8/2002 Colens
2002/0124343 A1 9/2002 Reed
2002/0153185 A1 10/2002 Song et al.
2002/0156556 A1 10/2002 Ruffner
2002/0159051 A1 10/2002 Guo
2002/0166193 A1 11/2002 Kasper
2002/0169521 A1 11/2002 Goodman et al.
2002/0173877 A1 11/2002 Zweig
2002/0189871 A1 12/2002 Won
2003/0009259 A1 1/2003 Hattori et al.
2003/0015232 A1 1/2003 Nguyen
2003/0019071 A1 1/2003 Field et al.
2003/0023356 A1 1/2003 Keable
2003/0024986 A1 2/2003 Mazz et al.
2003/0025472 A1 2/2003 Jones et al.
2003/0028286 A1 2/2003 Glenn et al.
2003/0030399 A1 2/2003 Jacobs
2003/0058262 A1 3/2003 Sato et al.
2003/0060928 A1 3/2003 Abramson et al.
2003/0067451 A1 4/2003 Tagg et al.
2003/0097875 A1 5/2003 Lentz et al.
2003/0120389 A1 6/2003 Abramson et al.
2003/0124312 A1 7/2003 Autumn
2003/0126352 A1 7/2003 Barrett
2003/0137268 A1 7/2003 Papanikolopoulos et al.
2003/0146384 A1 8/2003 Logsdon et al.
2003/0159232 A1 8/2003 Hekman et al.
2003/0168081 A1 9/2003 Lee et al.
2003/0175138 A1 9/2003 Beenker
2003/0192144 A1 10/2003 Song et al.
2003/0193657 A1 10/2003 Uomori et al.
2003/0216834 A1 11/2003 Allard
2003/0221114 A1 11/2003 Hino et al.
2003/0229421 A1 12/2003 Chmura et al.
2003/0229474 A1 12/2003 Suzuki et al.
2003/0233171 A1 12/2003 Heiligensetzer
2003/0233177 A1 12/2003 Johnson et al.
2003/0233870 A1 12/2003 Mancevski
2003/0233930 A1 12/2003 Ozick
2004/0016077 A1 1/2004 Song et al.
2004/0020000 A1 2/2004 Jones
2004/0030448 A1 2/2004 Solomon
2004/0030449 A1 2/2004 Solomon
2004/0030450 A1 2/2004 Solomon
2004/0030451 A1 2/2004 Solomon
2004/0030570 A1 2/2004 Solomon
2004/0030571 A1 2/2004 Solomon
2004/0031113 A1 2/2004 Wosewick et al.
2004/0049877 A1 3/2004 Jones et al.
2004/0055163 A1 3/2004 McCambridge et al.
2004/0068351 A1 4/2004 Solomon
2004/0068415 A1 4/2004 Solomon
2004/0068416 A1 4/2004 Solomon
2004/0074038 A1 4/2004 Im et al.
2004/0074044 A1 4/2004 Diehl et al.
2004/0076324 A1 4/2004 Burl et al.
2004/0083570 A1 5/2004 Song et al.
2004/0085037 A1 5/2004 Jones et al.
2004/0088079 A1 5/2004 Lavarec et al.
2004/0093122 A1 5/2004 Galibraith
2004/0098167 A1 5/2004 Yi et al.
2004/0111184 A1 6/2004 Chiappetta et al.
2004/0111821 A1 6/2004 Lenkiewicz et al.
2004/0113777 A1 6/2004 Matsuhira et al.
2004/0117064 A1 6/2004 McDonald
2004/0117846 A1 6/2004 Karaoguz et al.
2004/0118998 A1 6/2004 Wingett et al.
2004/0128028 A1 7/2004 Miyamoto et al.
2004/0133316 A1 7/2004 Dean
2004/0134336 A1 7/2004 Solomon
2004/0134337 A1 7/2004 Solomon
2004/0143919 A1 7/2004 Wilder
2004/0148419 A1 7/2004 Chen et al.
2004/0148731 A1 8/2004 Damman et al.
2004/0153212 A1 8/2004 Profio et al.
2004/0156541 A1 8/2004 Jeon et al.
2004/0158357 A1 8/2004 Lee et al.
2004/0181706 A1 9/2004 Chen et al.
2004/0187249 A1 9/2004 Jones et al.
2004/0187457 A1 9/2004 Colens
2004/0196451 A1 10/2004 Aoyama
2004/0200505 A1 10/2004 Taylor et al.
2004/0201361 A1 10/2004 Koh et al.
2004/0204792 A1 10/2004 Taylor et al.
2004/0204804 A1 10/2004 Lee et al.
2004/0210345 A1 10/2004 Noda et al.
2004/0210347 A1 10/2004 Sawada et al.
2004/0211444 A1 10/2004 Taylor et al.
2004/0221790 A1 11/2004 Sinclair et al.
2004/0236468 A1 11/2004 Taylor et al.
2004/0244138 A1 12/2004 Taylor et al.
2004/0255425 A1 12/2004 Arai et al.
2005/0000543 A1 1/2005 Taylor et al.
2005/0010330 A1 1/2005 Abramson et al.
2005/0010331 A1 1/2005 Taylor et al.
2005/0015920 A1 1/2005 Kim et al.
2005/0021181 A1 1/2005 Kim et al.
2005/0028316 A1 2/2005 Thomas et al.
2005/0053912 A1 3/2005 Roth et al.
2005/0055796 A1 3/2005 Wright et al.
2005/0067994 A1 3/2005 Jones et al.
2005/0081782 A1 4/2005 Buckley et al.
2005/0085947 A1 4/2005 Aldred et al.
2005/0091782 A1 5/2005 Gordon et al.
2005/0091786 A1 5/2005 Wright et al.
2005/0137749 A1 6/2005 Jeon et al.
2005/0144751 A1 7/2005 Kegg et al.
2005/0150074 A1 * 7/2005 Diehl ..... G05D 1/0225 15/327.5
2005/0150519 A1 7/2005 Keppler et al.
2005/0154795 A1 7/2005 Kuz et al.
2005/0156562 A1 7/2005 Cohen et al.
2005/0162119 A1 7/2005 Landry et al.
2005/0163119 A1 7/2005 Ito et al.
2005/0165508 A1 7/2005 Kanda et al.
2005/0166352 A1 8/2005 Keppler et al.
2005/0166354 A1 8/2005 Uehigashi
2005/0166355 A1 8/2005 Tani

(56) References Cited

U.S. PATENT DOCUMENTS

2005/0171636 A1* 8/2005 Tani ..... G05D 1/0276 700/245
2005/0172445 A1 8/2005 Diehl et al.
2005/0183229 A1* 8/2005 Uehigashi ..... A47L 9/009 15/319
2005/0183230 A1* 8/2005 Uehigashi ..... A47L 9/19 15/319
2005/0187678 A1 8/2005 Myeong et al.
2005/0192707 A1 9/2005 Park et al.
2005/0204505 A1* 9/2005 Kashiwagi ..... G05D 1/0246 15/319
2005/0204717 A1 9/2005 Colens
2005/0209736 A1 9/2005 Kawagoe
2005/0211880 A1 9/2005 Schell et al.
2005/0212929 A1 9/2005 Schell et al.
2005/0213082 A1 9/2005 DiBernardo et al.
2005/0213109 A1 9/2005 Schell et al.
2005/0217042 A1 10/2005 Reindle
2005/0218852 A1 10/2005 Landry et al.
2005/0222933 A1 10/2005 Wesby
2005/0229340 A1 10/2005 Sawalski et al.
2005/0229355 A1 10/2005 Crouch et al.
2005/0235451 A1 10/2005 Yan
2005/0251292 A1 11/2005 Casey et al.
2005/0255425 A1 11/2005 Pierson
2005/0258154 A1 11/2005 Blankenship et al.
2005/0273967 A1 12/2005 Taylor et al.
2005/0287038 A1 12/2005 Dubrovsky et al.
2005/0288819 A1 12/2005 De Guzman
2006/0000050 A1 1/2006 Cipolla et al.
2006/0009879 A1 1/2006 Lynch et al.
2006/0010638 A1 1/2006 Shimizu et al.
2006/0020369 A1 1/2006 Taylor et al.
2006/0020370 A1 1/2006 Abramson
2006/0021168 A1 2/2006 Nishikawa
2006/0025134 A1 2/2006 Cho et al.
2006/0037170 A1 2/2006 Shimizu
2006/0042042 A1 3/2006 Mertes et al.
2006/0044546 A1 3/2006 Lewin et al.
2006/0060216 A1 3/2006 Woo
2006/0061657 A1 3/2006 Rew et al.
2006/0064828 A1 3/2006 Stein et al.
2006/0087273 A1 4/2006 Ko et al.
2006/0089765 A1 4/2006 Pack et al.
2006/0100741 A1 5/2006 Jung
2006/0107894 A1 5/2006 Buckley et al.
2006/0119839 A1 6/2006 Bertin et al.
2006/0143295 A1 6/2006 Costa-Requena et al.
2006/0146776 A1 7/2006 Kim
2006/0150361 A1 7/2006 Aldred et al.
2006/0184293 A1 8/2006 Konandreas et al.
2006/0185690 A1 8/2006 Song et al.
2006/0190133 A1 8/2006 Konandreas et al.
2006/0190134 A1 8/2006 Ziegler et al.
2006/0190146 A1 8/2006 Morse et al.
2006/0196003 A1 9/2006 Song et al.
2006/0200281 A1 9/2006 Ziegler et al.
2006/0220900 A1 10/2006 Ceskutti et al.
2006/0229774 A1 10/2006 Park et al.
2006/0259194 A1 11/2006 Chiu
2006/0259494 A1 11/2006 Watson et al.
2006/0278161 A1 12/2006 Burkholder et al.
2006/0288519 A1 12/2006 Jaworski et al.
2006/0293787 A1 12/2006 Kanda et al.
2006/0293808 A1 12/2006 Qian
2007/0006404 A1 1/2007 Cheng et al.
2007/0016328 A1 1/2007 Ziegler et al.
2007/0017061 A1 1/2007 Yan
2007/0028574 A1 2/2007 Yan
2007/0032904 A1 2/2007 Kawagoe et al.
2007/0042716 A1 2/2007 Goodall et al.
2007/0043459 A1 2/2007 Abbott et al.
2007/0061041 A1 3/2007 Zweig
2007/0061043 A1 3/2007 Seaburg
2007/0114975 A1 5/2007 Cohen et al.
2007/0142964 A1 6/2007 Abramson
2007/0150096 A1 6/2007 Yeh et al.
2007/0156286 A1 7/2007 Yamauchi
2007/0157415 A1 7/2007 Lee et al.
2007/0157420 A1 7/2007 Lee et al.
2007/0179670 A1 8/2007 Chiappetta et al.
2007/0226949 A1 10/2007 Hahm et al.
2007/0234492 A1 10/2007 Svendsen et al.
2007/0244610 A1 10/2007 Ozick et al.
2007/0245511 A1 10/2007 Hahm et al.
2007/0250212 A1 10/2007 Halloran et al.
2007/0261193 A1 11/2007 Gordon et al.
2007/0266508 A1 11/2007 Jones et al.
2008/0007203 A1 1/2008 Cohen et al.
2008/0039974 A1 2/2008 Sandin et al.
2008/0052846 A1 3/2008 Kapoor et al.
2008/0091304 A1 4/2008 Ozick et al.
2008/0109126 A1 5/2008 Sandin et al.
2008/0134458 A1 6/2008 Ziegler et al.
2008/0140255 A1 6/2008 Ziegler et al.
2008/0155768 A1 7/2008 Ziegler et al.
2008/0184518 A1 8/2008 Taylor et al.
2008/0266748 A1 10/2008 Lee
2008/0276407 A1 11/2008 Schnittman et al.
2008/0281470 A1 11/2008 Gilbert et al.
2008/0282494 A1 11/2008 Won et al.
2008/0294288 A1 11/2008 Yamauchi
2008/0302586 A1 12/2008 Yan
2008/0307590 A1 12/2008 Jones et al.
2009/0007366 A1 1/2009 Svendsen et al.
2009/0038089 A1 2/2009 Landry et al.
2009/0048727 A1 2/2009 Hong et al.
2009/0049640 A1 2/2009 Lee et al.
2009/0055022 A1 2/2009 Casey et al.
2009/0102296 A1 4/2009 Greene et al.
2009/0292393 A1 11/2009 Casey et al.
2010/0006028 A1 1/2010 Buckley et al.
2010/0011529 A1 1/2010 Won et al.
2010/0049365 A1 2/2010 Jones et al.
2010/0063628 A1 3/2010 Landry et al.
2010/0082193 A1 4/2010 Chiappetta
2010/0107355 A1 5/2010 Won et al.
2010/0257690 A1 10/2010 Jones et al.
2010/0257691 A1 10/2010 Jones et al.
2010/0263158 A1 10/2010 Jones et al.
2010/0268384 A1 10/2010 Jones et al.
2010/0293742 A1 11/2010 Chung et al.
2010/0312429 A1 12/2010 Jones et al.

FOREIGN PATENT DOCUMENTS

DE 3536907 C2 2/1989
DE 3404202 C2 12/1992
DE 199311014 U1 10/1993
DE 4338841 A1 5/1995
DE 4414683 10/1995
DE 4414683 A1 10/1995
DE 19849978 2/2001
DE 10242257 4/2003
DE 102004038074 6/2005
DE 10357636 7/2005
DE 102004041021 B3 8/2005
DE 102005046813 A1 4/2007
DK 338988 A 12/1988
EP 0265542 A1 5/1988
EP 0281085 A2 9/1988
EP 0286328 A1 10/1988
EP 0294101 A2 12/1988
EP 0352045 A2 1/1990
EP 0433697 A2 6/1991
EP 0437024 A1 7/1991
EP 0554978 A2 8/1993
EP 0615719 A1 9/1994
EP 0792726 A1 9/1997
EP 0930040 A2 7/1999
EP 0845237 B1 4/2000
EP 0861629 B1 9/2001
EP 1228734 A2 8/2002
EP 1243218 9/2002

(56) References Cited

FOREIGN PATENT DOCUMENTS

| | | | |
|---|---|---|---|
| EP | 1380245 | A1 | 1/2004 |
| EP | 1380246 | A2 | 1/2004 |
| EP | 1018315 | B1 | 11/2004 |
| EP | 1553472 | A1 | 7/2005 |
| EP | 1557730 | A1 | 7/2005 |
| EP | 1642522 | A2 | 4/2006 |
| EP | 1836941 | A2 | 9/2007 |
| ES | 2238196 | A1 | 8/2005 |
| FR | 722755 | | 3/1932 |
| FR | 2601443 | A1 | 1/1988 |
| FR | 2828589 | A1 | 2/2003 |
| GB | 702426 | | 1/1954 |
| GB | 2128842 | A | 5/1984 |
| GB | 2225221 | A | 5/1990 |
| GB | 2267360 | A | 12/1993 |
| GB | 2283838 | A | 5/1995 |
| GB | 2284957 | A | 6/1995 |
| GB | 2300082 | A | 10/1996 |
| GB | 2404330 | A | 2/2005 |
| GB | 2417354 | A | 2/2006 |
| JP | 53021869 | | 2/1978 |
| JP | 53110257 | A2 | 9/1978 |
| JP | 57064217 | | 4/1982 |
| JP | 59005315 | | 2/1984 |
| JP | 59033511 | U | 3/1984 |
| JP | 59094005 | | 5/1984 |
| JP | 59099308 | | 6/1984 |
| JP | 59112311 | | 6/1984 |
| JP | 59120124 | | 7/1984 |
| JP | 59131668 | | 9/1984 |
| JP | 59164973 | | 9/1984 |
| JP | 59184917 | A | 10/1984 |
| JP | 2283343 | A2 | 11/1984 |
| JP | 59212924 | | 12/1984 |
| JP | 59226909 | | 12/1984 |
| JP | 60089213 | A | 5/1985 |
| JP | 60211510 | A | 10/1985 |
| JP | 60259895 | | 12/1985 |
| JP | 61023221 | | 1/1986 |
| JP | 61097712 | A | 5/1986 |
| JP | 61160366 | | 7/1986 |
| JP | 62070709 | | 4/1987 |
| JP | 62074018 | A | 4/1987 |
| JP | 62120510 | A | 6/1987 |
| JP | 62154008 | | 7/1987 |
| JP | 62164431 | | 7/1987 |
| JP | 62263507 | A | 11/1987 |
| JP | 62263508 | A | 11/1987 |
| JP | 62189057 | U | 12/1987 |
| JP | 63079623 | A | 4/1988 |
| JP | 63158032 | | 7/1988 |
| JP | 63203483 | A | 8/1988 |
| JP | 63241610 | A | 10/1988 |
| JP | 1118752 | | 8/1989 |
| JP | 206312 | U | 1/1990 |
| JP | 3051023 | A | 3/1991 |
| JP | 4019586 | | 1/1992 |
| JP | 4074285 | A | 3/1992 |
| JP | 4084921 | A | 3/1992 |
| JP | 5023269 | A | 2/1993 |
| JP | 5042076 | A | 2/1993 |
| JP | 5046246 | | 2/1993 |
| JP | 5091604 | A | 4/1993 |
| JP | 5095879 | A | 4/1993 |
| JP | 5150827 | A | 6/1993 |
| JP | 5150829 | A | 6/1993 |
| JP | 5054620 | U | 7/1993 |
| JP | 5040519 | Y2 | 10/1993 |
| JP | 05257527 | A | 10/1993 |
| JP | 5257533 | | 10/1993 |
| JP | 05285861 | A | 11/1993 |
| JP | 5302836 | A | 11/1993 |
| JP | 5312514 | A | 11/1993 |
| JP | 05046239 | Y2 | 12/1993 |
| JP | 5341904 | A | 12/1993 |
| JP | 6003251 | U | 1/1994 |
| JP | 6038912 | | 2/1994 |
| JP | 6137828 | A | 5/1994 |
| JP | 6154143 | A | 6/1994 |
| JP | 6293095 | A | 10/1994 |
| JP | 06327598 | A | 11/1994 |
| JP | 6105781 | A | 12/1994 |
| JP | 7047046 | A | 2/1995 |
| JP | 07129239 | A | 5/1995 |
| JP | 7059702 | B | 6/1995 |
| JP | 07222705 | A2 | 8/1995 |
| JP | 7270518 | A | 10/1995 |
| JP | 7313417 | A | 12/1995 |
| JP | 8016776 | A | 1/1996 |
| JP | 8084696 | A | 4/1996 |
| JP | 8089449 | A | 4/1996 |
| JP | 08089451 | A | 4/1996 |
| JP | 8123548 | A | 5/1996 |
| JP | 8152916 | A | 6/1996 |
| JP | 8263137 | A | 10/1996 |
| JP | 8335112 | A | 12/1996 |
| JP | 8339297 | A | 12/1996 |
| JP | 9044240 | A | 2/1997 |
| JP | 9066855 | A | 3/1997 |
| JP | 9145309 | A | 6/1997 |
| JP | 09160644 | A | 6/1997 |
| JP | 09179625 | A | 7/1997 |
| JP | 09185410 | | 7/1997 |
| JP | 9192069 | A | 7/1997 |
| JP | 2555263 | Y2 | 8/1997 |
| JP | 09206258 | A | 8/1997 |
| JP | 09233712 | A | 9/1997 |
| JP | 9265319 | A | 10/1997 |
| JP | 9269807 | A | 10/1997 |
| JP | 9269810 | A | 10/1997 |
| JP | 9319431 | A1 | 12/1997 |
| JP | 9319432 | A | 12/1997 |
| JP | 9319434 | A | 12/1997 |
| JP | 9325812 | A | 12/1997 |
| JP | 10055215 | A | 2/1998 |
| JP | 10117973 | A | 5/1998 |
| JP | 10118963 | A | 5/1998 |
| JP | 10165738 | A | 6/1998 |
| JP | 10177414 | A | 6/1998 |
| JP | 10295595 | A | 11/1998 |
| JP | 10314088 | | 12/1998 |
| JP | 11015941 | A | 1/1999 |
| JP | 11102220 | A | 4/1999 |
| JP | 11162454 | A | 6/1999 |
| JP | 1178765 | A | 7/1999 |
| JP | 11174145 | A | 7/1999 |
| JP | 11175149 | A | 7/1999 |
| JP | 11178764 | A | 7/1999 |
| JP | 11212642 | A | 8/1999 |
| JP | 11213157 | A | 8/1999 |
| JP | 11282532 | A | 10/1999 |
| JP | 11282533 | A | 10/1999 |
| JP | 11295412 | A | 10/1999 |
| JP | 2000047728 | | 2/2000 |
| JP | 2000056006 | A | 2/2000 |
| JP | 2000056831 | A | 2/2000 |
| JP | 2000060782 | A | 2/2000 |
| JP | 2000066722 | A | 3/2000 |
| JP | 2000075925 | A | 3/2000 |
| JP | 2000102499 | A | 4/2000 |
| JP | 2000275321 | | 10/2000 |
| JP | 2000279353 | A | 10/2000 |
| JP | 2000353014 | A | 12/2000 |
| JP | 2001022443 | A | 1/2001 |
| JP | 2001067588 | | 3/2001 |
| JP | 2001087182 | | 4/2001 |
| JP | 2001121455 | | 5/2001 |
| JP | 2001125641 | | 5/2001 |
| JP | 2001508572 | A | 6/2001 |
| JP | 2001197008 | A | 7/2001 |
| JP | 3197758 | B2 | 8/2001 |
| JP | 3201903 | B2 | 8/2001 |
| JP | 2001216482 | A | 8/2001 |
| JP | 2001258807 | | 9/2001 |

(56) References Cited

FOREIGN PATENT DOCUMENTS

| | | | | |
|---|---|---|---|---|
| JP | 2001265437 | A | | 9/2001 |
| JP | 2001275908 | A | | 10/2001 |
| JP | 2001289939 | | | 10/2001 |
| JP | 2001306170 | A | | 11/2001 |
| JP | 2002073170 | A | | 3/2002 |
| JP | 2002078650 | A | | 3/2002 |
| JP | 2002204768 | A | | 7/2002 |
| JP | 2002204769 | A | | 7/2002 |
| JP | 2002247510 | A | | 8/2002 |
| JP | 2002306387 | A | * | 10/2002 |
| JP | 2002532180 | A | | 10/2002 |
| JP | 2002323925 | | | 11/2002 |
| JP | 2002333920 | A | | 11/2002 |
| JP | 2002355206 | | | 12/2002 |
| JP | 2002360471 | A | | 12/2002 |
| JP | 2002360482 | A | | 12/2002 |
| JP | 2002366227 | | | 12/2002 |
| JP | 2002369778 | | | 12/2002 |
| JP | 2003005296 | A | | 1/2003 |
| JP | 2003010076 | A | | 1/2003 |
| JP | 2003010088 | A | | 1/2003 |
| JP | 2003028528 | A | | 1/2003 |
| JP | 2003036116 | A | | 2/2003 |
| JP | 2003038401 | A | | 2/2003 |
| JP | 2003038402 | A | | 2/2003 |
| JP | 2003047579 | | | 2/2003 |
| JP | 2003061882 | A | | 3/2003 |
| JP | 2003084994 | | | 3/2003 |
| JP | 2003167628 | A | | 6/2003 |
| JP | 2003180586 | A | | 7/2003 |
| JP | 2003180587 | A | | 7/2003 |
| JP | 2003186539 | A | | 7/2003 |
| JP | 2003190064 | A | | 7/2003 |
| JP | 2003241836 | A | | 8/2003 |
| JP | 2003262520 | A | | 9/2003 |
| JP | 2003304992 | A | | 10/2003 |
| JP | 2003310509 | A | | 11/2003 |
| JP | 2003330543 | A | | 11/2003 |
| JP | 2004123040 | A | | 4/2004 |
| JP | 2004148021 | A | | 5/2004 |
| JP | 2004160102 | A | | 6/2004 |
| JP | 2004166968 | A | | 6/2004 |
| JP | 2004198330 | A | | 7/2004 |
| JP | 2004219185 | | | 8/2004 |
| JP | 2004351234 | A | | 12/2004 |
| JP | 2005118354 | A | | 5/2005 |
| JP | 2005211360 | A | | 8/2005 |
| JP | 2005224265 | A | | 8/2005 |
| JP | 2005230032 | A | | 9/2005 |
| JP | 2005245916 | A | | 9/2005 |
| JP | 2005352707 | A | | 12/2005 |
| JP | 2006043071 | A | | 2/2006 |
| JP | 2006155274 | A | | 6/2006 |
| JP | 2006164223 | A | | 6/2006 |
| JP | 2006227673 | A | | 8/2006 |
| JP | 2006247467 | A | | 9/2006 |
| JP | 2006260161 | A | | 9/2006 |
| JP | 2006293662 | A | | 10/2006 |
| JP | 2006296697 | A | | 11/2006 |
| JP | 2007034866 | A | | 2/2007 |
| JP | 2007213180 | A | | 8/2007 |
| JP | 2009015611 | A | | 1/2009 |
| JP | 2010198552 | A | | 9/2010 |
| WO | 199526512 | A1 | | 10/1995 |
| WO | 199530887 | A1 | | 11/1995 |
| WO | 199617258 | A1 | | 6/1996 |
| WO | 199715224 | A1 | | 5/1997 |
| WO | 199740734 | A1 | | 11/1997 |
| WO | 199741451 | A1 | | 11/1997 |
| WO | 199853456 | A1 | | 11/1998 |
| WO | 199905580 | A2 | | 2/1999 |
| WO | 199916078 | A1 | | 4/1999 |
| WO | 199938056 | A1 | | 7/1999 |
| WO | 199938237 | A1 | | 7/1999 |
| WO | 199943250 | A1 | | 9/1999 |
| WO | 200038026 | A1 | | 6/2000 |
| WO | 200038028 | A1 | | 6/2000 |
| WO | 200038029 | A1 | | 6/2000 |
| WO | 200004430 | A1 | | 10/2000 |
| WO | 200078410 | A1 | | 12/2000 |
| WO | 200106904 | A1 | | 2/2001 |
| WO | 200106905 | A1 | | 2/2001 |
| WO | 2001080703 | A1 | | 11/2001 |
| WO | 200191623 | A2 | | 12/2001 |
| WO | 2002024292 | A1 | | 3/2002 |
| WO | 200239864 | A1 | | 5/2002 |
| WO | 200239868 | A1 | | 5/2002 |
| WO | 2002058527 | A1 | | 8/2002 |
| WO | 2002062194 | A1 | | 8/2002 |
| WO | 2002067744 | A1 | | 9/2002 |
| WO | 2002067745 | A1 | | 9/2002 |
| WO | 2002067752 | A1 | | 9/2002 |
| WO | 2002069774 | A1 | | 9/2002 |
| WO | 2002069775 | A2 | | 9/2002 |
| WO | 2002071175 | A1 | | 9/2002 |
| WO | 2002074150 | A1 | | 9/2002 |
| WO | 2002075356 | A1 | | 9/2002 |
| WO | 2002075469 | A1 | | 9/2002 |
| WO | 2002075470 | A1 | | 9/2002 |
| WO | 2002081074 | A1 | | 10/2002 |
| WO | 2002101477 | A2 | | 12/2002 |
| WO | 2003015220 | A1 | | 2/2003 |
| WO | 2003024292 | A2 | | 3/2003 |
| WO | 2003040546 | A1 | | 5/2003 |
| WO | 2003040845 | A1 | | 5/2003 |
| WO | 2003040846 | A1 | | 5/2003 |
| WO | 2003062850 | A2 | | 7/2003 |
| WO | 2003062852 | A1 | | 7/2003 |
| WO | 2004004533 | A1 | | 1/2004 |
| WO | 2004004534 | A1 | | 1/2004 |
| WO | 2004006034 | A2 | | 1/2004 |
| WO | 2004025947 | A2 | | 3/2004 |
| WO | 2004058028 | A2 | | 7/2004 |
| WO | 2004059409 | A1 | | 7/2004 |
| WO | 2005006935 | A1 | | 1/2005 |
| WO | 2005037496 | A1 | | 4/2005 |
| WO | 2005055795 | A1 | | 6/2005 |
| WO | 2005055796 | A2 | | 6/2005 |
| WO | 2005076545 | A1 | | 8/2005 |
| WO | 2005077243 | A1 | | 8/2005 |
| WO | 2005077244 | A1 | | 8/2005 |
| WO | 2005081074 | A1 | | 9/2005 |
| WO | 2005082223 | A1 | | 9/2005 |
| WO | 2005083541 | A1 | | 9/2005 |
| WO | 2005098475 | A1 | | 10/2005 |
| WO | 2005098476 | A1 | | 10/2005 |
| WO | 2006046400 | A1 | | 5/2006 |
| WO | 2006061133 | A1 | | 6/2006 |
| WO | 2006068403 | A1 | | 6/2006 |
| WO | 2006073248 | A1 | | 7/2006 |
| WO | 2006089307 | A2 | | 8/2006 |
| WO | 2007028049 | A2 | | 3/2007 |
| WO | 2007036490 | A2 | | 4/2007 |
| WO | 2007065033 | A2 | | 6/2007 |
| WO | 2007137234 | A2 | | 11/2007 |
| WO | 2002075350 | A1 | | 1/2012 |

OTHER PUBLICATIONS

Andersen et al., "Landmark based navigation strategies," SPIE Conference on Mobile Robots XIII, SPIE vol. 3525, pp. 170-181, Jan. 8, 1999.

Ascii, Mar. 25, 2002, http://ascii.jp/elem/000/000/330/330024/ accessed Nov. 1, 2011. 7 pages.

Becker et al., "Reliable Navigation Using Landmarks, " IEEE International Conference on Robotics and Automation, 0-7803-1965-6, pp. 401-406, 1995.

Benayad-Cherif et al., "Mobile Robot Navigation Sensors," SPIE vol. 1831 Mobile Robots, VII, pp. 378-387, 1992.

Bison et al., "Using a structured beacon for cooperative position estimation," *Robotics and Autonomous Systems*, 29(1):33-40, Oct. 1999.

(56) References Cited

OTHER PUBLICATIONS

Blaasvaer et al., "AMOR—An Autonomous Mobile Robot Navigation System," Proceedings of the IEEE International Conference on Systems, Man, and Cybernetics, pp. 2266-2271, 1994.
Borges et al., "Optimal Mobile Robot Pose Estimation Using Geometrical Maps," IEEE Transactions on Robotics and Automation, 18(1): 87-94, Feb. 2002.
Braunstingl et al., "Fuzzy Logic Wall Following of a Mobile Robot Based on the Concept of General Perception," ICAR '95, 7th International Conference on Advanced Robotics, Sant Feliu De Guixols, Spain, pp. 367-376, Sep. 1995.
Bulusu et al., "Self Configuring Localization systems: Design and Experimental Evaluation,"*ACM Transactions on Embedded Computing Systems*, 3(1):24-60, 2003.
Caccia et al., "Bottom-Following for Remotely Operated Vehicles,"5th IFAC Conference, Alaborg, Denmark, pp. 245-250, Aug. 2000.
Certified copy of U.S. Appl. No. 60/605,066 as provided to WIPO in PCT/US2005/030422, corresponding to National Stage Entry U.S. Appl. No. 11/574,290, U.S.publication 2008/0184518, filed Aug. 27, 2004.
Certified copy of U.S. Appl. No. 60/605,181 as provided to WIPO in PCT/US2005/030422, corresponding to National Stage Entry U.S. Appl. No. 11/574,290, U.S.publication 2008/0184518, filed Aug. 27, 2004.
Chae et al., "StarLITE: A new artificial landmark for the navigation of mobile robots," http://www.irc.atr.jp/jk-nrs2005/pdf/Starlite.pdf, 4 pages, 2005.
Chamberlin et al., "Team 1: Robot Locator Beacon System," NASA Goddard SFC, Design Proposal, 15 pages, Feb. 2006.
Champy, "Physical management of IT assets in Data Centers using RFID technologies," RFID 2005 University, Oct. 12-14, 2005 , 19 pages.
Chiri, "Joystick Control for Tiny OS Robot," http://www.eecs.berkeley.edu/Programs/ugrad/superb/papers2002/chiri.pdf. 12 pages, Aug. 2002.
Christensen et al. "Theoretical Methods for Planning and Control in Mobile Robotics," 1997 First International Conference on Knowledge-Based Intelligent Electronic Systems, Adelaide, Australia, pp. 81-86, May 1997.
Clerentin et al., "A localization method based on two omnidirectional perception systems cooperation," *Proc of IEEE International Conference on Robotics & Automation*, San Francisco, CA vol. 2, pp. 1219-1224, Apr. 2000.
Corke, "High Performance Visual serving for robots end-point control," SPIE vol. 2056, Intelligent Robots and Computer Vision, 1993, 10 pages.
Cozman et al., "Robot Localization using a Computer Vision Sextant," IEEE International Midwest Conference on Robotics and Automation, pp. 106-111, 1995.
D'Orazio et al., "Model based Vision System for mobile robot position estimation", *SPIE*, vol. 2058 Mobile Robots VIII, pp. 38-49, 1992.
De Bakker et al., "Smart PSD—array for sheet of light range imaging", Proc. Of *SPIE*, vol. 3965, pp. 1-12, May 2000.
Denning Roboscrub image (1989), 1 page.
Desaulniers et al., "An Efficient Algorithm to find a shortest path for a car-like Robot," *IEEE Transactions on robotics and Automation* , 11(6):819-828, Dec. 1995.
Dorfmüller-Ulhaas, "Optical Tracking From User Motion to 3D Interaction," http://www.cg.tuwien.ac.at/research/publications/2002/Dorfmueller-Ulhaas-thesis, 182 pages, 2002.
Dorsch et al., "Laser Triangulation: Fundamental uncertainty in distance measurement," *Applied Optics*, 33(7):1306-1314, Mar. 1994.
Doty et al., "Sweep Strategies for a Sensory-Driven, Behavior-Based Vacuum Cleaning Agent," AAAI 1993 Fall Symposium Series, Instantiating Real-World Agents, pp. 1-6, Oct. 22-24, 1993.
Dudek et al., "Localizing a Robot with Minimum Travel" *Proceedings of the sixth annual ACM-SIAM symposium on Discrete Algorithms*, 27(2):583-604, Apr. 1998.
Dulimarta et al., "Mobile Robot Localization in Indoor Environment", *Pattern Recognition*, 30(1):99-111, 1997.
Dyson's Robot Vacuum Cleaner—the DC06, May 2004, Retrieved from the Internet: URL< http://www.gizmag.com/go/1282/>. Accessed Nov. 2011, 3 pages.
EBay, "Roomba Timer -> Timed Cleaning—Floorvac Robotic Vacuum," Retrieved from the Internet: URL Cgi.ebay.com/ws/eBayISAPI.dll?viewitem&category=43526&item=4375198387&rd=1, 5 pages, Apr. 2005.
Electrolux Trilobite, "Time to enjoy life," Retrieved from the Internet: URL<http://www.robocon.co.kr/trilobite/Presentation_Trilobite_Kor_030104.ppt, 26 pages, accessed Dec. 2011.
Electrolux Trilobite, Jan. 12, 2001, http://www.electroluxui.com:8080/2002%5C822%5C833102EN.pdf, accessed Jul. 2, 2012, 10 pages.
Electrolux, "Designed for the well-lived home," Retrieved from the Internet: URL<http://www.electroluxusa.com/node57.as[?currentURL=node142.asp%3F >. Accessed Mar. 2005, 5 pages.
Electrolux, "Welcome to the Electrolux trilobite," Retrieved from the Internet: URL<www.electroluxusa.com/node57.asp?currentURL=node142.asp%3F>. 2 pages, Mar. 2005.
Eren et al., "Accuracy in position estimation of mobile robots based on coded infrared signal transmission," Proceedings: Integrating Intelligent Instrumentation and Control, Instrumentation and Measurement Technology Conference, 1995, IMTC/95. pp. 548-551, 1995.
Eren et al., "Operation of Mobile Robots in a Structured Infrared Environment," Proceedings 'Sensing, Processing, Networking', IEEE Instrumentation and Measurement Technology Conference, 1997 (IMTC/97), Ottawa, Canada vol. 1, pp. 20-25, May 1997.
Euroflex, Jan. 2006, Retrieved from the Internet: URL< http://www.euroflex.tv/novita_dett.php?id=15, 1 page, accessed Nov. 2011.
eVac Robotic Vacuum S1727 Instruction Manual, Sharper Image Corp, Copyright 2004, 16 pages.
Everyday Robots, "Everyday Robots: Reviews, Discussion and News for Consumers," Retrieved from the Internet: URL< www.everydayrobots.com/index.php?option=content&task=view&id=9>. 7 pages, Apr. 2005.
Evolution Robotics, "NorthStar—Low-cost Indoor Localiztion—How it Works," E Evolution Robotics , 2 pages, 2005.
Facchinetti Claudio et al., "Self-Positioning Robot Navigation Using Ceiling Images Sequences," ACCV '95, 5 pages, Dec. 1995.
Facchinetti Claudio et al., "Using and Learning Vision-Based Self-Positioning for Autonomous Robot Navigation," ICARCV '94, vol. 3, pp. 1694-1698, 1994.
Facts on the Trilobite, Retrieved from the Internet: URL<http://www.frc.ri.cmu.edu/~hpm/talks/Extras/trilobite.desc.html >. 2 pages, accessed Nov. 2011.
Facts on Trilobite, webpage, Retrieved from the Internet: URL<http://trilobiteelectroluxse/presskit_en/model11335asp?print=yes&pressID=>. 2 pages, accessed Dec. 2003.
Fairfield et al., "Mobile Robot Localization with Sparse Landmarks," SPIE vol. 4573, pp. 148-155, 2002.
Favre-Bulle, "Efficient tracking of 3D—Robot Position by Dynamic Triangulation," IEEE Instrumentation and Measurement Technology Conference IMTC 98 Session on Instrumentation and Measurement in Robotics, vol. 1, pp. 446-449, May 1998.
Fayman, "Exploiting Process Integration and Composition in the context of Active Vision," IEEE Transactions on Systems, Man, and Cybernetics—Part C: Application and reviews, vol. 29, No. 1, pp. 73-86, Feb. 1999.
Florbot GE Plastics, 1989-1990, 2 pages, available at http://www.fuseid.com/, accessed Sep. 27, 2012.
Franz et al., "Biomimetric robot navigation", Robotics and Autonomous Systems, vol. 30 pp. 133-153, 2000.
Friendly Robotics, "Friendly Robotics—Friendly Vac, Robotic Vacuum Cleaner," Retrieved from the Internet: URL< www.friendlyrobotics.com/vac.htm > 5 pages, Apr. 2005.
Friendly Robotics, Retrieved from the Internet: URL<http://www.robotsandrelax.com/PDFs/RV400Manual.pdf>. 18 pages, accessed Dec. 2011.
Fuentes et al., "Mobile Robotics 1994," University of Rochester. Computer Science Department, TR 588, 44 pages, Dec. 1994.

(56) References Cited

OTHER PUBLICATIONS

Fukuda et al., "Navigation System based on Ceiling Landmark Recognition for Autonomous mobile robot," 1995 IEEE/RSJ International Conference on Intelligent Robots and Systems 95. 'Human Robot Interaction and Cooperative Robots', Pittsburgh, PA, pp. 1466/1471, Aug. 1995.
Gat, "Robust Low-Computation Sensor-driven Control for Task-Directed Navigation," Proc of IEEE International Conference on Robotics and Automation , Sacramento, CA pp. 2484-2489, Apr. 1991.
Gionis, "A hand-held optical surface scanner for environmental Modeling and Virtual Reality," . Virtual Reality World, 16 pages, 1996.
Goncalves et al., "A Visual Front-End for Simultaneous Localization and Mapping", Proceedings of the 2005 IEEE International Conference on Robotics and Automation, Barcelona, Spain, pp. 44-49, Apr. 2005.
Gregg et al., "Autonomous Lawn Care Applications," 2006 Florida Conference on Recent Advances in Robotics, Miami, Florida, May 25-26, 2006, Florida International University, 5 pages.
Grumet, "Robots Clean House," Popular Mechanics, Nov. 2003, 3 pages.
Hamamatsu "SI PIN Diode S5980, S5981 S5870—Multi-element photodiodes for surface mounting," Hamatsu Photonics, 2 pages, Apr. 2004.
Hammacher Schlemmer , "Electrolux Trilobite Robotic Vacuum," Retrieved from the Internet: URL< www.hammacher.com/publish/71579.asp?promo=xsells>. 3 pages, Mar. 2005.
Haralick et al. "Pose Estimation from Corresponding Point Data", *IEEE Transactions on Systems, Man, and Cybernetics*, 19(6):1426-1446, Nov. 1989.
Hausler, "About the Scaling Behaviour of Optical Range Sensors," Fringe '97, Proceedings of the 3rd International Workshop on Automatic Processing of Fringe Patterns, Bremen, Germany, pp. 147-155, Sep. 1997.
Hitachi 'Feature', http://kadenfan.hitachi.co.jp/robot/feature/feature.html, 1 page, Nov. 19, 2008.
Hitachi, http://www.hitachi.co.jp/New/cnews/hi_030529_hi_030529.pdf , 8 pages, May 29, 2003.
Hitachi: News release: "The home cleaning robot of the autonomous movement type (experimental machine)," Retrieved from the Internet: URL< www.i4u.com./japanreleases/hitachirobot.htm>. 5 pages, Mar. 2005.
Hoag et al., "Navigation and Guidance in interstellar space," ACTA Astronautica, vol. 2, pp. 513-533 , Feb. 1975.
Home Robot—UBOT; Microbotusa.com, retrieved from the WWW at www.microrobotusa.com, accessed Dec. 2, 2008, 2 pages.
Huntsberger et al., "CAMPOUT: A Control Architecture for Tightly Coupled Coordination of Multirobot Systems for Planetary Surface Exploration," *IEEE Transactions on Systems, Man, and Cybernetics—Part A: Systems and Humans*, 33(5):550-559, Sep. 2003.
Iirobotics.com, "Samsung Unveils Its Multifunction Robot Vacuum," Retrieved from the Internet: URL<.www.iirobotics.com/webpages/hotstuff.php?ubre=111>. 3 pages, Mar. 2005.
InMach "Intelligent Machines," Retrieved from the Internet: URL<www.inmach.de/inside.html>. 1 page , Nov. 2008.
Innovation First, "2004 EDU Robot Controller Reference Guide," Retrieved from the Internet: URL<http://www.ifirobotics.com>. 13 pages, Mar. 2004.
IT media, Retrieved from the Internet: URL<http://www.itmedia.co.jp/news/0111/16/robofesta_m.html>. Accessed Nov. 1, 2011, 4 pages.
It's eye, Retrieved from the Internet: URL< www.hitachi.co.jp/rd/pdf/topics/hitac2003_10.pdf>. 2 pages, 2003.
Jarosiewicz et al., "Final Report—Lucid," University of Florida, Departmetn of Electrical and Computer Engineering, EEL 5666—Intelligent Machine Design Laboratory, 50 pages, Aug. 1999.
Jensfelt et al., "Active Global Localization for a mobile robot using multiple hypothesis tracking," *IEEE Transactions on Robots and Automation*, 17(5): 748-760, Oct. 2001.
Jeong et al., "An intelligent map-building system for indoor mobile robot using low cost photo sensors,"*SPIE*, vol. 6042, 6 pages, 2005.
Kahney, "Robot Vacs are in the House," Retrieved from the Internet: URL<www.wired.com/news/technology/o,1282,59237,00.html>. 6 pages, Jun. 2003.
Karcher "Karcher RoboCleaner RC 3000," Retrieved from the Internet: URL<www.robocleaner.de/english/screen3.html>. 4 pages, Dec. 2003.
Karcher Product Manual Download webpage: Retrieved from the Internet: URL<http://www.karcher.com/bta/download.en.shtml?ACTION=SELECTTEILENR&ID=rc3000&submitButtonName=Select+Product+Manual and associated .pdf file "5959-915en.pdf (4.7 MB) English/English," 16 pages, accessed Jan. 2004.
Karcher RC 3000 Cleaning Robot-user manual Manufacturer: Alfred-Karcher GmbH & Co, Cleaning Systems, Alfred Karcher-Str 28-40, PO Box 160, D-71349 Winnenden, Germany, Dec. 2002.
Karcher USA "RC 3000 Robotics cleaner," : Retrieved from the Internet: URL<www.karcher-usa.com, 3 pages, Mar. 2005.
Karcher USA, RC3000 Robotic Cleaner, website: http://www.karcher-usa.com/showproducts.php?op=view prod&paraml=143&param2=&param3=, 6 pages, accessed Mar. 2005.
Karcher, "Product Manual Download Karch", available at www.karcher.com, 17 pages, 2004.
Karlsson et al, "Core Technologies for service Robotics," IEEE/RSJ International Conference on Intelligent Robots and Systems (IROS 2004), vol. 3, pp. 2979-2984, Sep. 2004.
Karlsson et al., The vSLAM Algorithm for Robust Localization and Mapping, Proceedings of the 2005 IEEE International Conference on Robotics and Automation, Barcelona, Spain, pp. 24-29, Apr. 2005.
King and Weiman, "HelpmateTM Autonomous Mobile Robots Navigation Systems," SPIE vol. 1388 Mobile Robots, pp. 190-198, 1990.
Kleinberg, The Localization Problem for Mobile Robots, Laboratory for Computer Science, Massachusetts Institute of Technology, 1994 IEEE, pp. 521-531, 1994.
Knights, et al., "Localization and Identification of Visual Landmarks," *Journal of Computing Sciences in Colleges*, 16(4):312-313, May 2001.
Kolodko et al., "Experimental System for Real-Time Motion Estimation," Proceedings of the 2003 IEEE/ASME International Conference on Advanced Intelligent Mechatronics (AIM 2003), pp. 981-986, 2003.
Komoriya et al., "Planning of Landmark Measurement for the Navigation of a Mobile Robot," Proceedings of the 1992 IEEE/RSJ International Cofnerence on Intelligent Robots and Systems, Raleigh, NC pp. 1476-1481, Jul. 1992.
Krotov et al., "Digital Sextant," Downloaded from the internet at: http://www.cs.cmu.edu/~epk/ , 1 page, 1995.
Krupa et al., "Autonomous 3-D Positioning of Surgical Instruments in Robotized Laparoscopic Surgery Using Visual Servoin," *IEEE Transactions on Robotics and Automation*, 19(5):842-853, Oct. 2003.
Kuhl et al., "Self Localization in Environments using Visual Angles," VRCAI '04 Proceedings of the 2004 ACM SIGGRAPH international conference on Virtual Reality continuum and its applications in industry, pp. 472-475, 2004.
Kurs et al, Wireless Power transfer via Strongly Coupled Magnetic Resonances, Downloaded from www.sciencemag.org, Aug. 2007, 5 pages.
Kurth, "Range-Only Robot Localization and SLAM with Radio", http://www.ri.cmu.edu/pub_files/pub4/kurth_derek_2004_1/kurth_derek_2004_1.pdf. 60 pages, May, 2004, accessed Jul. 27, 2012.
Kwon et al., "Table Recognition through Range-based Candidate Generation and Vision based Candidate Evaluation," ICAR 2007, The 13th International Conference on Advanced Robotics Aug. 21-24, 2007, Jeju, Korea, pp. 918-923, 2007.
Lambrinos et al., "A mobile robot employing insect strategies for navigation," Retrieved from the Internat: URL<http://www8.cs.umu.se/kurser/TDBD17/VT04/dl/Assignment%20Papers/lambrinos-RAS-2000.pdf>. 38 pages, Feb. 1999.
Lang et al., "Visual Measurement of Orientation Using Ceiling Features", 1994 IEEE, pp. 552-555, 1994.

(56) References Cited

OTHER PUBLICATIONS

Lapin, "Adaptive position estimation for an automated guided vehicle," *SPIE*, vol. 1831 Mobile Robots VII, pp. 82-94, 1992.
LaValle et al., "Robot Motion Planning in a Changing, Partially Predictable Environment," 1994 IEEE International Symposium on Intelligent Control, Columbus, OH, pp. 261-266, Aug. 1994.
Lee et al., "Development of Indoor Navigation system for Humanoid Robot Using Multi-sensors Integration", ION NTM, San Diego, CA pp. 798-805, Jan. 2007.
Lee et al., "Localization of a Mobile Robot Using the Image of a Moving Object," *IEEE Transaction on Industrial Electronics*, 50(3):612-619, Jun. 2003.
Leonard et al., "Mobile Robot Localization by tracking Geometric Beacons," *IEEE Transaction on Robotics and Automation*, 7(3):376-382, Jun. 1991.
Li et al. "Robust Statistical Methods for Securing Wireless Localization in Sensor Networks," Information Processing in Sensor Networks, 2005, Fourth International Symposium on, pp. 91-98, Apr. 2005.
Li et al., "Making a Local Map of Indoor Environments by Swiveling a Camera and a Sonar," Proceedings of the 1999 IEEE/RSJ International Conference on Intelligent Robots and Systems, pp. 954-959, 1999.
Lin et al., "Mobile Robot Navigation Using Artificial Landmarks," *Journal of robotics System*, 14(2): 93-106, 1997.
Linde, Dissertation—"On Aspects of Indoor Localization," Available at: https://eldorado.tu-dortmund.de/handle/2003/22854, University of Dortmund, 138 pages, Aug. 2006.
Lumelsky et al., "An Algorithm for Maze Searching with Azimuth Input", 1994 IEEE International Conference on Robotics and Automation, San Diego, CA vol. 1, pp. 111-116, 1994.
Luo et al., "Real-time Area-Covering Operations with Obstacle Avoidance for Cleaning Robots," IEEE, pp. 2359-2364, 2002.
Ma, Thesis—"Documentation on Northstar," California Institute of Technology, 14 pages, May 2006.
Madsen et al., "Optimal landmark selection for triangulation of robot position," Journal of Robotics and Autonomous Systems, vol. 13 pp. 277-292, 1998.
Malik et al., "Virtual Prototyping for Conceptual Design of a Tracked Mobile Robot," Electrical and Computer Engineering, Canadian Conference on, IEEE, PI. pp. 2349-2352, May 2006.
Martishevcky, "The Accuracy of point light target coordinate determination by dissectoral tracking system", SPIE vol. 2591, pp. 25-30, Oct. 23, 2005.
Maschinemarkt Wiirzburg 105, Nr. 27, pp. 3, 30, Jul. 5, 1999.
Matsumura Camera Online Shop: Retrieved from the Internet: URL<http://www.rakuten.co.jp/matsucame/587179/711512/>. Accessed Nov. 2011, 7 pages.
Matsutek Enterprises Co. Ltd, "Automatic Rechargeable Vacuum Cleaner," http://matsutek.manufacturer.globalsources.com/si/6008801427181/pdtl/Home-vacuum/10 . . . , Apr. 2007, 3 pages.
McGillem et al., "Infra-red Lacation System for Navigation and Autonomous Vehicles," 1988 IEEE International Conference on Robotics and Automation, vol. 2, pp. 1236-1238, Apr. 1988.
McGillem,et al. "A Beacon Navigation Method for Autonomous Vehicles," *IEEE Transactions on Vehicular Technology*, 38(3):132-139, Aug. 1989.
McLurkin "Stupid Robot Tricks: A Behavior-based Distributed Algorithm Library for Programming Swarms of Robots," Paper submitted for requirements of BSEE at MIT, May 2004, 127 pages.
McLurkin, "The Ants: A community of Microrobots," Paper submitted for requirements of BSEE at MIT, May 1995, 60 pages.
Miro et al., "Towards Vision Based Navigation in Large Indoor Environments," Proceedings of the IEEE/RSJ International Conference on Intelligent Robots and Systems, Beijing, China, pp. 2096-2102, Oct. 2006.
Miwako Doi "Using the symbiosis of human and robots from approaching Research and Development Center," Toshiba Corporation, 16 pages, available at http://warp.ndl.go.jp/info:ndljp/pid/258151/www.soumu.go.jp/joho_tsusin/policyreports/chousa/netrobot/pdf/030214_1_33_a.pdf, Feb. 26, 2003.
MobileMag, "Samsung Unveils High-tech Robot Vacuum Cleaner," Retrieved from the Internet: URL<http://www.mobilemag.com/content/100/102/C2261/>. 4 pages, Mar. 2005.
Monteiro et al., "Visual Servoing for Fast Mobile Robot: Adaptive Estimation of Kinematic Parameters," Proceedings of the IECON '93., International Conference on Industrial Electronics, Maui, HI, pp. 1588-1593, Nov. 1993.
Moore et al., "A simple Map-bases Localization strategy using range measurements," *SPIE*, vol. 5804 pp. 612-620, 2005.
Morland,"Autonomous Lawnmower Control", Downloaded from the internet at: http://cns.bu.edu/~cjmorlan/robotics/lawnmower/report.pdf, 10 pages, Jul. 2002.
Munich et al., "ERSP: A Software Platform and Architecture for the Service Robotics Industry," Intelligent Robots and Systems, 2005. (IROS 2005), pp. 460-467, Aug. 2005.
Munich et al., "SIFT-ing Through Features with ViPR", IEEE Robotics & Automation Magazine, pp. 72-77, Sep. 2006.
Nam et al., "Real-Time Dynamic Visual Tracking Using PSD Sensors and extended Trapezoidal Motion Planning", Applied Intelligence 10, pp. 53-70, 1999.
Nitu et al., "Optomechatronic System for Position Detection of a Mobile Mini-Robot," *IEEE Ttransactions on Industrial Electronics*, 52(4):969-973, Aug. 2005.
On Robo, "Robot Reviews Samsung Robot Vacuum (VC-RP3OW)," Retrieved from the Internet: URL <www.onrobo.com/reviews/AT_Home/vacuum_cleaners/on00vcrb30rosam/index.htm>. 2 pages, 2005.
OnRobo "Samsung Unveils Its Multifunction Robot Vacuum," Retrieved from the Internet: URL <www.onrobo.com/enews/0210/samsung_vacuum.shtml>. 3 pages, Mar. 2005.
Pages et al., "A camera-projector system for robot positioning by visual serving," Proceedings of the 2006 Conference on Computer Vision and Pattern Recognition Workshop (CVPRW06), 8 pages, Jun. 2006.
Pages et al., "Optimizing Plane-to-Plane Positioning Tasks by Image-Based Visual Servoing and Structured Light," *IEEE Transactions on Robotics*, 22(5):1000-1010, Oct. 2006.
Pages et al., "Robust decoupled visual servoing based on structured light," 2005 IEEE/RSJ, Int. Conf. on Intelligent Robots and Systems, pp. 2676-2681, 2005.
Park et al., "A Neural Network Based Real-Time Robot Tracking Controller Using Position Sensitive Detectors," IEEE World Congress on Computational Intelligence., 1994 IEEE International Conference on Neutral Networks, Orlando, Florida pp. 2754-2758, Jun./Jul. 1994.
Park et al., "Dynamic Visual Servo Control of Robot Manipulators using Neutral Networks," *The Korean Institute Telematics and Electronics*, 29-B(10):771-779, Oct. 1992.
Paromtchik "Toward Optical Guidance of Mobile Robots," Proceedings of the Fourth World Multiconference on Systemics, Cybermetics and Informatics, Orlando, FL, USA, Jul. 23, 2000, vol. IX, pp. 44-49, available at http://emotion.inrialpes.fr/~paromt/infos/papers/paromtchik:asama:sci:2000.ps.gz, accessed Jul. 3, 2012, 6 pages.
Paromtchik et al., "Optical Guidance System for Multiple mobile Robots," Proceedings 2001 ICRA. IEEE International Conference on Robotics and Automation, vol. 3, pp. 2935-2940, May 2001.
Penna et al., "Models for Map Building and Navigation", IEEE Transactions on Systems. Man. And Cybernetics., 23(5):1276-1301, Sep./Oct. 1993.
Pirjanian et al. "Representation and Execution of Plan Sequences for Multi-Agent Systems," Proceedings of the 2001 IEEE/RSJ International Conference on Intelligent Robots and Systems, Maui, Hawaii, pp. 2117-2123, Oct. 2001.
Pirjanian et al., "A decision-theoretic approach to fuzzy behavior coordination", 1999 IEEE International Symposium on Computational Intelligence in Robotics and Automation, 1999. CIRA '99., Monterey, CA, pp. 101-106, Nov. 1999.
Pirjanian et al., "Distributed Control for a Modular, Reconfigurable Cliff Robot," Proceedings of the 2002 IEEE International Conference on Robotics & Automation, Washington, D.C. pp. 4083-4088, May 2002.

(56) References Cited

OTHER PUBLICATIONS

Pirjanian et al., "Improving Task Reliability by Fusion of Redundant Homogeneous Modules Using Voting Schemes," Proceedings of the 1997 IEEE International Conference on Robotics and Automation, Albuquerque, NM, pp. 425-430, Apr. 1997.
Pirjanian et al., "Multi-Robot Target Acquisition using Multiple Objective Behavior Coordination," Proceedings of the 2000 IEEE International Conference on Robotics & Automation, San Francisco, CA, pp. 2696-2702, Apr. 2000.
Pirjanian, "Challenges for Standards for consumer Robotics," IEEE Workshop on Advanced Robotics and its Social impacts, pp. 260-264, Jun. 2005.
Pirjanian, "Reliable Reaction," Proceedings of the 1996 IEEE/SICE/RSJ International Conference on Multisensor Fusion and Integration for Intelligent Systems, pp. 158-165, 1996.
Popco.net, "Make your digital life," Retrieved from the Internet: URL<http://www.popco.net/zboard/view.php?id=tr_review&no=40>. 14 pages, Accessed Nov. 2011.
Prassler et al., "A Short History of Cleaning Robots," Autonomous Robots 9, 211-226, 2000, 16 pages.
Put Your Roomba . . . On, Automatic webpages: http://www.acomputeredge.com/roomba, 5 pages, accessed Apr. 2005.
Remazeilles et al., "Image based robot navigation in 3D environments," Proc. of *SPIE*, vol. 6052, pp. 1-14, Dec. 2005.
Retrieved from the Internet: URL<. http://www.karcher.de/versions/intg/assets/video/2_4_robo_en.swf>. Accessed Sep. 2009, 2 pages.
Rives et al., "Visual servoing based on ellipse features," *SPIE*, vol. 2056 Intelligent Robots and Computer Vision pp. 356-367, 1993.
Roboking—not just a vacuum cleaner, a robot!, Jan. 21, 2004, infocom.uz/2004/01/21/robokingne-prosto-pyilesos-a-robot/, accessed Oct. 10, 2011, 7 pages.
RoboMaid Sweeps Your Floors So You Won't Have to, the Official Site, website: Retrieved from the Internet: URL<http://therobomaid.com>. 2 pages, accessed Mar. 2005.
Robot Buying Guide, "LG announces the first robotic vacuum cleaner for Korea," Retrieved from the Internet: URL<http://robotbg.com/news/2003/04/22/lg_announces_the_firstroboticvacu>. 1 page, Apr. 2003.
Robotics World, "A Clean Sweep," 5 pages, Jan. 2001.
Ronnback, "On Methods for Assistive Mobile Robots," Retrieved from the Internet: URL<http://www.openthesis.org/documents/methods-assistive-mobile-robots-595019.html>. 218 pages, Jan. 2006.
Roth-Tabak et al., "Environment Model for mobile Robots Indoor Navigation," *SPIE*, vol. 1388 Mobile Robots, pp. 453-463, 1990.
Sahin et al., "Development of a Visual Object Localization Module for Mobile Robots," 1999 Third European Workshop on Advanced Mobile Robots, (Eurobot '99), pp. 65-72, 1999.
Salomon et al., "Low-Cost Optical Indoor Localization system for Mobile Objects without Image Processing," IEEE Conference on Emerging Technologies and Factory Automation, 2006. (ETFA '06), pp. 629-632, Sep. 2006.
Sato, "Range Imaging Based on Moving Pattern Light and Spatio-Temporal Matched Filter," Proceedings International Conference on Image Processing, vol. 1., Lausanne, Switzerland, pp. 33-36, Sep. 1996.
Schenker et al., "Lightweight rovers for Mars science exploration and sample return," Intelligent Robots and Computer Vision XVI, *SPIE* Proc. 3208, pp. 24-36, 1997.
Schofield, "Neither Master Nor slave—A Practical Study in the Development and Employment of Cleaning Robots, Emerging Technologies and Factory Automation," 1999 Proceedings ETFA '99 1999 7th IEEE International Conference on Barcelona, Spain, pp. 1427-1434, Oct. 1999.
Shimoga et al., "Touch and Force Reflection for Telepresence Surgery," Engineering in Medicine and Biology Society, 1994. Engineering Advances: New Opportunities for Biomedical Engineers. Proceedings of the 16th Annual International Conference of the IEEE, Baltimore, MD, pp. 1049-1050, 1994.
Sim et al, "Learning Visual Landmarks for Pose Estimation," IEEE International Conference on Robotics and Automation, vol. 3, Detroit, MI, pp. 1972-1978, May 1999.
Sobh et al., "Case Studies in Web-Controlled Devices and Remote Manipulation," Automation Congress, 2002 Proceedings of the 5th Biannual World, pp. 435-440, Dec. 2002.
Special Reports, "Vacuum Cleaner Robot Operated in Conjunction with 3G Celluar Phone," 59(9): 3 pages, Retrieved from the Internet: URL<http://www.toshiba.co.jp/tech/review/2004/09/59_0>. 2004.
Stella et al., "Self-Location for Indoor Navigation of Autonomous Vehicles," Part of the SPIE conference on Enhanced and Synthetic Vision SPIE vol. 3364, pp. 298-302, 1998.
Summet, "Tracking Locations of Moving Hand-held Displays Using Projected Light," Pervasive 2005, LNCS 3468, pp. 37-46, 2005.
Svedman et al., "Structure from Stereo Vision using Unsynchronized Cameras for Simultaneous Localization and Mapping," 2005 IEEE/RSJ International Conference on Intelligent Robots and Systems, pp. 2993-2998, 2005.
SVET Computers—New Technologies—Robot Vacuum Cleaner, Oct. 1999, available at http://www.sk.rs/1999/10/sknt01.html, 1 page, accessed Nov. 1, 2011.
Taipei Times, "Robotic vacuum by Matsuhita about to undergo testing," Retrieved from the Internet: URL<http://www.taipeitimes.com/News/worldbiz/archives/2002/03/26/0000129338>. accessed Mar. 2002, 2 pages.
Takio et al., "Real-Time Position and Pose Tracking Method of Moving Object Using Visual Servo System," 47th IEEE International Symposium on Circuits and Systems, pp. 167-170, 2004.
Tech-on!, Retrieved from the Internet: URL<http://techon.nikkeibp.co.jp/members/Oldb/200203/1006501/>. 4 pages, accessed Nov. 2011.
Teller, "Pervasive pose awareness for people, Objects and Robots," http://www.ai.mit.edu/lab/dangerous-ideas/Spring2003/teller-pose.pdf, 6 pages, Apr. 2003.
Terada et al., "An Acquisition of the Relation between Vision and Action using Self-Organizing Map and Reinforcement Learning," 1998 Second International Conference on Knowledge-Based Intelligent Electronic Systems, Adelaide, Australia, pp. 429-434, Apr. 1998.
The Sharper Image, eVac Robotic Vacuum—Product Details, www.sharperiamge.com/us/en/templates/products/pipmorework1printable.jhtml, 1 page, Mar. 2005.
TheRobotStore.com, "Friendly Robotics Robotic Vacuum RV400—The Robot Store," www.therobotstore.com/s.nl/sc.9/category.-109/it.A/id.43/E, 1 page, Apr. 2005.
Thrun, Sebastian, "Learning Occupancy Grid Maps With Forward Sensor Models," Autonomous Robots 15, 28 pages, Sep. 1, 2003.
TotalVac.com, RC3000 RoboCleaner website, Mar. 2005, 3 pages.
Trebi-Ollennu et al., "Mars Rover Pair Cooperatively Transporting a Long Payload," Proceedings of the 2002 IEEE International Conference on Robotics & Automation, Washington, D.C. pp. 3136-3141, May 2002.
Tribelhorn et al., "Evaluating the Roomba: A low-cost, ubiquitous platform for robotics research and education," IEEE, pp. 1393-1399, 2007.
Tse et al., "Design of a Navigation System for a Household Mobile Robot Using Neural Networks," Department of Manufacturing Engg. & Engg. Management, City University of Hong Kong, pp. 2151-2156, 1998.
UAMA (Asia) Industrial Co., Ltd., "RobotFamily," 2005, 1 page.
UBOT, cleaning robot capable of wiping with a wet duster, Retrieved from the Internet: URL<http://us.aving.net/news/view.php?articleId=23031>. 4 pages, accessed Nov. 2011.
Watanabe et al., "Position Estimation of Mobile Robots With Internal and External Sensors Using Uncertainty Evolution Technique," 1990 IEEE International Conference on Robotics and Automation, Cincinnati, OH, pp. 2011-2016, May 1990.
Watts, "Robot, boldly goes where no man can," The Times—pp. 20, Jan. 1985.
Wijk et al., "Triangulation-Based Fusion of Sonar Data with Application in Robot Pose Tracking," *IEEE Transactions on Robotics and Automation*, 16(6):740-752, Dec. 2000.

(56) References Cited

OTHER PUBLICATIONS

Wolf et al., "Robust Vision-Based Localization by Combining an Image-Retrieval System with Monte Carol Localization,", *IEEE Transactions on Robotics*, 21(2):208-216, Apr. 2005.
Wolf et al., "Robust Vision-based Localization for Mobile Robots Using an Image Retrieval System Based on Invariant Features," Proceedings of the 2002 IEEE International Conference on Robotics & Automation, Washington, D.C., pp. 359-365, May 2002.
Wong, "EIED Online>> Robot Business", ED Online ID# 13114, 17 pages, Jul. 2006.
Yamamoto et al., "Optical Sensing for Robot Perception and Localization," 2005 IEEE Workshop on Advanced Robotics and its Social Impacts, pp. 14-17, 2005.
Yata et al., "Wall Following Using Angle Information Measured by a Single Ultrasonic Transducer," Proceedings of the 1998 IEEE, International Conference on Robotics & Automation, Leuven, Belgium, pp. 1590-1596, May 1998.
Yujin Robotics,"An intelligent cleaning robot," Retrieved from the Internet: URL<http://us.aving.net/news/view.php?articleId=7257>. 8 pages, accessed Nov. 2011.
Yun et al., "Image-Based Absolute Positioning System for Mobile Robot Navigation," IAPR International Workshops SSPR, Hong Kong, pp. 261-269, Aug. 2006.
Yun et al., "Robust Positioning a Mobile Robot with Active Beacon Sensors," *Lecture Notes in Computer Science*, 2006, vol. 4251, pp. 890-897, 2006.
Yuta et al., "Implementation of an Active Optical Range sensor Using Laser Slit for In-Door Intelligent Mobile Robot," IEE/RSJ International Workshop on Intelligent Robots and Systems (IROS 91) vol. 1, Osaka, Japan, pp. 415-420, Nov. 3-5, 1991.
Zha et al., "Mobile Robot Localization Using Incomplete Maps for Change Detection in a Dynamic Environment," Advanced Intelligent Mechatronics '97. Final Program and Abstracts., IEEE/ASME International Conference, pp. 110, Jun. 1997.
Zhang et al., "A Novel Mobile Robot Localization Based on Vision," *SPIE* vol. 6279, 6 pages, Jan. 2007.
International Search Report and Written Opinion issued in International Application No. PCT/US2007/069389, dated Feb. 14, 2008, 9 pages.
International Preliminary Report on Patentability issued in International Application No. PCT/US2007/069389, dated Nov. 4, 2008, 9 pages.
Partial European Search Report issued in EP Application No. 12180805.9, dated Jul. 29, 2013, 6 pages.
Extended European Search Report issued in EP Application No. 12180805.9, dated Nov. 28, 2013, 5 pages.
European Search Report issued in EP Application No. 12180798.6, dated Jul. 29, 2013, 3 pages.
European Search Report issued in EP Application No. 11180028.0, dated May 3, 2013, 3 pages.

* cited by examiner

COVERAGE ROBOTS AND ASSOCIATED CLEANING BINS

CROSS-REFERENCE TO RELATED APPLICATIONS

This U.S. patent application is a continuation of and claims priority under 35 U.S.C. § 120 to U.S. application Ser. No. 11/751,267, filed May 21, 2007, which claims priority, under 35 U.S.C. § 119(e) to U.S. provisional patent applications 60/747,791, filed on May 19, 2006, 60/803,504, filed on May 30, 2006, and 60/807,442, filed on Jul. 14, 2006. The entire contents of the aforementioned applications are hereby incorporated by reference.

TECHNICAL FIELD

This disclosure relates to autonomous coverage robots and associated cleaning bins.

BACKGROUND

Autonomous robots are robots which can perform desired tasks in unstructured environments without continuous human guidance. Many kinds of robots are autonomous to some degree. Different robots can be autonomous in different ways. An autonomous coverage robot traverses a work surface without continuous human guidance to perform one or more tasks. In the field of home, office and/or consumer-oriented robotics, mobile robots that perform household functions such as vacuum cleaning, floor washing, patrolling, lawn cutting and other such tasks have been widely adopted.

SUMMARY

In one aspect, an autonomous coverage robot includes a chassis, a drive system mounted on the chassis and configured to maneuver the robot, and a cleaning assembly carried by the chassis. The cleaning assembly includes a cleaning assembly housing and at least one driven sweeper brush rotatably coupled to the cleaning assembly housing. The robot includes a controller carried by the chassis and a removable sweeper bin attached to the chassis. The sweeper bin is configured to receive debris agitated by the driven sweeper brush. The sweeper bin includes an emitter disposed on an interior surface of the bin and a receiver disposed remotely from the emitter on the interior surface of the bin. The receiver is configured to receive a signal emitted by the emitter. The emitter and the receiver are disposed such that a threshold level of accumulation of debris in the sweeper bin blocks the receiver from receiving emissions from the emitter. The robot includes a bin controller disposed in the sweeper bin and monitoring a signal from the detector and initiating a bin full routine upon determining a bin debris accumulation level requiring service.

Implementations of this aspect of the disclosure may include one or more of the following features. The cleaning bin is removably attached to the chassis. In some implementations, a diffuser is positioned over the emitter to diffuse the emitted signal. The receiver receives the diffused emissions. Accumulation of debris in the bin at least partially blocks the diffused emissions from being received by the receiver. The emitter may include an infrared light emitter diffused by a translucent plastic sheet. In some examples, the emitter is disposed on a first interior lateral surface of the bin and the receiver is disposed on an opposing, second interior lateral surface of the bin. The emitter and the receiver may be arranged for a determination of debris accumulation within substantially an entire volume of the bin. In some implementations, the coverage robot bin-full detection system includes a human perceptible indicator providing an indication that autonomous operation may be interrupted for bin servicing. The cleaning bin may include a vacuum assembly having an at least partially separate entrance path into the bin. In some examples, the cleaning bin includes a plurality of teeth disposed substantially along a mouth of the bin between a sweeper bin portion and a vacuum bin portion housing the vacuum assembly. The teeth are configured to strip debris from the rotating sweeper brush and the debris is allowed to accumulate in the sweeper bin portion.

In another aspect, a coverage robot bin-full detection system includes a cleaning bin housing configured to be received by a cleaning robot and a bin capacity sensor system carried by the cleaning bin housing. The bin capacity sensor system includes at least one signal emitter disposed on an interior surface of the cleaning bin housing and at least one signal detector disposed on the interior surface of the cleaning bin housing. The detector is configured to receive a signal emitted by the emitter. The coverage robot bin-full detection system includes a controller carried by the cleaning bin housing and a remote indicator in wireless communication with the controller. The controller monitors a signal from the detector and determines a cleaning service requirement. The remote indicator provides an indication of the cleaning service requirement determined by the controller.

Implementations of this aspect of the disclosure may include one or more of the following features. In some implementations, the cleaning bin housing defines a sweeper bin portion and a vacuum bin portion. The cleaning bin housing may include a vacuum assembly housed by the vacuum bin portion. The emitter may be an infrared light emitter. In some implementations, the controller is configured to determine a robot stuck condition and communicate the robot stuck condition to the wireless remote indicator. The remote indicator may be configured to communicate commands to the bin controller. The bin controller may communicate with a controller of the robot.

In yet another aspect, a method of detecting fullness of a cleaning bin of an autonomous coverage robot includes determining an empty bin threshold signal value by reading a signal received from a bin-fullness detection system while the cleaning bin is empty. After a predetermined period of time, the method includes detecting a present bin signal value by reading the signal from the detection system. The method includes comparing the empty bin threshold signal value with the present bin signal value to determine a signal value difference. Then the method includes, in response to determining that the signal difference is greater than a predetermined amount, activating a bin full indicator.

Implementations of this aspect of the disclosure may include one or more of the following features. The method may include periodically determining the check bin signal and the signal difference, wherein the indicator is activated when the check bin signals is greater than the empty bin threshold signal. The indicator maybe activated when multiple check bin signals over the period of time are greater than the empty bin threshold signal. The emitter may be an infrared light emitter. In some examples, a diffuser positioned over the emitter to diffuse the emitted signal. In some implementations, the emitter is disposed on a first interior surface of the cleaning bin housing and the detector is disposed on an opposing, second interior surface of the cleaning bin housing.

The details of one or more implementations of the disclosure are set fourth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1A:
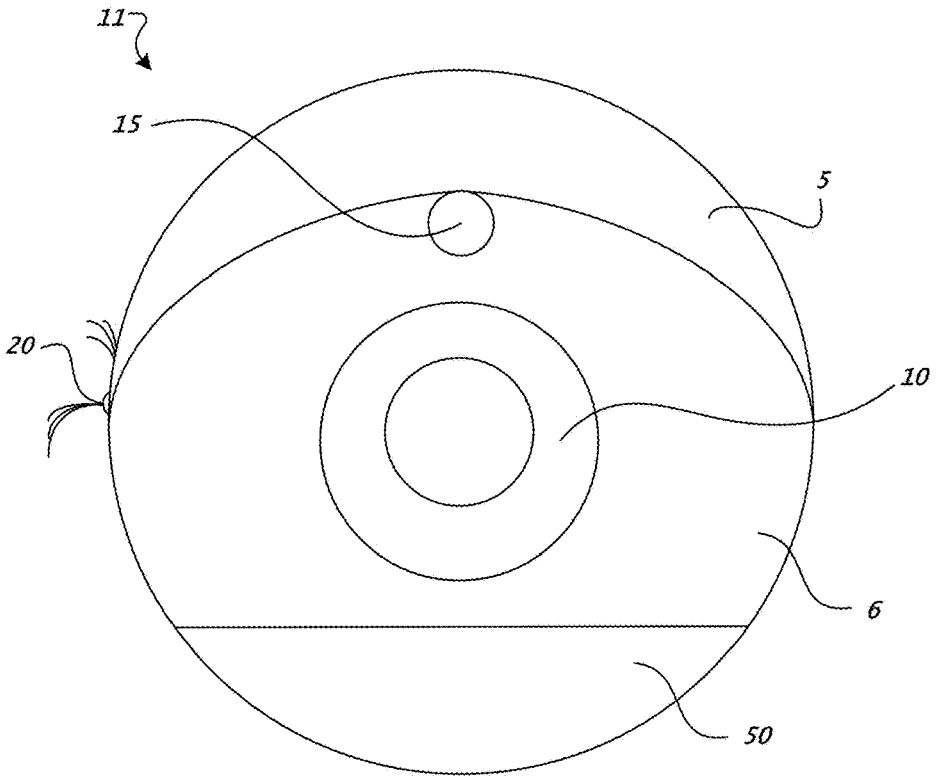
FIG. 1A is a top view of an autonomous robotic cleaner.

Referring to FIGS. 1A-1D, an autonomous robotic cleaner 11 includes a chassis 31 which carries an outer shell 6. FIG. 1A illustrates the outer shell 6 of the robot 11 connected to a bumper 5. An omnidirectional receiver 15 and a control panel 10 are both carried by the outer shell 6. The omnidirectional receiver 15 has a 360 degree line of vision that allows detection of signals emitted towards the robot 11 from substantially all directions.

Figure 1B:
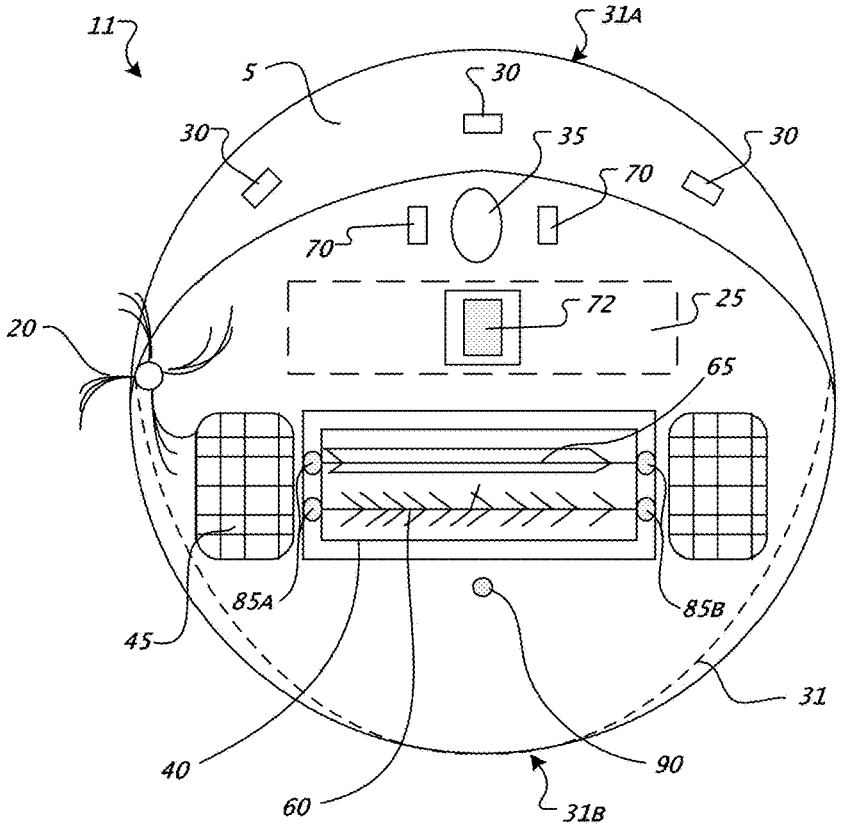
FIG. 1B is a bottom view of an autonomous robotic cleaner.

Referring to FIG. 1B, the robot 11 may move in forward and reverse drive directions; consequently, the chassis 31 has corresponding forward and back ends, 31A and 31B respectively. Infrared light (IR) cliff sensors 30 are installed on the underside of the robot 11 proximate the forward end 31A of the chassis 31. The cliff sensors 30 are configured to detect sudden changes in floor characteristics indicative of an edge or cliff of the floor (e.g. an edge of a stair). The forward end 31A of the chassis 31 includes a caster wheel 35 which provides additional support for the robot 11 as a third point of contact with the floor and does not hinder robot mobility. Located proximate to and on either side of the caster wheel 35 are two wheel-floor proximity sensors 70. The wheel-floor proximity sensors 70 are configured to detect sudden changes in floor characteristics indicative of an edge or cliff of the floor (e.g. an edge of a stair). The wheel-floor proximity sensors 70 provide redundancy should the primary cliff sensors 30 fail to detect an edge or cliff. In some implementations, the wheel-floor proximity sensors 70 are not included, while the primary cliff sensors 31 remain installed along the bottom front edge of the chassis 31. A lock assembly 72 on a bottom side of robot chassis 31 is configured to engage a corresponding lock assembly installed on a maintenance station for securing the robot 11 during servicing.

A cleaning head assembly 40 is located towards the middle of the robot 11 and installed within the chassis 31. The cleaning head assembly 40 includes a main 65 brush and a secondary brush 60. A battery 25 is housed within the chassis 31 proximate the cleaning head assembly 40. In some examples, the main 65 and/or the secondary brush 60 are removable. In other examples, the cleaning head assembly 40 includes a fixed main brush 65 and/or secondary brush 60, where fixed refers to a brush permanently installed on the chassis 31.

Installed along either side of the chassis 31 are differentially driven wheels 45 that mobilize the robot 11 and provide two points of support. Also installed along the side of the chassis 31 is a side brush 20 configured to rotate 360 degrees when the robot 11 is operational. The rotation of the side brush 20 allows the robot 11 to better clean areas adjacent the robot's side, and areas otherwise unreachable by the centrally located cleaning head assembly 40.

Figure 1C:
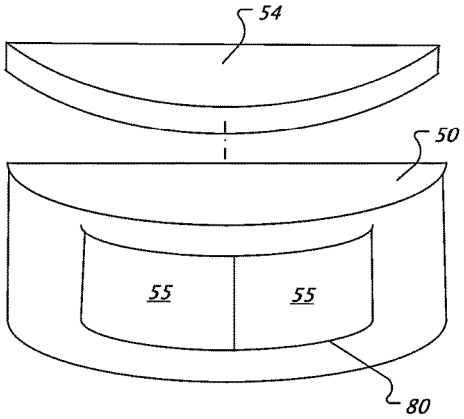
FIG. 1C is a side view of an autonomous robotic cleaner.

A removable cleaning bin 50 is located towards the back end 31B of the robot 11 and installed within the outer shell 6. The cleaning bin 50 is removable from the chassis 31 to provide access to bin contents and an internal filter 54. Additional access to the cleaning bin 50 may be provided via an evacuation port 80, as shown in FIG. 1C. In some implementations, the evacuation port 80 includes a set of sliding side panels 55 which slide along a side wall of the chassis 31 and under side panels of the outer shell 6 to open the evacuation port 80. The evacuation port 80 is configured to mate with corresponding evacuation ports on a maintenance station 1250. In other implementations, the evacuation port 80 is installed along an edge of the outer shell 6, on a top most portion of the outer shell 6, on the bottom of the chassis 31, or other similar placements where the evacuation port 80 has ready access to the contents of the cleaning bin 50.

In some implementations, the robot 11 includes a communication module 90 installed on the bottom of the chassis 31. The communication module 90 provides a communication link between a maintenance station 1250 and the robot 11. The communication module 90, in some instances, includes both an emitter and a detector, and provides an alternative communication path while the robot 11 is located within the maintenance station 1250. In some implementations, the robot 11 includes a brush service sensor assembly 85 installed on either side of and proximate the cleaning head 40. The brush service sensor assembly 85 provides user and system feedback regarding a degree of filament wound about the main brush 65, the secondary brush 60, or both. The brush service sensor assembly 85 includes an emitter 85A for emitting modulated beams and a detector 85B configured to detect the beams. The emitter 85A and the detector 86B are positioned on opposite sides of the cleaning head 60, 65 and aligned to detect filament wound about the cleaning head 60, 65. The brush service sensor assembly 85 includes a signal processing circuit configured to receive and interpret detector output. The emitter 85A is aligned along a rotating axis of the brush 60, 65 and between rows of bristles (or flaps) so that when no errant filaments are present on the brush 60, 65, a signal transmission between the emitter 85A and the detector 86B is not blocked. A presence of a few errant filaments spooled about the brush 60, 65 partially blocks a signal transmission between the emitter 85A and the detector 86B. When accumulation of errant filaments wrapped about the brush 60, 65 circumferentially and longitudinally reaches a certain threshold, a signal transmission between the emitter 85A and the detector 86B is substantially blocked by a corresponding threshold amount. Accumulation of errant filaments across the whole brush or locally in a ring clump are both detected at an appropriate time for maintenance.

Figure 2:
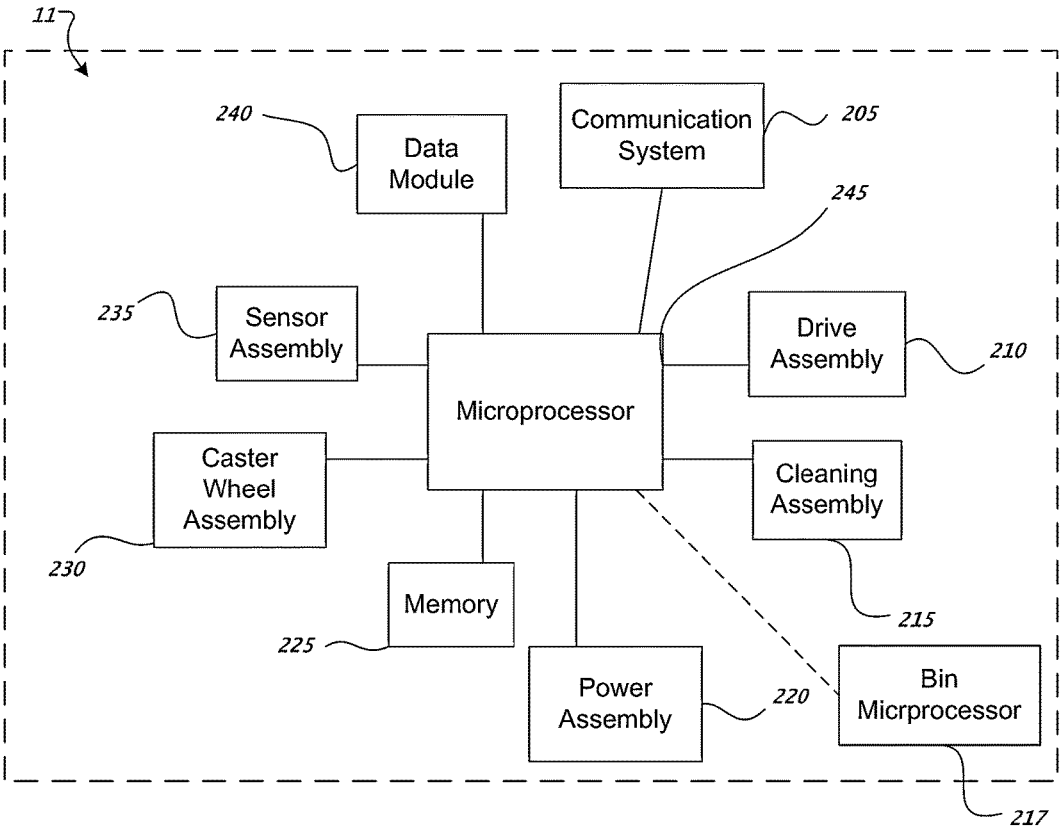
FIG. 2 is a block diagram of systems of an autonomous robotic cleaner.

FIG. 2 is a block diagram of systems included within the robot 11. The robot 11 includes a microprocessor 245 capable of executing routines and generating and sending control signals to actuators within the robot 200. Connected to the microprocessor 245 is memory 225 for storing routines and sensor input and output, a power system 220 with a battery 25 and a plurality of amplifiers able to generate and distribute power to the microprocessor 245, and other components included within the robot 11. A data module 240 is connected to the microprocessor 245 which may include ROM, RAM, an EEPROM or Flash memory. The data module 240 may store values generated within the robot 11 or to upload new software routines or values to the robot 11.

The microprocessor 245 is connected to a plurality of assemblies and systems, one of which is the communication system 205 including an RS-232 transceiver, radio, Ethernet, and wireless communicators. The drive assembly 210 is connected to the microprocessor 245 and includes right and left differentially driven wheels 45, right and left wheel motors, and wheel encoders. The drive assembly 210 is operable to receive commands from the microprocessor 245 and generate sensor data transmitted back to the microprocessor 245 via the communication system 205. A separate caster wheel assembly 230 is connected to the microprocessor 245 and includes a caster wheel 35 and a wheel encoder. The cleaning assembly 215 is connected to the microprocessor 245 and includes a primary brush 65, a secondary brush 60, a side brush 20, and brush motors associated with each brush. Also connected to the microprocessor is the sensor assembly 235 which may include infrared proximity sensors 75, an omnidirectional detector 15, mechanical switches installed in the bumper 5, wheel-floor proximity sensors 70, stasis sensors, a gyroscope, and infrared cliff sensors 30.

Figure 3A:
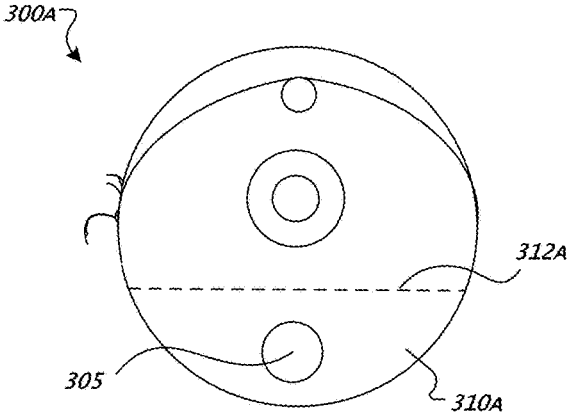
FIGS. 3A-3B are top views of autonomous robotic cleaners.

FIGS. 3A-3E illustrate various example locations of disposing the cleaning bin 50 and a filter 54 on the chassis 31 and the outer shell 6. FIG. 3A displays a robot 300A with an evacuation port 305 disposed on the top of the robot 300A, and more specifically installed on the top of a cleaning bin 310A. The cleaning bin 310A may or may not be removable from the chassis 31 and outer shell 6, and if removable, is removable such that the bin 310A separates from a back portion 312A of the robot 300A.

Figure 3B:
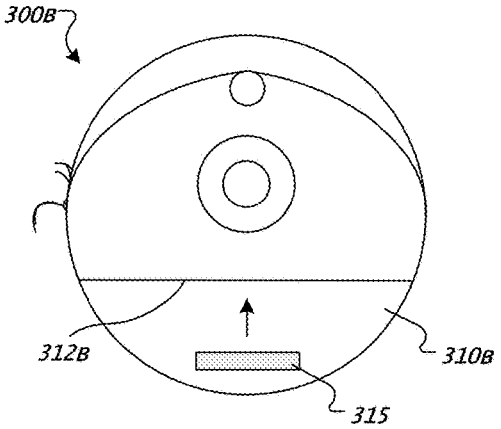

Referring to FIG. 3B, a cleaning bin 310B is installed towards the rearward end of a robot 310B and includes a latch 315. A top 311 of the cleaning bin 310B slides toward the forward end of the robot 310B when the latch 315 is manipulated, so that contents of the cleaning bin 310B can be removed. The outer shell 6 includes no latch for the removal of the filter 54. To access the filter 54, the cleaning bin 310B is removed from a back portion 312B of the robot 310B. In this implementation, the cleaning bin latch 315 may be manipulated manually by the operator or autonomously by a robotically driven manipulator.

Figure 3C:
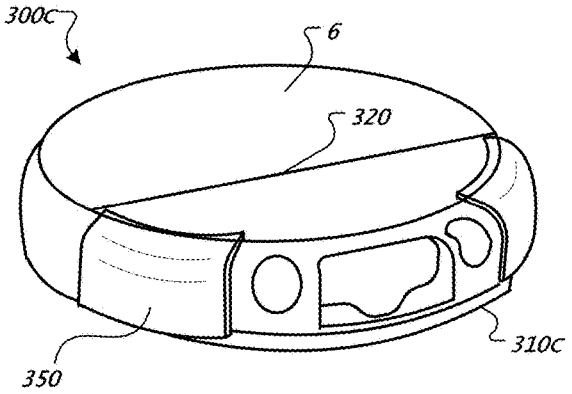
FIG. 3C is a rear perspective view of an autonomous robotic cleaner.

FIG. 3C illustrates a robot 300C including a cleaning bin 310C located on a rearmost side wall 320 of the outer shell 6. The cleaning bin 310C has a set of movable doors 350 that when actuated, slide along the side of the chassis 31 and under the outer shell 6. Once the doors 350 recess under the outer shell 6, the cleaning bin 310C is then configured to accept and mate with an external evacuation port.

Figure 3D:
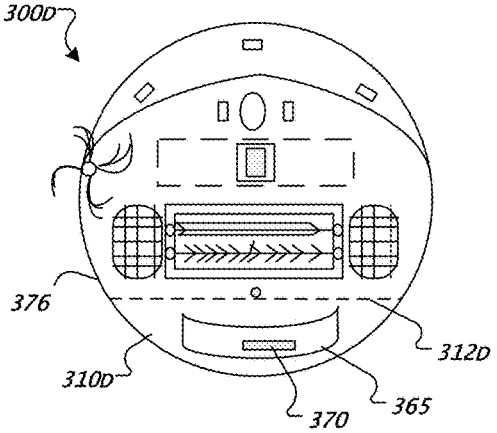
FIGS. 3D-3E are bottom views of autonomous robotic cleaners.

FIG. 3D provides a bottom view of a robot 300D and the bottom of the cleaning bin 310D located on the bottom back end of the robot 300D. The cleaning bin 310D has a latch 370 allowing a door 365 located on the bottom of cleaning bin 310D to slide towards the forward end of the robot 300D so that contents of the cleaning bin 310D may be removed. The filter 54 cannot be accessed from the outer shell 6. The cleaning bin 310D must be removed from a back portion 312D of the robot 300D to clean the filter 54. The cleaning bin 310D and latch 370 may be manipulated manually by an operator or autonomously by a robotically driven manipulator.

Figure 3E:
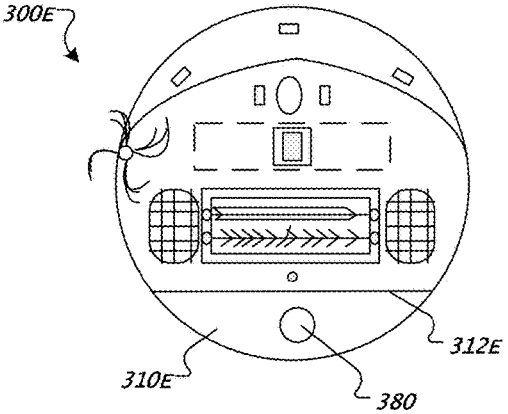

FIG. 3E provides a bottom view of a robot 300E and the floor of the cleaning bin 310E located on the bottom, back end of the robot 300E. The cleaning bin 310E includes a port 380 for accessing contents of the cleaning bin 310E. An evacuation hose may be attached to the port 380 to evacuate the cleaning bin 310E. The cleaning bin 310E must be removed from a back portion 312E of the robot 300D to access and clean the filter 54.

Figure 3F:
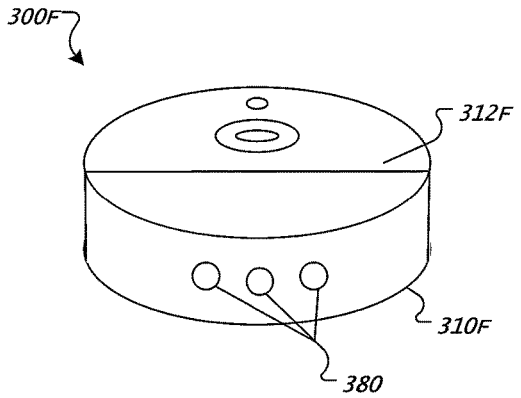
FIGS. 3F-3G are perspective views of an autonomous robotic cleaner.

Referring to FIG. 3F, a robot 300F includes a cleaning bin 310F located on a rear robot portion 312F. The cleaning bin 310F includes two or more evacuation ports 380 on a rear side (three are shown). The evacuation ports 380 are configured to receive an evacuation hose for removing debris from the bin 310F.

Figure 3G:
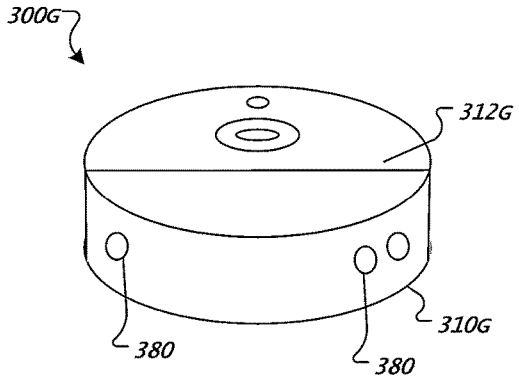

Referring to FIG. 3G, a robot 300G includes a cleaning bin 310G located on a rear robot portion 312G. The cleaning bin 310G includes one or more evacuation ports 380 on a side portion (e.g. left and/or right sides). The evacuation ports 380 are configured to receive an evacuation hose for removing debris from the bin 310G.

Figure 4A:
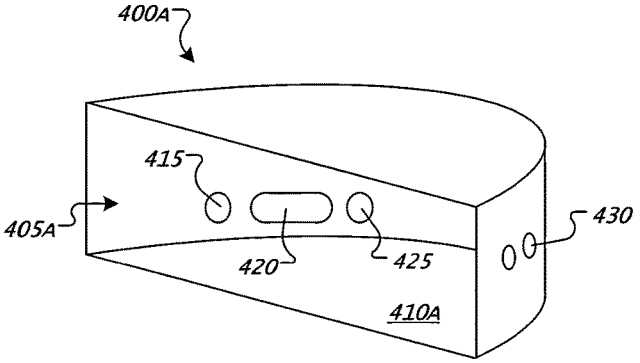
FIGS. 4A-4B are perspective views of removable cleaning bins.

The robotic cleaner 11 receives a number of different cleaning bins 50. Referring to FIG. 4A, a cleaning bin 400A is configured to mate with external vacuum evacuation ports. The vacuum bin 400A defines a main chamber 405A having a sloped floor 410A that aids movement of debris towards evacuation ports 415, 420, 425. A first side evacuation port 415 is located adjacent a center evacuation port 420 which is located between the first side evacuation port 415 and a second side evacuation port 425. Located on the side walls of the bin 400A are two evacuation outlets 430 that are installed to further aid a vacuum in its evacuation operation.

Figure 4B:
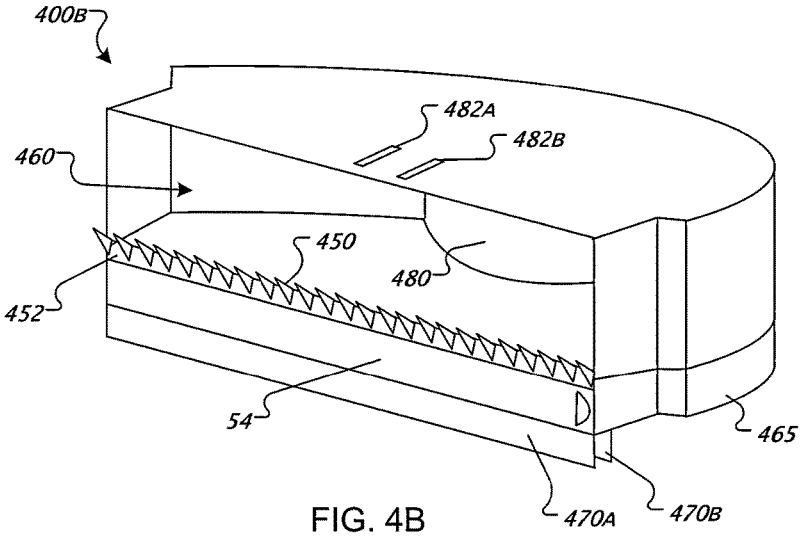

Referring to FIG. 4B, a bin 400B includes teeth 450 along a mouth edge 452 of the bin 400B. The teeth 450 reduce the amount of filament build up on the main brush 60 and/or the secondary brush 65 by placing the bin 400B close enough to the brush 60, 65 such that the teeth 492 slide under filament on the brush 60, 65 and pull off filament as the brush 60, 65 rotates. In some examples, the bin 400B includes between about 24-36 teeth. In the example shown, the bin 400B defines a sweeper bin portion 460 and a vacuum bin portion 465. The comb or teeth 450 are positioned between the sweeper bin portion 460 and the vacuum bin portion 465 and presented to lightly comb the sweeper brush 60. The comb or teeth 450 remove errant filaments from the sweeper brush 60 that accumulate either on the teeth 450 or in the sweeper bin portion 460. The vacuum bin portion 465 and the teeth 450 above it do not interfere with each other. The bin 400B carries a vacuum assembly 480 (e.g. a vacuum motor/fan) configured to draw debris past a pair of squeegees 470A and 470B in the vacuum bin portion 460. Electrical contacts 482A, 482B provide power to the vacuum assembly 480. In some examples, the electrical contacts 482A, 482B provide communication to a bin microprocessor 217. A filter 54 separates the vacuum bin portion 460 from the vacuum assembly 480. In some examples, the filter 54 pivots open along a side, top, or bottom edge for servicing. In other examples, the filter 54 slides out of the vacuum bin portion 460.

Figure 4C:
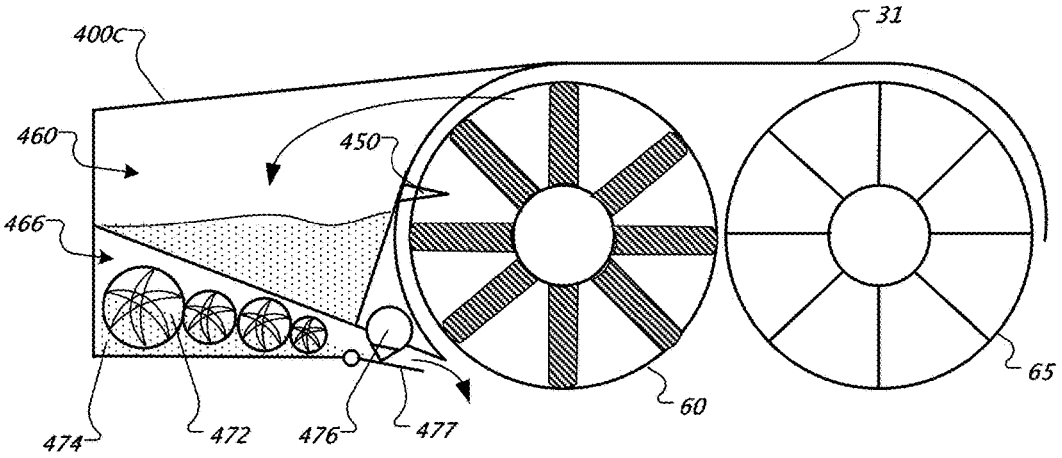
FIGS. 4C-4E are schematic views an autonomous robotic cleaner.

Referring to FIG. 4C, a bin 400C defines a sweeper bin portion 460 and a dispenser portion 466. The sweeper bin portion 460 is configured to receive debris agitated by the brush 60 and the flapper roller 65. The brush 60 and the flapper roller 65 may rotate in the same direction or opposite directions. The bin 400C includes driven vanes 472 configured to churn a substance 474 (e.g. powdered freshener) for dispersion. In some examples, a dispersion cam 476 (e.g. a single row of teeth on a rotatable shaft or roller) opens a spring biased flap 477 allowing the churned freshener to be disposed. In other examples, the dispersion cam 476 rotated among open and closed positions to control freshener dispersion. In some examples, the bin 400C includes teeth 450 disposed along a sweeper bin portion opening are configured to engage the brush 60 to remove filament and debris from the brush.

Figure 4D:
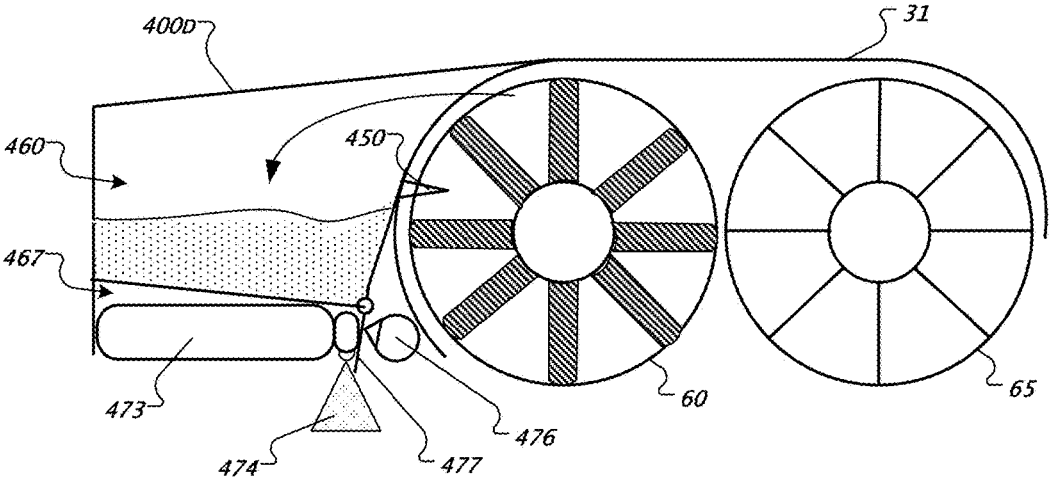

Referring to FIG. 4D, a bin 400D defines a sweeper bin portion 460 and a dispenser portion 467. The bin 400D includes a sprayer 473 configured to spray a substance 474 (e.g. liquid or powder freshener) when actuated by a dispersion cam 476. In some examples, the dispersion cam 476 rotates a spring biased flap 477 that actuates the sprayer 473.

Figure 4E:
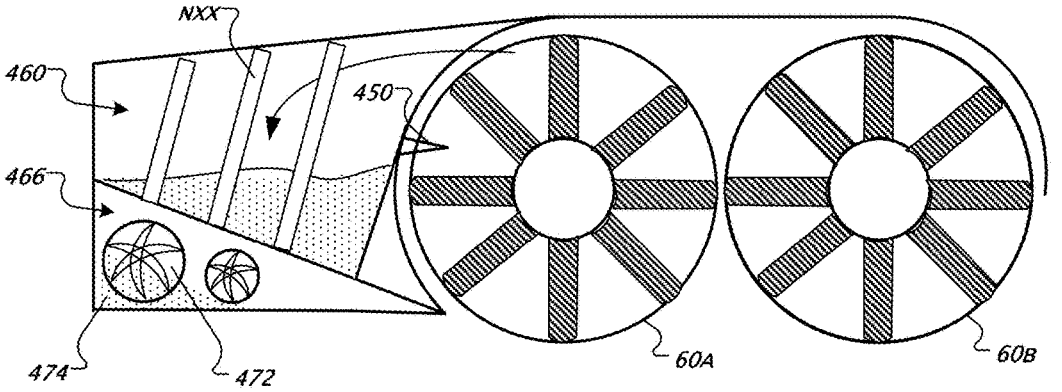

Referring to FIG. 4E, a bin 400E defines a sweeper bin portion 460 which includes at least one chased plate 468 configured to attract particulate or debris. In some examples, the bin 400E defines a dispenser portion 466 including driven vanes 472 configured to churn a substance 474 (e.g. powdered freshener) for dispersion. Air may be forced through dispenser portion 466 (e.g. via a fan) to treat the air.

Figure 5A:
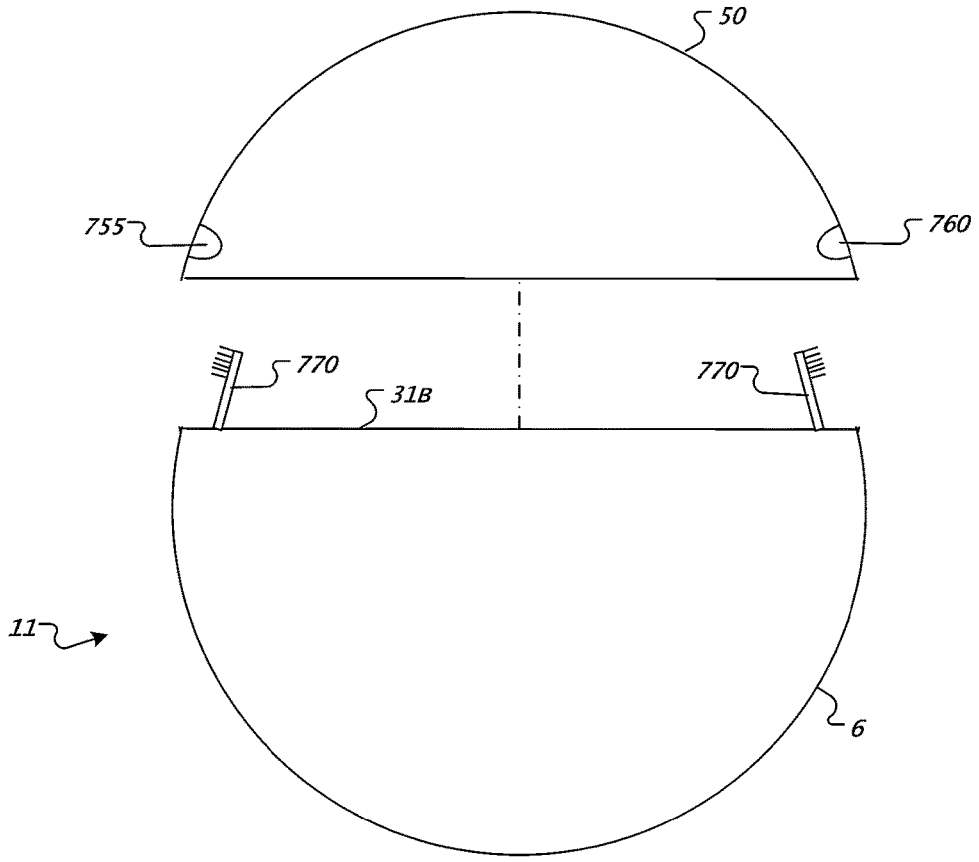
FIG. 5A is a top view of an autonomous robotic cleaner.
Figure 5B:
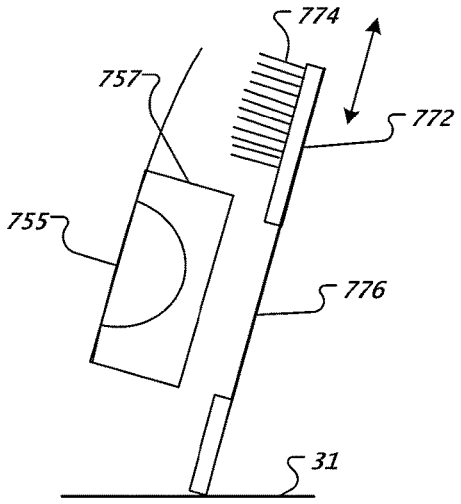
FIG. 5B is a top view of a bin sensor brush.

Referring to FIGS. 5A-5B, in some instances, the bin 50 includes a bin-full detection system 700 for sensing an amount of debris present in the bin 50. In one implementation, the bin-full detection system includes an emitter 755 and a detector 760 housed in the bin 50. A housing 757 surrounds each of the emitter 755 and the detector 760 and is substantially free from debris when the bin 50 is also free of debris. In one implementation, the bin 50 is detachably connected to the robotic cleaner 11 and includes a brush assembly 770 for removing debris and soot from the surface of the emitter/detector housing 757. The brush assembly 770 includes a brush 772 mounted on the chassis 31 and configured to sweep against the emitter/detector housing 757 when the bin 50 is removed from or attached to the robot 11. The brush 772 includes a cleaning head 774 (e.g. bristles or sponge) at a distal end farthest from the robot 11 and a window section 776 positioned toward a base of the brush 772 and aligned with the emitter 755 or detector 760 when the bin 50 is attached to the robot 11. The emitter 755 transmits and the detector 760 receives light through the window 776. In addition to brushing debris away from the emitter 755 and detector 760, the cleaning head 774 prevents debris or dust from reaching the emitter 755 and detector 760 when the bin 50 is attached to the robot 11. In some examples, the window 776 comprises a transparent or translucent material and formed integrally with the cleaning head 774. In some examples, the emitter 755 and the detector 760 are mounted on the chassis 31 of the robot 11 and the cleaning head 774 and/or window 776 are mounted on the bin 50.

Figure 6A:
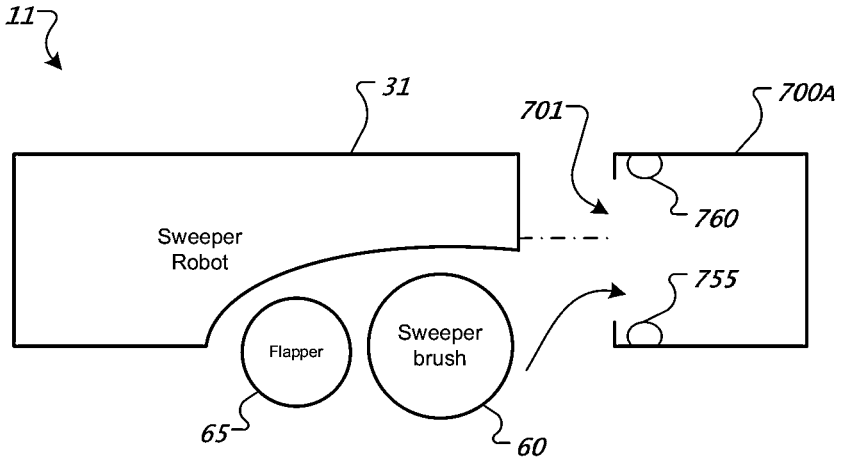
FIGS. 6A-6C are schematic views of autonomous robotic cleaners.
Figure 6B:
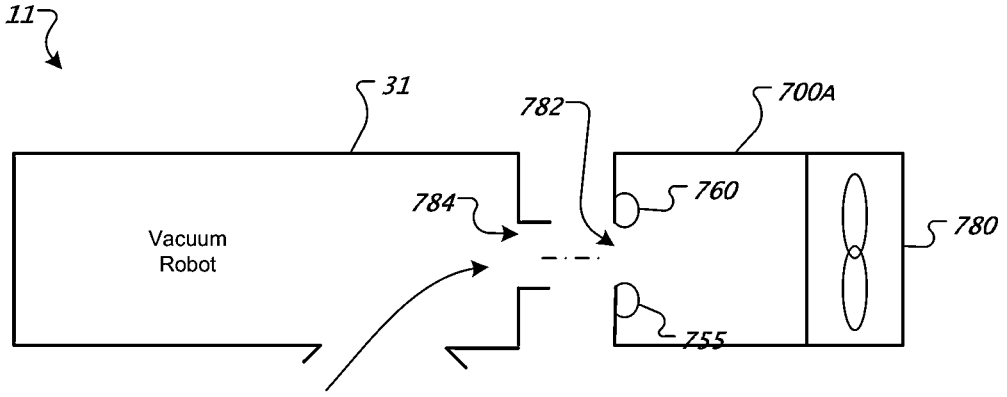

FIG. 6A illustrates a sweeper robot 11 including a brush 60 and a flap 65 that sweep debris into a bin 700A having an emitter 755 and a detector 760 both positioned near a bin mouth 701. FIG. 6B illustrates an implementation in which a bin 700B includes a vacuum/blower motor 780, and an emitter 755 and a detector 760 located near an inlet 782 of a vacuum flow path into the bin 700B. The chassis 31 of the robot 11 includes a robot vacuum outlet 784 that fits flush with the vacuum inlet 782 of the bin 700B. By placing the emitter 755 and the detector 760 near the debris inlet 782, the debris is measured along the intake flow path rather than within the debris chamber 785. Therefore, a bin-full condition is triggered when either the amount of debris swept or vacuumed along the flow path is extremely high (which may typically be a rare scenario), or when the debris chamber 785 is full (e.g. debris is no longer deposited therein, but instead backs up along the intake flow path near the inlet 782).

Figure 6C:
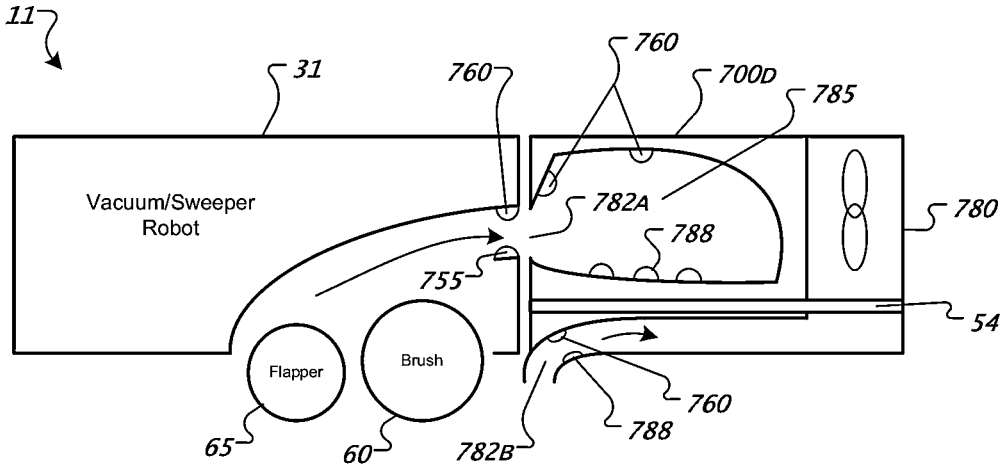

FIG. 6C illustrates a combined vacuum/sweeper bin 700C including an emitter 755 and a detector 760 pair positioned near a sweeper bin inlet 782A and a vacuum bin inlet 782B. An emitter 755 and a detector 760 are mounted on the chassis 31 of the robot 11 near the bin inlet 782. Alternatively to or in combination with the inlet sensors 755, 760, several emitter arrays 788 are positioned on a bottom interior surface of the bin 700C and one or more detectors 760 are positioned on a top interior surface of the bin 700C. Signals from the detectors 760 located along the intake flow path, as well as the container of the bin 700C, may be compared for determining bin fullness. For example, when a heavy volume of debris is pulled into the bin 700C by the brush 60, flapper 65, and/or vacuum motor 780, the detectors 760 located along the flow path may generate a low detection signal. However, detectors 760 located on the top interior surface of the bin 700D will not detect a full bin 700C, if it is not yet full. Comparison of the detector signals avoids a false bin-full condition.

Figure 7A:
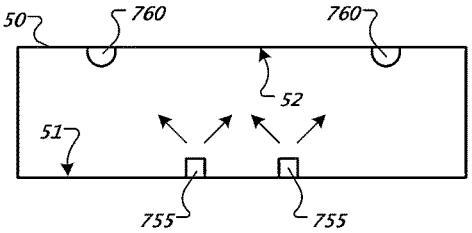
FIGS. 7A-7B are front views of removable cleaning bins.

FIGS. 7A-7E illustrate a transmissive optical debris-sensing system for detecting debris within the bin 50. As shown in FIG. 7A, in some examples, the bin 50 includes emitters 755 located on a bottom interior surface 51 of the bin 50 and detectors 760 located on an upper interior surface 52 of the bin 50. The emitters 755 emit light that traverses the interior of the bin 50 and which may be detected by the detectors 760. When the interior of the bin 50 is clear of debris, the transmitted light from the emitters 755 produces a relatively high signal strength in the detectors 760, because very little of the transmitted light is diverted or deflected away from the detectors 760 as the transmitted light passes through the empty interior of the bin 50. By contrast, when the interior of the bin 50 contains debris, at least some of the light transmitted from the emitters 755 is absorbed, reflected, or diverted as the light strikes the debris, such that a lower proportion of the emitted light reaches the detectors 760. The degree of diversion or deflection caused by the debris in the interior of the bin 50 correlates positively with the amount of debris within the bin 50.

By comparing the signals generated by the detectors 760 when the bin 50 does not contain debris to subsequent signal readings obtained by the detectors 760 as the robot 11 sweeps and vacuums debris into the bin 50 during a cleaning cycle, the presence of debris within the bin 50 may be determined. For example, when the subsequently polled detector signals are compared to initial detector signals (taken when the bin 50 is empty), a determination can be made whether the debris accumulated within the bin 50 has reached a level sufficient to trigger a bin-full condition.

One example bin configuration includes one emitter 755 and two detectors 760. Another configuration includes positioning one or more emitters 755 and detectors 760 in cross-directed in mutually orthogonal directions. The robot 11 may determine that heavy debris has accumulated on the bottom of the bin 50 but has not filled the bin 50, when signals generated by a first detector 760 on the inner top surface 52 is relatively low and signals generated by a second detector 760 on an inner side wall (which detects horizontally-transmitted light) does not meet a bin-full threshold. On the other hand, when both detectors 760 report a relatively low received-light signal, it may be determined that the bin 50 is full.

Figure 7B:
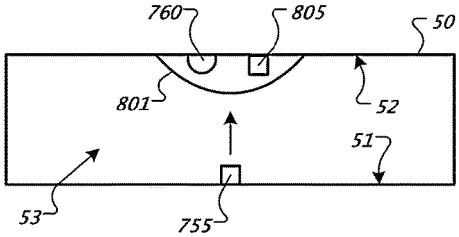

FIG. 7B illustrates a bin configuration in which the bin 50 includes a detector 760 located proximate a calibration emitter 805, both disposed behind a shield 801 on the top interior surface 52 of the bin 50. An emitter 755 is disposed on the bottom interior surface 51 of the bin 50. A calibration signal reading is obtained by emitting light from the calibration emitter 805 which is then detected by the detector 760 as a first reading. The translucent or transparent shield 801 prevents emission interfere between the transmission of light from the calibration emitter 805 to the detector 760 with dust or debris from the bin 50. The emitter 755 then transmits light across the interior of the bin 50 and the detector 760 takes a second reading of received light. By comparing the second reading to the first reading, a determination may be made whether the bin 50 is full of debris. In some examples, the robot 11 includes sensors 755, 760 positioned along a debris flow path prior to a mouth 53 of the bin 50. The bin full sensors 755, 760 may detect debris tending to escape from the bin 50.

Figure 7C:
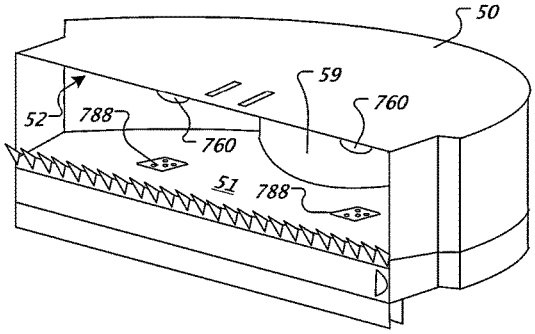
FIGS. 7C-7E are perspective views of removable cleaning bins.

FIG. 7C illustrates a configuration in which the bin 50 includes two emitter arrays 788 and two detectors 760. Each emitter array 788 may include several light sources. The light sources may each emit light frequencies that differ from one another within the same emitter arrays 788. For example, varying frequencies of light emitted by the light sources exhibit various levels of absorption by debris of different sizes. A first sub-emitter within the emitter array 788 may emit light at a first frequency, which is absorbed by debris of very small particle size, while a second sub-emitter within the emitter arrays 788 may emit light at a second frequency which is not absorbed by small-sized debris particles. The robot 11 may determine whether the bin 50 is full even when the particle size of the debris varies by measuring and comparing the received light signals from the first and second sub-emitters. Undesirable interference with the optical transmissive detection system may be avoided by employing sub-emitters emitting light at different frequencies.

Multiple emitter arrays 788 and detectors 760 provide more accurate and reliable bin fullness detection. In the example shown, the multiple emitter arrays 788 provide cross-bin signals to detect potential bin blockages. One possible blockage location is near an intruding vacuum holding bulkhead 59, which partially divides the bin 50 into two lateral compartments. This does not apply to all bins 50. A blockage may occur when received artifact debris of a large enough size (e.g. paper or hairball) becomes a blocking and compartmentalizing bulkhead in the bin 50. A blockage may occur when shifting, clumping, moving, vibrated, or pushed debris within the bin creates one or more compartments via systematic patterns of accumulation. If debris accumulates in one lateral compartment, but not another, a single detector pair may miss it. A single detector pair may also provide a false-positive signal from a large debris item or clump. Multiple emitter arrays 788 located on the bottom interior surface 51 of the bin 50 and multiple detectors 760 located on the top interior surface 52 of the bin 50 in two different lateral or front-to-back locations covers more potential volume of the bin 50 for more accurate and reliable bin fullness detection. A histogram or averaging of the bin detector signals or using XOR or AND on the results of more than one break-beam may be used to get more true positives (even depending on the time since accumulation began).

Figure 7D:
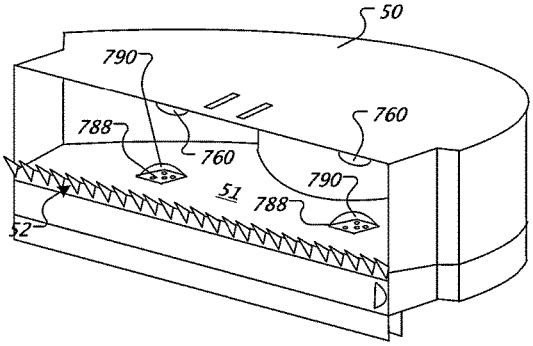

FIG. 7D illustrates a bin 50 with a transmissive optical detection system including two emitter arrays 788, each having a diffuser 790 diffusing emitted infrared light. The diffuse light transmitted to the interior of the bin 50 provides a steadier detection signal generated by the detectors 760 relative to a detection signal generated from a concentrated beam of light from a non-diffuse light source. The diffuse light provides a type of physical averaging of the emitted signal. The detectors 760 receiving diffused infrared light signals can measure an overall blockage amount versus interruption of only a line-of-sight break beam from one emitter.

Figure 7E:
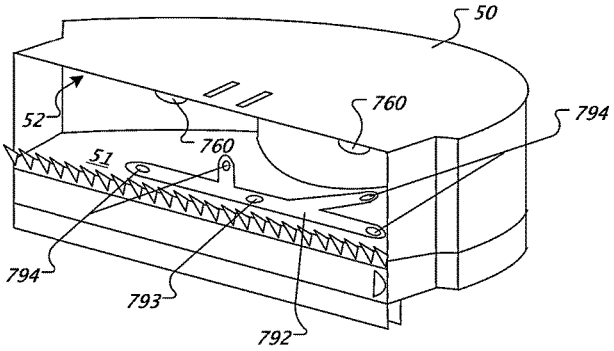

FIG. 7E illustrates a bin 50 including a light pipe or fiber-optic pathway 792 disposed on the bottom interior surface 51 of the bin 50. Light from a light source 793 in the bin 50 travels along the fiber-optic pathway 792 and is emitted from distributor terminals 794. This bin configuration centralizes light production to the single light source 793, rather than supplying power to several independent light sources, while distributes light across the bin 50. The distributor terminals 794 may also include a diffuser 790, as discussed above.

Figure 7F:
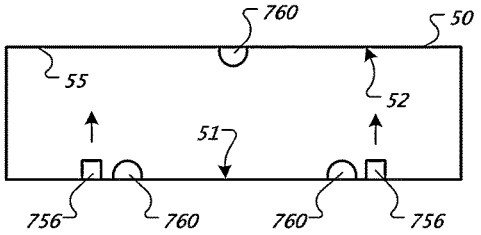
FIGS. 7F-7H are front views of removable cleaning bins.
Figure 7G:
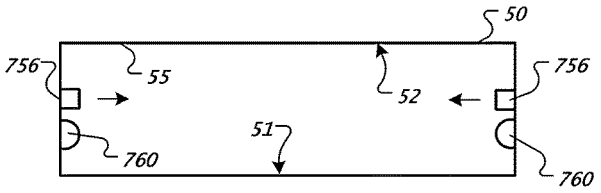
Figure 7H:
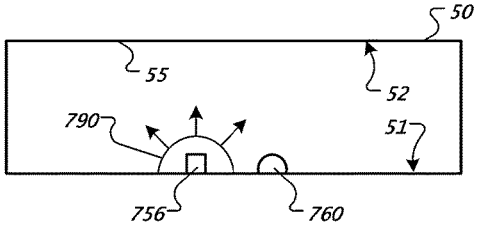

FIGS. 7F-7H illustrate optical debris detection in the bin 50 by reflective light transmission. In one example, as illustrated in FIG. 7F, the bin 50 includes a shielded emitter 756 located near a detector 760. Light emitted by the shielded emitter 756 does not travel directly to the detector 760 because of the shielding. However, light emitted from the emitter 756 is reflected by the interior surface 55 of the bin 50, and traverses an indirect path to the detectors 760. The attenuation of the reflected light caused by debris within the bin 50 may be comparatively greater than in a direct transmissive configuration, because the path the reflected light must travel within the bin 50 is effectively doubled, for example. Although the shielded emitter 756 and detector 760 are illustrated as being proximal to each other, they may be located distally from each other. The emitter 756 and detector 760 may be positioned on the same surface, or on different surfaces.

FIG. 7G illustrates two sets of shielded emitters 756 and detectors 760, each located on opposite horizontal sides of the interior of the bin 50. In this configuration, light received by each detector 760 may be a combination of light directly transmitted from the shielded emitter 756 located on the opposite side of the bin 50, as well as light reflected off the interior surface 55 by the proximal shielded emitter 756. In some examples, a first set of shielded emitters 756 and detectors 760 is located on an adjacent bin surface from a second set of shielded emitters 756 and detectors 760. In one example, a single shielded emitter 756 and detector 760 pair is located on a bottom surface 51 of the bin 50.

FIG. 7H illustrates a configuration in which the bin 50 includes a diffusive screen 412 placed along the transmission path of the shielded emitter 756 disposed on a bottom surface 51 of the bin 50. The diffusive screen 790 diffuses light emitted from the shielded emitter 756 that reflects off various surfaces of the interior 55 of the bin 50 before reaching the detector 760, thereby providing a detection signal that reflects a broad area of the interior of the bin 50.

Figure 8A:
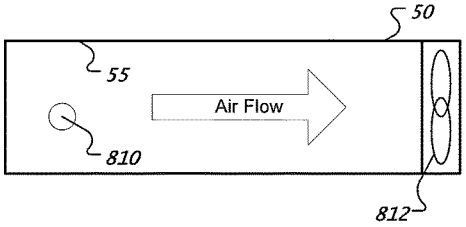
FIGS. 8A-8E are schematic views of removable cleaning bins.
Figure 8B:
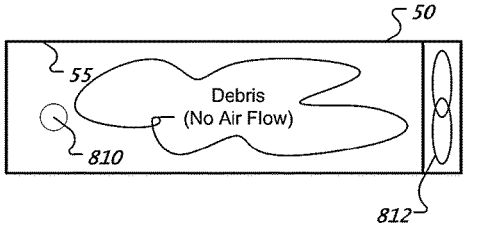

The robot 11, in some implementations, measures or detects air flow to determine the presence of debris within the bin 50. FIGS. 8A-8B illustrate an air flow detection system 800 for detecting a bin-full state. The bin 50 includes an air flow detector 810. As illustrated in FIG. 8A, when high air flow is detected by the air flow detector 810, the bin 50 determines that the interior is not full, because a high level of debris would obstruct air flow within the bin 50. Conversely, as illustrated in FIG. 8B, when the bin 50 contains a large quantity of debris, the air flow within the bin 50 stagnates. Therefore, air flow detected by the air flow detector 810 declines and the bin 50 determines that the debris level is full.

In some examples, the bin 50 includes a rotating member 812 which influences an air volume to flow within the bin 50, guided by the inner surface 55 of the bin 50. The rotating member 812 may be disposed inside or outside of the bin 50 (anchored or free, e.g., a wire, a vane, a brush, a blade, a beam, a membrane, a fork, a flap). In some instances, the rotating member 812 is an existing fan or blower from which air is diverted. In other instances, the rotating member 812 includes a brush or paddle having a primary purpose of moving debris or particulates. The rotating member 812 may be diverted from a wheel chamber or other moving member chamber. "Rotation" and "rotating" as used herein, for sensors and/or cleaning members, includes transformations of rotation into linear motion, and thereby expressly includes reciprocating and sweeping movements. The air flow sensor 810 is disposed in the air volume that generates a signal corresponding to a change in an air flow characteristic within the bin 50 in response to a presence of material collected in the bin 50.

In some implementations, the air flow sensor 810 includes a thermal sensor 862, such as a thermistor, thermocouple, bimetallic element, IR photo-element, or the like. The thermal sensor 862 may have a long or short time constant, and can be arranged to measure static temperature, temperature change, rate of temperature change, or transient characteristics or spikes. The thermal sensor 862 may be passive, active, or excited. An example of a thermal sensor 862 that is excited is a self-heating thermistor, which is cyclically excited for a fixed time at a fixed voltage, in which the cooling behavior of the thermistor is responsive to air flow over the thermistor. Different thermistors and thermistor packaging may be used, e.g. beads or glass packages, having different nominal resistances and negative temperature coefficient of resistance vs. positive temperature coefficient of resistance.

Figure 8C:
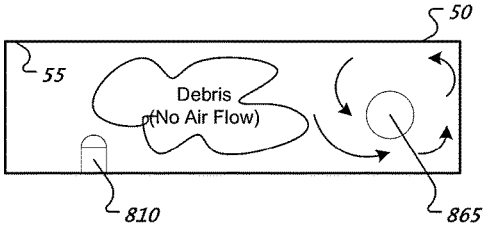

FIG. 8C illustrates a temperature sensing system for detecting a bin-full state. In some examples, the bin 50 includes a self-heating thermistor 862 placed along an air flow path 864 from an air duct 865 of the bin 50. Air flow is generated by suction of a vacuum motor 880, for example. The thermistor 862 is heated to a predetermined temperature (e.g. by applying an electric current to a heating coil surrounding the thermistor 864). A predetermined period of time is permitted to elapse without applying further heating to the thermistor 862 before reading the thermistor temperature of the 862. When air flow within the bin 50 is relatively high, the temperature detected by the thermistor 862 is relatively low because the circulating air cools the thermistor 862. Conversely, when the air flow is stagnant, the temperature detected by the thermistor 862 is relatively high, because of less cooling of the thermistor 862. The robot 11 determines whether the bin 50 is full or not based on the relative temperature detected by the thermistor 862 following the heating and cooling-off cycle. Accuracy can be achieved by disposing two thermistors 862 in appropriate positions in the bin 50. A first thermistors 862 measures ambient temperature, and a second thermistors 862 to heat above the ambient temperature. Air flow generally dissipates heat generated by the thermistor 862. A lack of air flow typically relates to generally higher temperatures. Long thermal time constants associated with the temperature differences tend to result in good noise resistance and benefit from a built-in running averages effect, aggregating previous measurements automatically to produce a more accurate determination.

Placing the thermistor 862 in a location of the bin 50 empirically determined to have more or less air flow in general, it is possible to tune the sensitivity of air flow inference by the thermistors 862. The thermistor 862 may be shielded or define holes to obtain better air flow over the thermistor, enhancing thermistor sensitivity. The fluid dynamics of a bin 50 actively filling with randomly shaped debris and randomly perturbed air flow is inherently predictable, and routine experimentation is necessary to determine the best location for any sensors mentioned herein.

By adopting a total heating/cooling cycle time of about one minute (30 seconds heating, 30 seconds cooling, although this could be varied by an order of magnitude), the long thermal time constant of the system may prevent the thermistor 862 from responding too quickly. Air flow may also affect the time constant and the peak-to-peak change in temperature during cycling as well as reducing the long-term average temperature over many cycles.

Convection may be used if heating occurs at the bottom and temperature sensing at the top of the thermistor 862. Convection be used in the vacuum bin 50 to sense a clogged filter (usually equivalent to a full bin for the vacuum chamber, which tends to collect microscopic material only). Air flow decreases when the filter 54 is clogged. If the air flow decreases, a higher temperature change is produced. Alternatively, the slope of the heating/cooling cycle, averaged, may also be used to detect filter clogging and/or blocked air flow.

Figure 8D:
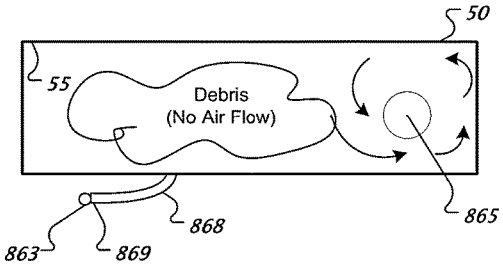

FIG. 8D illustrates a pressure sensing system for detecting a bin-full state. In some implementations, the air flow sensor 810 includes a pressure transducer 863, which may have a long or short time constant. The pressure transducer 863 may be arranged to measure static pressure (e.g., strain gauge pressure transducer), overpressure, back pressure, pressure change, rate of pressure change, or transient characteristics or spikes (e.g., piezo pressure transducer). The pressure transducer 863 can be passive, active, or excited, and can be arranged to measure air flow directly or indirectly by Bernoulli/venturi principles (in which more flow past a venturi tube creates lower pressure, which can be measured transiently or on an averaged basis to infer low air flow and a full bin when a low pressure zone is not detected).

A relatively small air pathway 868 (herein a "Venturi tube") extends orthogonally from the interior surface 55 of the bin 50. The robot 11 determines bin fullness based on the relative pressure detected by the pressure transducer 863 at a distal end 869 of the Venturi tube 868. When air flow along the interior surface of the bin 50 is high, the pressure at the distal end 869 of the Venturi tube 868 is relatively low. The pressure readings may be combined with thermistor and/or optical sensor readings to more accurately determine the presence of debris, for example.

Figure 8E:
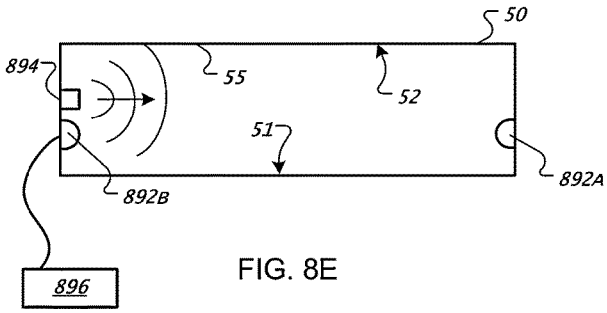

Referring to FIG. 8E, in some implementations, the bin 50 includes a vibration, resonance, or acoustic sensor 892 and an agitator or sonic emitter 894 configured to acoustically stimulate or perturb the bin 50, the air within the bin 50, or a sensing element provided in the bin 50 (e.g., with a known value or values for the vibrational response of an empty bin, so as to permit LaPlace-domain or other frequency, spectra, or response function oriented analyses). The agitator 894 acoustically stimulates the bin at least two different frequencies (including pings, discrete frequencies or a continuous sweep), e.g., which can serve to compensate for loads of varying consistency, density or other potentially confounding factors. The robot 11 includes an analyzer 896 configured to analyze vibration or resonance data detected by the vibration or resonance sensor 892 in response to the acoustical stimulation of the bin 50 by the agitator or sonic emitter 894 and to indicate when the bin 50 is full to capacity.

In some examples, at various periods the agitator 894, under the control of the analyzer circuit 896, perturbs the air remaining within the bin 50 with a known vibration strength. At the same time, the vibration sensor 892 measures a vibration response of the air in the bin 50 and transmits the measured values to the analyzer circuit 896. With respective known empty and full characteristic vibration responses of the bin 50, the analyzer circuit 896 analyzes the response from the vibration sensor 892 using methods such as frequency-domain transforms and comparisons (e.g., LaPlace or Fourier transforms, etc.) and returns an appropriate bin state.

When an acoustic signal is emitted from an acoustic emitter 894 at time T1, the transmitted signal initially traverses the interior of the bin 50 from the acoustic emitter 894 to an acoustic detector 892 located horizontally opposite the acoustic emitter 894. At time T2, the signal is detected by the transmissive acoustic detector 892A, after one time period $\tau$1 has elapsed. The acoustic signal also reflects off the interior surface 55 of the bin 50 and re-traverses the interior of the bin 50 until it is received by the reflective acoustic detector 892B at time T3, following another time period equal to $\tau$1. When the detectors 892A and 892B are of similar sensitivity, the signal detected at time T3 is lower than the signal detected at time T2 (the difference in amplitude between the signal detected at T2 and the signal detected at T3 is referred to as $\Delta$1).

A similar signal analysis is performed when the interior of the bin 50 is full of debris. The signals received by the detectors 892A and 892B at times T2 and T3, respectively, may decline monotonically with respect to the initial signal emitted from emitter 894 at time T1. However, the amplitude difference between the signals detected at T2 and T3, designated $\Delta$2, is greater than a corresponding amplitude difference $\Delta$1. A time-of-flight that elapses as the acoustic signal traverses the interior of the bin 50 (herein referred to as $\tau$2) is also greater than the time period $\tau$1 corresponding to the bin-empty state. The bin-full state can be determined using a signal analysis when a signal emitted from the acoustic emitter 894 and detected by the transmissive acoustic detector 892A and the reflective acoustic detector 892B is compared to a bin empty condition (which may be initially recorded as a reference level when the bin is known to be empty, for example).

Any of these fore-mentioned methods for detecting, measuring, inferring or quantifying air flow and/or bin capacity may also be combined in any suitable permutation thereof, to further enhance the accuracy of bin capacity measuring results; in particular, for example, at least two differing bin capacity-measuring techniques may be employed such that if there is a weakness in one of the techniques—for example, where air flow may be halted due to a factor other than bin fullness, a straight pressure transducer might still produce accurate measurements of bin capacity, etc.

Figure 9A:
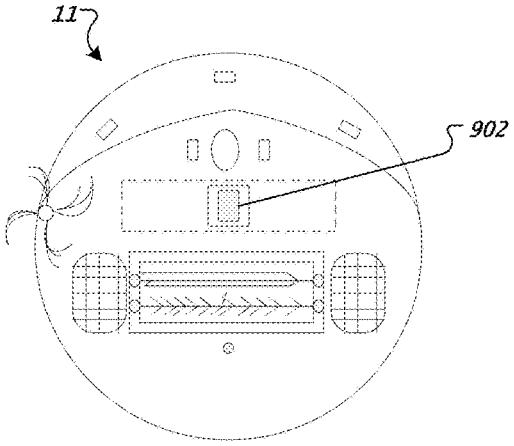
FIG. 9A is a bottom view of an autonomous robotic cleaner.
Figure 9B:
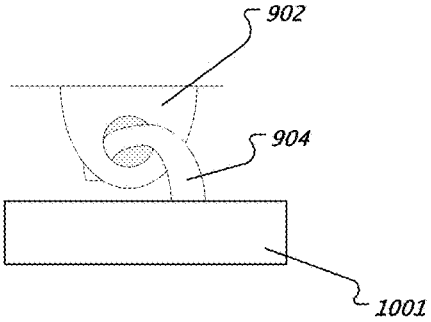
FIG. 9B is a perspective view of a robot locking device.

Referring to FIGS. 9A-B, in some implementations, a clip catch 902 is installed on the bottom of the robot chassis 31 and configured to mate with a clip 904 on a maintenance station 1250. The clip 904 engages the catch 902 to lock the robot 11 in place during servicing of the bin 50 and/or brushes or rollers 60, 65.

Existing robots 11 which do not include bin-sensing features may be retrofitted with a bin 50 including a bin-full sensor system 700. Signals generated by the bin-full sensor system 700 are transmitted to the robot microprocessor 245 (e.g. via snap-in wires, a serial line, or a card edge for interfacing a bus controlled by a microcontroller; using wireless transmission, etc.). Alternatively, an existing actuator (e.g. a fan) monitored by the home robot is "hijacked" (i.e., a property of it is modified for new use). For example, when the bin 50 is full, a cleaning assembly microprocessor 215 energizes the fan motor in a pattern (e.g., three times in a row with predetermined timing). The retrofitted and firmware-updated robot processor 245 detects the distinctive current pattern on the fan and communicates to a user that the bin 50 is full. In another example, an existing sensor is "hijacked." For example, an IR emitter disposed on top of the bin 50 in a visible range of an omnidirectional virtual wall/docking sensor. A distinctive modulated IR chirp or pulse train emitted by the retrofitted bin 50 indicates that the bin 50 is full without overwhelming the virtual wall sensor. In yet another example, communications are made just to the user but not to any automated system. For example, a flashing light on the bin 50, or a klaxon or other audio signaler, notifies the user that the bin 50 is full. Such retrofitting is not necessarily limited to the bin-capacity-sensing function, but may be extended to any suitable features amenable to similar retrofitting.

Using a manufacturer's server, a robot user may create a website containing information regarding his or her customized (or standard) robot 11 and share the information with other robot users. The server can also receive information from robots 11 pertaining to battery usage, bin fullness, scheduled cleaning times, required maintenance, cleaning patterns, room-size estimates, etc. Such information may be stored on the server and sent (e.g. with other information) to the user via e-mail from the manufacturer's server, for example.

Figure 10A:
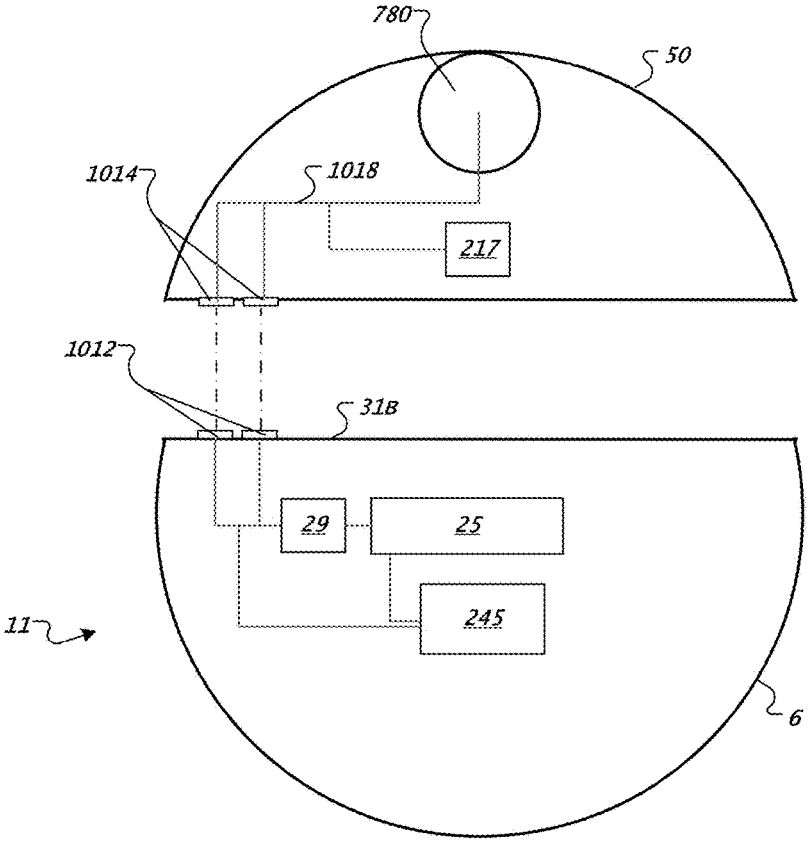
FIGS. 10A-10B are schematic views of autonomous robotic cleaners.
Figure 10B:
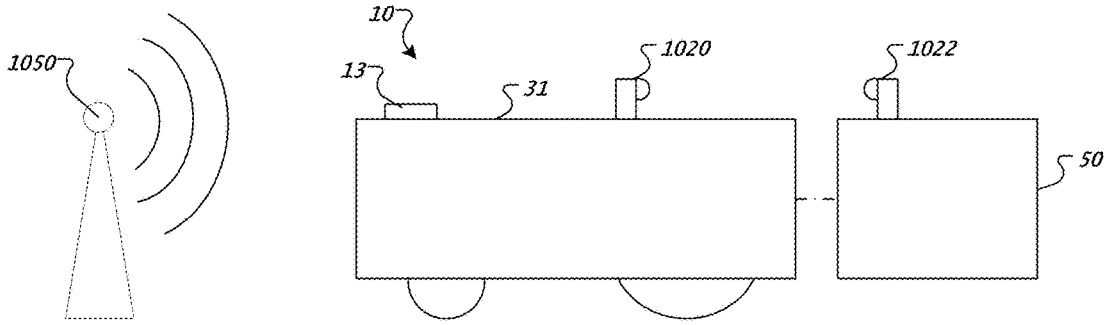

Referring to FIGS. 10A-10B, in some implementations, the robot 11 includes robot communication terminals 1012 and the bin 50 includes bin communication terminals 1014. When the bin 50 is attached to the robot 11, the bin communication terminals 1014 contact the corresponding robot communication terminals 1012. Information regarding bin-full status is communicated from the bin 50 to the robot 11 via the communication terminals 1012, 1014, for example. In some examples, the robot 11 includes a demodulator/decoder 29 through which power is routed from the battery 25 through the communication terminals 1012, 1014 and to the bin 50. Bin power/communication lines 1018 supply power to a vacuum motor 780 and to a bin microcontroller 217. The bin microcontroller 217 monitors the bin-full status reported by the debris detection system 700 in the bin 50, and piggybacks a reporting signal onto the power being transmitted over the bin-side lines 1018. The piggybacked reporting signal is then transmitted to the demodulator/decoder 29 of the robot 11. The microprocessor 245 of the robot 11 processes the bin full indication from the reporting signal piggybacked onto the power lines 1018, for example. In some examples, the communication terminals 1012, 1014 include serial ports operating in accordance with an appropriate serial communication standard (e.g. RS-232, USB, or a proprietary protocol). The bin microcontroller 217 monitors the bin-full status reported by the debris detection system 700 in the bin 50 independent of a robot controller, allowing the bin 50 to be used on robots without a debris detection system 700. A robot software update may be required for the bin upgrade.

Referring to FIG. 10B, in some implementations, the robot 11 includes an infrared light (IR) receiver 1020 and the bin 50 includes a corresponding IR emitter 1022. The IR emitter 1022 and IR receiver 1020 are positioned on the bin 50 and robot 11, respectively, such that an IR signal transmitted from the IR emitter 1022 reaches the IR receiver 1020 when the bin 50 is attached to the robot 11. In some examples, the IR emitter 1022 and the IR receiver 1020 both function as emitters and receivers, allowing signals to be sent from the robot 11 to the bin 50. In some examples, the robot 11 includes an omni-directional receiver 13 on the chassis 31 and configured to interact with a remote virtual wall beacon 1050 that emits and receives infrared signals. A signal from the IR emitter 1022 on the bin 50 is receivable by the omni-directional receiver 13 and/or the remote virtual wall beacon 1050 to communicate a bin fullness signal. If the robot 10 was retrofitted with the bin 50 and received appropriate software, the retrofitted bin 50 can order the robot 10 to return to a maintenance station for servicing when the bin 50 is full.

Figure 11A:
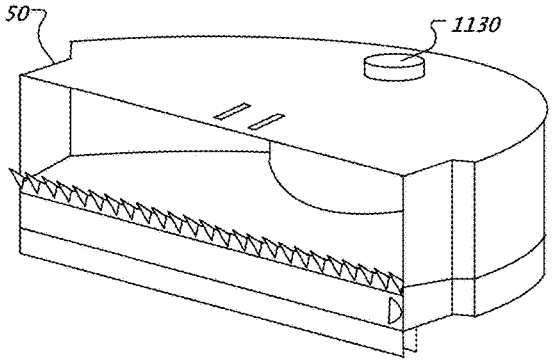
FIG. 11A is a perspective view of a cleaning bin.
Figure 11B:
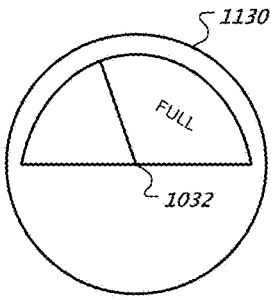
FIGS. 11B-11D are schematic views of cleaning bin indicators.
Figure 11C:
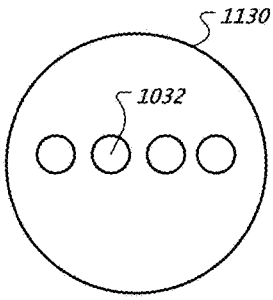
Figure 11D:
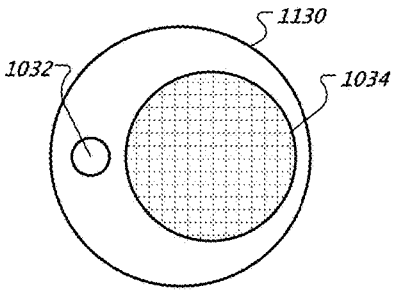

FIGS. 11A-11D illustrate a bin 50 including a bin-full indicator 1130. In some examples the bin-full indicator 1130 includes visual indicator 1132 such as an LED (FIG. 11B), LCD, a light bulb, a rotating message wheel (FIG. 11C) or a rotating color wheel, or any other suitable visual indicator. The visual indicator 1132 may steadily emit light, flash, pulse, cycle through various colors, or advance through a color spectrum in order to indicate to the user that the bin 50 is full of debris, inter alia. The indicator 30 may include an analog display for indicating the relative degree of fullness of the bin 50. For example, the bin 50 includes a translucent window over the top of a rotatable color wheel. The translucent window permits the user to view a subsection of the color wheel rotated in accordance with a degree of fullness detected in the bin 50, for example, from green (empty) to red (full). In some examples, the indicator 30 includes two or more LEDs which light up in numbers proportional to bin fullness, e.g., in a bar pattern. Alternatively, the indicator 1030 may be an electrical and/or mechanical indicator, such as a flag, a pop up, or message strip, for example. In other examples, the bin-full indicator 1130 includes an audible indicator 1134 such as a speaker, a beeper, a voice synthesizer, a bell, a piezo-speaker, or any other suitable device for audibly indicating bin-full status to the user. The audible indicator 1134 emits a sound such as a steady tone, a ring tone, a trill, a buzzing, an intermittent sound, or any other suitable audible indication. The audible indicator 1134 modulates the volume in order to draw attention to the bin-full status (for example, by repeatedly increasing and decreasing the volume). In some examples, as shown in FIG. 11D, the indicator 1130 includes both visual and audible indicators, 1132 and 1134, respectively. The user may turn off the visual indicator 1132 or audible indicator 1134 without emptying the bin 50. In some implementations, the bin-full indicator 1130 is located on the chassis 31 or body 6 of the robot 11.

Figure 12A:
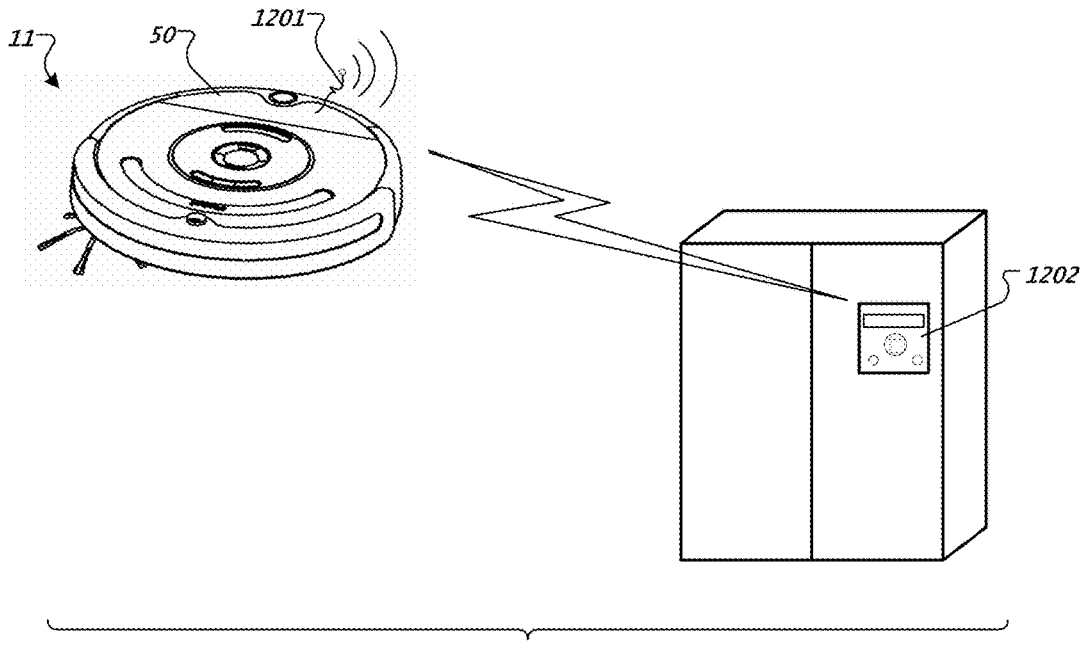
FIG. 12A is a schematic view of a cleaning bin indicator system.
Figure 12B:
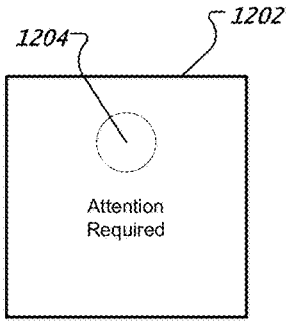
FIGS. 12B-12C are schematic views of remote cleaning bin indicators.

Referring to FIGS. 12A-12B, in some implementations, the bin 50 wirelessly transmits a signal to a remote indicator 1202 (via a transmitter 1201, for example), which then indicates to a user that the bin is full using optical (e.g. LED, LCD, CRT, light bulb, etc.) and/or audio output (such as a speaker 1202C). In one example, the remote indicator 1202 includes an electronic device mounted to a kitchen magnet. The remote indicator 1202 may provide (1) generalized robot maintenance notifications (2) a cleaning routine done notification (3) an abort and go home instruction, and (4) other control interaction with the robot 10 and/or bin 50.

An existing robot 11, which does not include any communication path or wiring for communicating with a bin-full sensor system 700 on the bin 50, is nonetheless retrofitted with a bin 50 including a bin-full sensor system 700 and a transmitter 1201. "Retrofitting" generally means associating the bin with an existing, in-service robot, but for the purposes of this disclosure, at least additionally includes forward fitting, i.e., associating the bin with a newly produced robot in a compatible manner. Although the robot 11 cannot communicate with the bin-full sensor system 700 and may possibly not include any program or behavioral routines for responding to a bin-full condition, the bin 50 may nonetheless indicate to a user that the bin 50 is full by transmitting an appropriate signal via the transmitter 1201 to a remote indicator 1202. The remote indicator 1202 may be located in a different room from the robot 11 and receives signals from the bin 50 wirelessly using any appropriate wireless communication method, such as IEEE 801.11/WiFi, BlueTooth, Zigbee, wireless USB, a frequency modulated signal, an amplitude modulated signal, or the like.

Figure 12C:
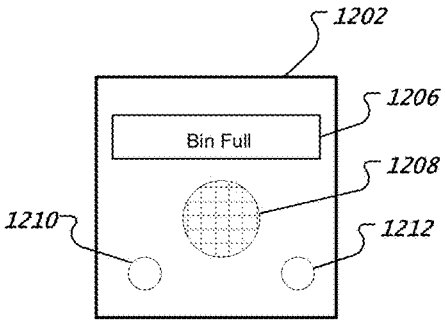

In some implementations, as shown in FIG. 12B, the remote indicator 1202 is a magnet-mounted unit including an LED 1204 that lights up or flashes when the bin 50 is full. In some examples, as shown in FIG. 12C, the remote indicator 1202 includes an LCD display 1206 for printing a message regarding the bin full condition and/or a speaker 1208 for emitting an audible signal to the user. The remote indicator 1202 may include a function button 1210, which transmits a command to the robot 11 when activated. In some examples, the remote indicator 1202 includes an acknowledge button 1212 that transmits an appropriate command signal to the mobile robot 20 when pushed. For example, when a bin-full signal is received, the LCD display 1206 may display a message indicating to the user that the bin is full. The user may then press the button 1212, causing a command to be transmitted to the robot 11 that in turn causes the robot 11 to navigate to a particular location. The user may then remove and empty the bin 50, for example.

In some examples, the remote indicator 1202 is a table-top device or a component of a computer system. The remote indicator 1202 may be provided with a mounting device such as a chain, a clip or magnet on a reverse side, permitting it to be kept in a kitchen, pendant, or on a belt. The transmitter 1201 may communicate using WiFi or other home radio frequency (RF) network to the remote indicator 1202 that is part of the computer system 1204, which may in turn cause the computer system to display a window informing the user of the bin-full status.

Figure 12D:
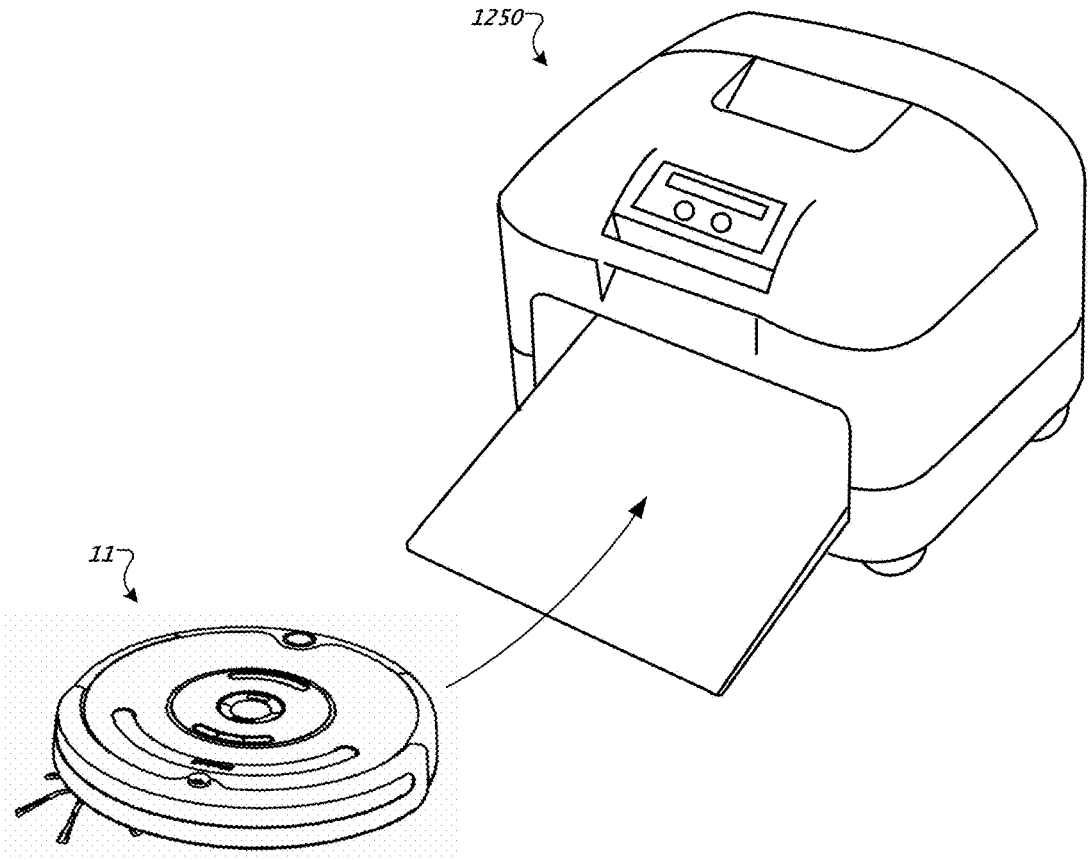
FIG. 12D is a schematic view of an autonomous robotic cleaner and an evacuation station.

Referring to FIG. 12D, when the bin-full detection system 700 determines that the bin 50 is full and/or the roller full sensor assembly 85 determines that the cleaning head 40 is full, the robot 11, in some examples, maneuver to a maintenance station 1250 for servicing. In some examples, the maintenance station 1250 automatically evacuates the bin 50 (e.g. via a vacuum tube connecting to an evacuation port 80, 305, 380, 415, 420, 425, 430 of the bin 50). If the cleaning head 40 is full of filament, the robot 11 may automatically discharge the cleaning brush/flapper 60, 65 for either automatic or manual cleaning. The brush/flapper 60, 65 may be fed into the maintenance station 1250, either manually or automatically, which strips filament and debris from the brush/flapper 60, 65.

FIGS. 13-32 illustrate methods for controlling the bin-full detection and user-notification systems of the robot 11. Steps or routines illustrated with dashed lines are expressly optional or include optional sub-routines. In some cases, steps may be omitted depending upon whether the bin is powered by its own battery or by a discharging capacitor.

Figure 13:
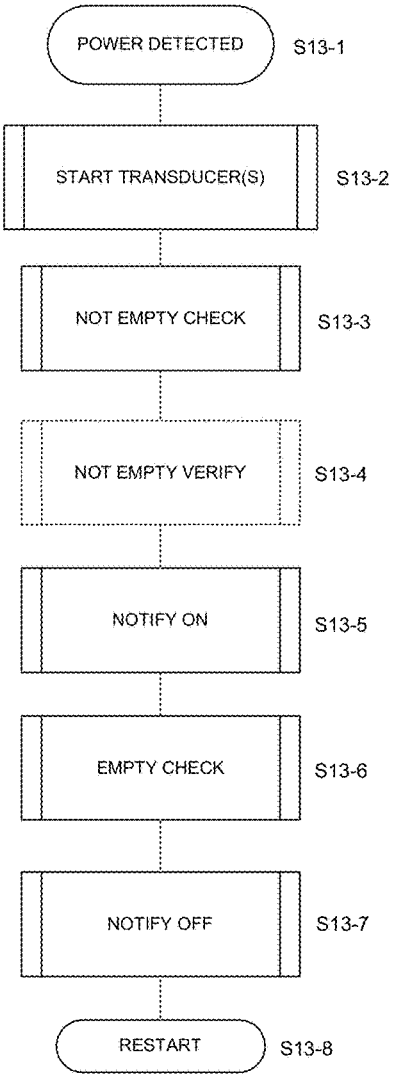
FIGS. 13-32 are process flow charts of bin-fullness detection systems.

A normal operating routine begins, as illustrated in FIG. 13, by activating transducers (e.g. bin detection system 700) to detect a bin full condition. The core operating cycle of the bin 50 takes place while the robot 11 is operating (e.g. cleaning), in order to detect a bin full condition. However, optional cycles check the status of the bin 50 and robot 11 when the robot 11 is not operating.

Figure 14:
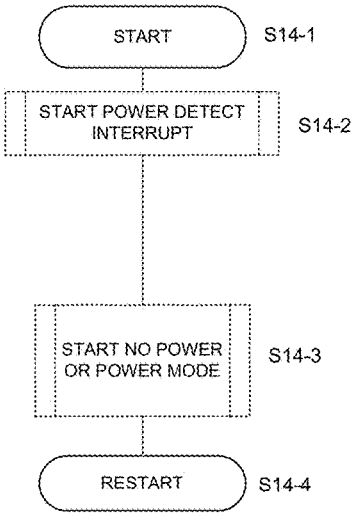
Figure 15:
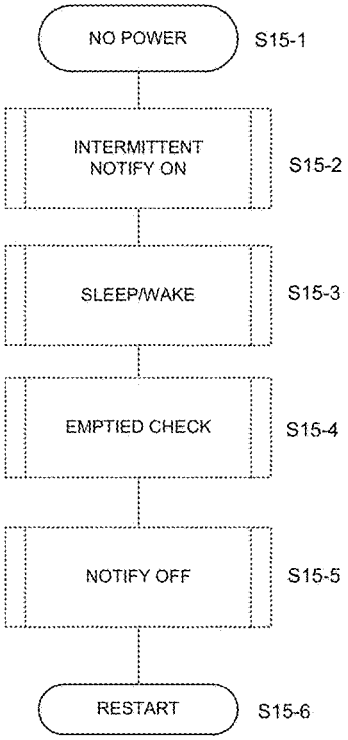

For example, the bin processor 217 may have an idle or low-power mode that is active when the robot 11 is not powered and/or the bin 50 is detached. FIGS. 14 and 15 illustrate parent procedures used to enter this mode. For example, the controller 217 may start an optional power detect routine at step S14-2. "Power detect" in this context is detecting whether or not the bin 50 is attached to the robot 11 and the robot 11 is operating (cleaning). If power is detected/available, the bin 50 enters the normal operating mode (described below). If no power is available, then the bin controller 217 executes a no-power routine, as illustrated in FIG. 15.

In the no-power mode, the bin 50 may have set a flag specifying notification is to be activated. If this is the case, a low-power notification is preferable. An optional step S15-2 would change the notification from a continuous to a more intermittent notification (rapid flashing to slower flashing, continuous on to flashing, i.e., from a higher power consumption notification to a lower power consumption notification). This is less important when the bin 50 does not rely on robot power to recharge its own power supply.

Another optional step in the no-power routine is a sleep/wake check, as shown in step S15-3. If the bin 50 maintains the intermittent or regular notification S15-2 (i.e., each step in the no-power routine is independent and optional, and may or may not depend on the execution of preceding steps), the bin 50 may enter a sleep state after a certain number of no-power (robot off), no-change (bin not disconnected from robot, bin not moved, no change in bin sensor states) minutes (e.g., 5 mins to 1 hour) elapses. The bin may wake upon disconnection from the robot 11, movement of the bin 50 or robot 11, any relevant change in bin sensor states; and may re-activate or activate checking and wake-state activities.

Another optional step in the no-power routine is an emptied check S15-4, which checks whether conditions reflect that the bin 50 has been emptied (including changes in internal sensor state indicative of emptying, tilt sensing, assumptions made). A subsequent step upon detection of bin emptying directly or indirectly is the deactivation of the notification (step S15-5) and resetting or restarting the processes.

Referring again to FIG. 13, if power is detected, i.e., if the bin is connected to the robot 11 and the robot 11 is operating, transducer(s) are started at step S13-2. "Transducers", in this context, describes various instruments and sensors as described herein that are used to directly or indirectly check whether the bin is full and/or not empty. This includes virtual transducers. Step S13-2 initiates bin monitoring via the transducer(s) until monitoring is no longer necessary.

Once the transducers are active, a not empty check is executed at step S13-3. "Not empty", in this context, describes positive, negative, and inferred sensor interpretations that may directly or indirectly check whether the bin is full, empty, and/or not empty and/or not full. Steps S13-2 and 13-3 starts, and continues, a not-empty check via the transducer(s) until the same is registered, and may constitute the only such check, i.e., confirmation or verification is optional.

Optionally, a not empty verify routine may be executed at step S13-4. "Verify", in this context, describes repeating or extending the checks performed in step S13-3, or a different kind of check upon a same or different kind of criteria. A preferred example of the step S13-4 correlates verification with sufficient elapsed time under a positive not-empty condition. Optionally, step S13-4 includes routines to reject false positives.

Once the not-empty or bin full state is detected and optionally checked as stable, in one direction or the other, the controller 217 may activate notification in step S13-5. The notification may be kept on for a certain time period, and/or may be kept on until the bin is detected as emptied at step S13-6. Notification is turned off at step S13-7. Thereafter, the process is restarted at S13-8.

Examples of start transducer routines are illustrated in FIGS. 16-20. Each routine includes appropriate calibration/tare/zeroing steps.

Figure 16:
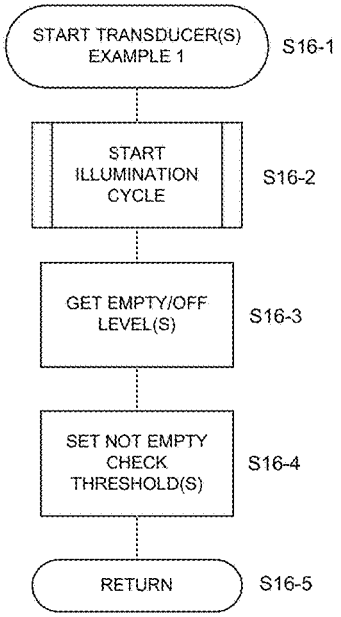
Figure 17:
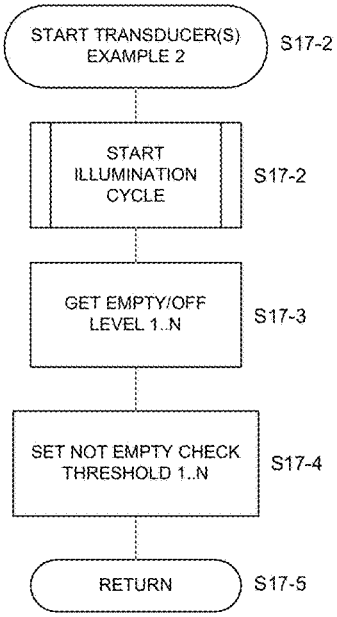
Figure 32:
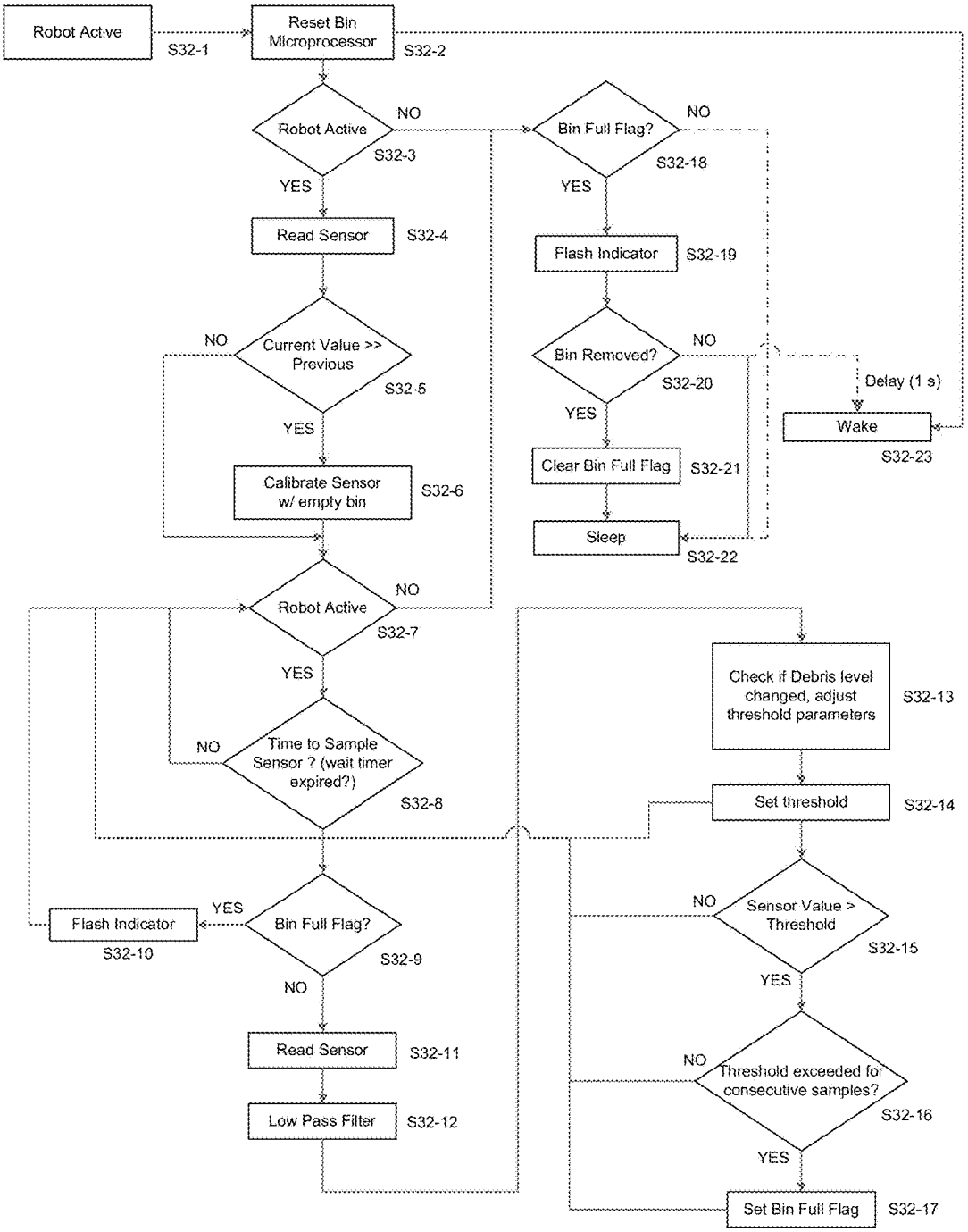

FIG. 16 illustrates an example start transducer routine appropriate for a single or combined/averaged illuminated emitter and or detector array in the bin 50, either of the reflective type or break-beam/transmissive type. A start illumination cycle routine is executed at step S16-2. Empty/off levels are sampled from bin detectors and averaged at step S16-3. A not empty check threshold is set at step S16-4, before the process is returned at step S16-5. As illustrated in FIG. 17, a similar process is executed in start transducer example 2 routine, in which empty/off levels are sampled for a set of 1 to N transducers. Each emitter/detector pair or combination is accounted for in the calibration or normalizing of empty or off levels in step 17-3. FIG. 32 contemplates the case in which the same sensors are checked for different orientations, or combinations, or cycled time-wise, e.g., emitter A1 with detector B1, emitter A1 with detector B2, emitter A2 with detector B1. The start transducer example 2 routine is appropriate when the same sensors in the emitter and/or detector arrays can identify sensor failure, or debris jams or clumps in the bin 50.

Figure 18:
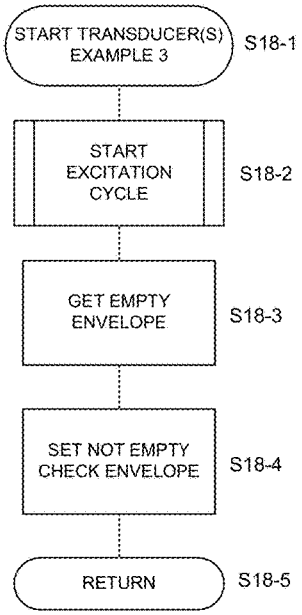
Figure 19:
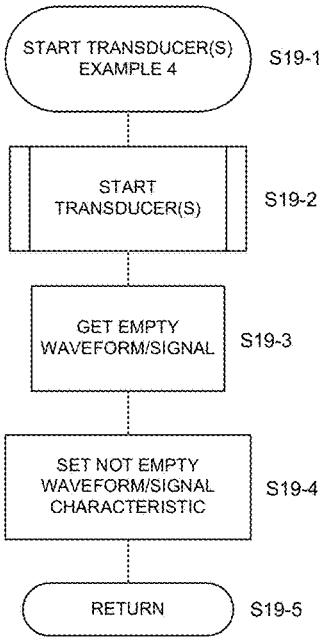

FIGS. 18-19 illustrate example start transducer routines, in which an excitation cycle is started at step S18-2 or S19-2. These routines are appropriate for bin detection systems 700 including hot-wire anemometers or thermistors, vibration sensors, time-of-flight acoustic measurements, or transducers that generate a signal in which the empty or full state that has a relatively more complex characterization. Calibration at step S18-3 or S19-3 may require identifying an empty waveform, signal, or envelope characteristic representing a range, envelope, or signal shape of transducer detection values corresponding to an empty bin 50. The characteristic envelope is a baseline for measurements in step S18-4 or S19-4. An intervening optional step can model, fit, or transform the shape or envelope so that less data is necessary for storage or comparison purposes.

Figure 20:
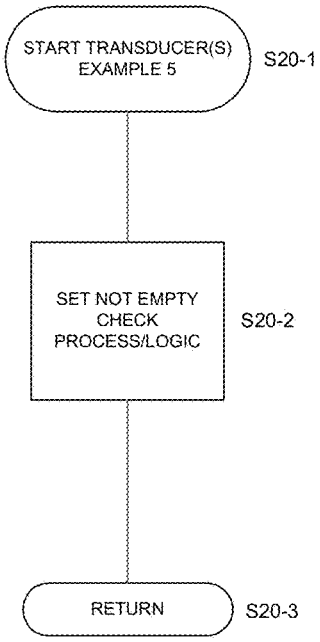

FIG. 20 illustrates an example start transducer routine appropriate for an arrangement in which transducers are not calibrated, and/or in which heuristics, filters, and/or other non-linear rules are used to identify the bin full state. The transducers may nonetheless be normalized or calibrated.

Figure 21:
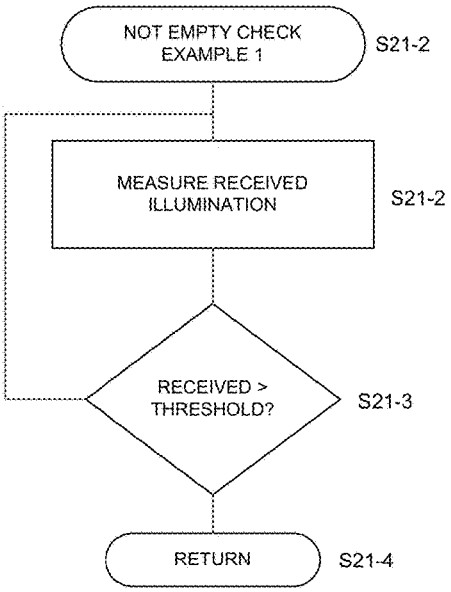

FIGS. 21-24 illustrate example not empty check routines. FIG. 21 provides an example not empty check routine appropriate for a single or combined/averaged illuminated emitter and or detector array in the bin 50. Illumination received by the detector of the transducer is measured at step S21-2. The measured illumination is compared to a threshold illumination level corresponding to the bin empty state in step S21-3. If received illumination is below the threshold, the process loops back to step S21-2. Otherwise, the routine returns at step S21-4.

Figure 22:
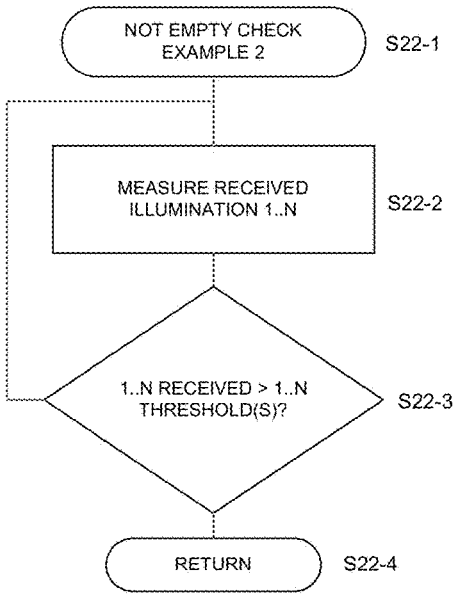

FIG. 22 provides a second example not empty check routine appropriate for a matrix of transducers. Illumination received by a set of 1 to N transducers is measured in step S22-2. The received illumination of the 1 to N transducers is compared to a set of 1 to N threshold levels in step S22-3. If received illumination is below the threshold, the process loops back to step S22-2. Otherwise, the routine returns at step S22-4.

Figure 23:
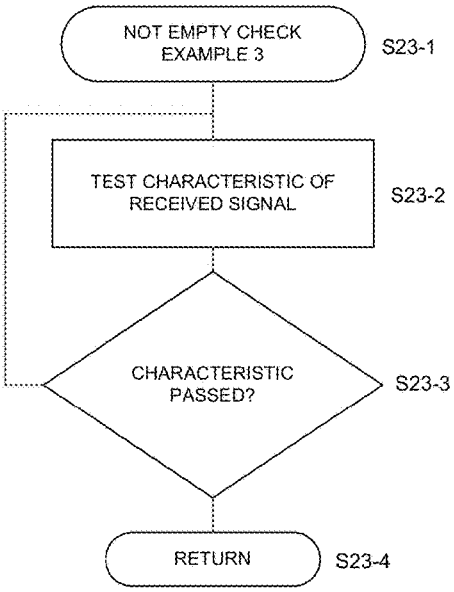

FIG. 23 illustrates a third example not empty check routine, in which characteristics of a received signal of a transducer are tested at step S23-2. A determination of whether the tested characteristic passes the not empty check is made at step S23-3. If the tested characteristic of the received signal passes, the routine returns at step S23-4; otherwise, the process repeats step S23-2.

Figure 24:
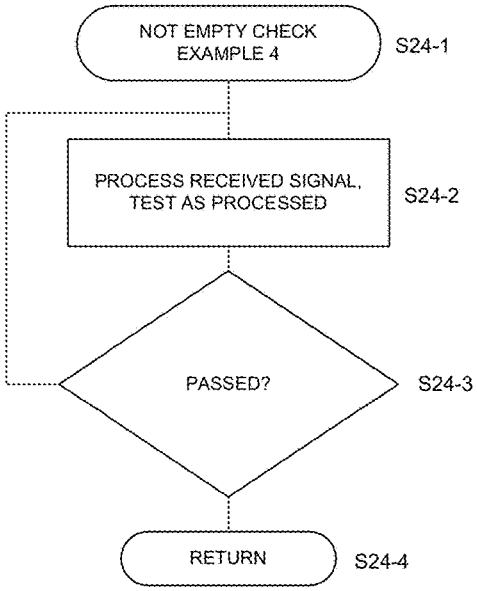

FIG. 24 illustrates a fourth example not empty check routine, in which a signal received by a transducer is processed and tested as it is processed at step S24-2. If the ongoing testing of the signal passes at step S24-3, the routine returns at step S24-4; otherwise, the routine repeats step S24-2.

Figure 25:
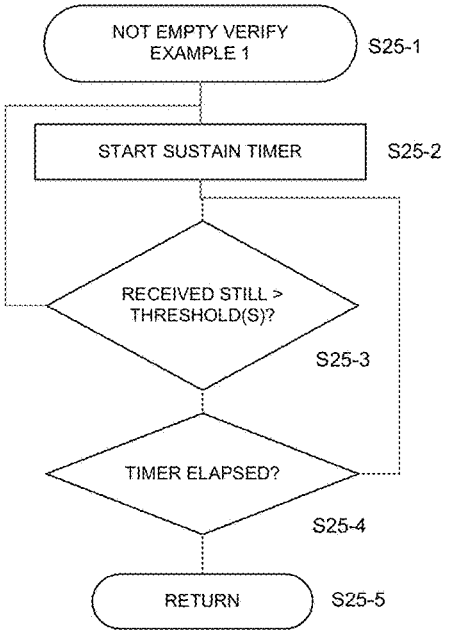

FIGS. 25-28 illustrate example not empty verification routines. FIG. 25 illustrates one example not empty verification routine including a start sustain timer (e.g., 5 mins) step S25-2. In step S25-3, it is determined whether a received signal of a transducer remains above a threshold level. The sustain timer sets the period for which the not-empty detection must continue in order to establish the stable bin full condition. If the received signal of the transducer continues to be above a threshold level at step S25-3, it is then determined whether the timer has elapsed at step S25-4. If the timer has elapsed, the stable bin full condition is established and the routine returns at step S25-5. If the timer has not yet elapsed, the routine loops back to step S25-3 to check whether received signals at the transducer remain above the threshold.

Figure 26:
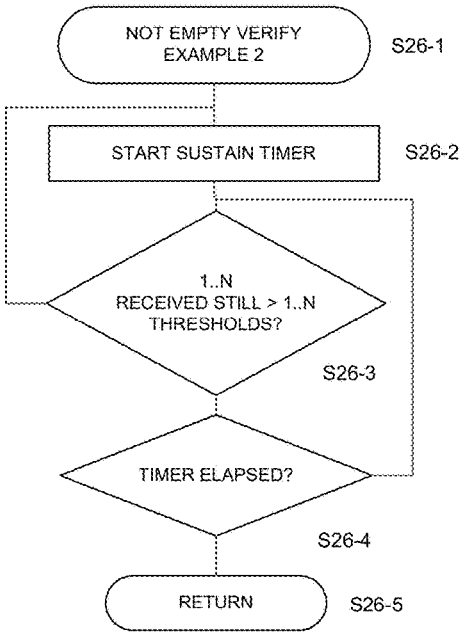

FIG. 26 illustrates a second example of a not empty verification routine, in which the received signals of a set of 1 . . . N transducers are compared to a set of 1 . . . N thresholds in step S26-3. If any sensor falls below the threshold, the sustain timer is restarted at step S26-2.

Figure 27:
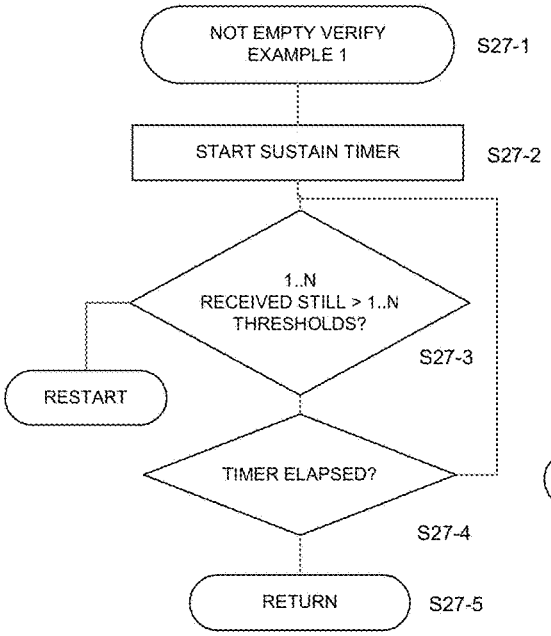

In a third example, illustrated in FIG. 27, when any transducer falls below the threshold level at step 27-3, the verification process, the entire not empty check procedure, and the initial bin full detection is restarted.

Figure 28:
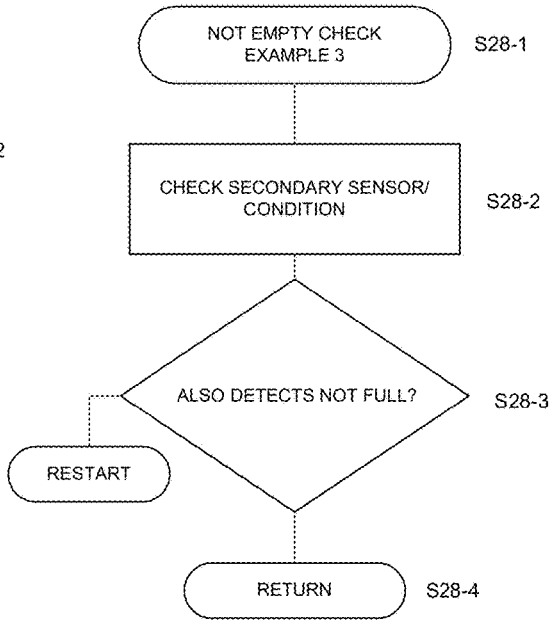

A fourth example of a not empty check routine is illustrated in FIG. 28, in which a secondary sensor or a condition is tested at step S28-2. The secondary sensor may be the same kind of transducer as the primary transducer in the same location for redundancy, or the same kind of transducer in a different location for confirmation, or a different kind of transducer in the same or a different location. If it is determined that that the secondary sensor also does not detect a full condition in step S28-3, the process is restarted.

Figure 29:
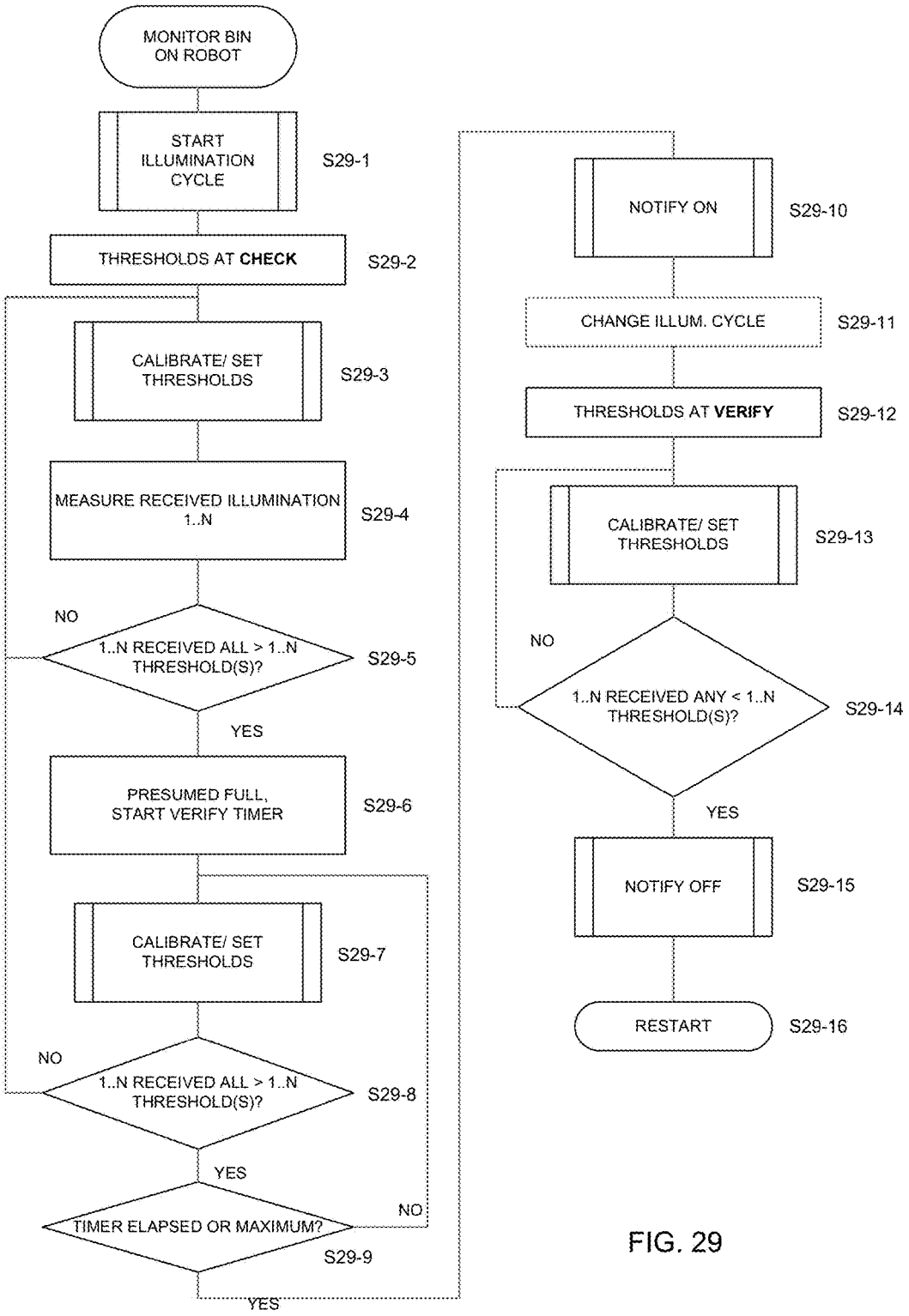

FIG. 29 illustrates a routine for monitoring debris content of the bin 50. The routine is a specific example of an entire integrated process such as the general process discussed with reference to FIG. 13, and includes a specific example including two or more LED emitters and two (or more) collectors disposed in the bin 50. When "80% of dark level" is discussed, the meaning may be (a) 80% of a negative value or (b) 80% of a variable meaning "darkness" rather than a direct measurement of voltage or current. For example, a full dark score may be 100, recorded upon calibration when illumination is off, and a full light score may be 0, recorded upon calibration when illumination is on and unobstructed. 80% of the absolute dark level would be a score of 80 (mostly dark). Alternatively, a light score may be used, which may also take into account accumulated dirt on the sensors and emitters. In this case, 80% of the absolute dark level may be replaced by 20% of the value recorded upon calibration when illumination is on and unobstructed.

At step S29-1, an illumination cycle of a transducer is started. For example, the emitters 755 may be activated and the transmitted signal detected by detectors 760, when it is known (or assumed) that the bin 50 is empty. The thresholds are then checked and set to the detected values at step S29-3. For example, each threshold is set proportional to a dark reading with the lights off.

In a measuring step S29-4, the illumination signal received by each transducer 1 . . . N (e.g., the detectors 760) is measured. In step S44-5, it is determined whether the received illumination is greater than a corresponding set of threshold values. The thresholds are set as a score to be exceeded, but may be set as a negative or low dark current value checked via a greater than or less than comparison. For example, a full bin 50 may register 80% of the absolute dark score in each compartment. The comparison step is intended to detect a nearly absolute dark level, even when the lights are illuminated, when most of the light is being blocked by debris. If one of the receivers is below the threshold (registers a dark level less than expected for a full or near-full bin), the routine returns to step S29-3 (e.g., at least one side is not full or nearing full). Otherwise, the routine proceeds to step S29-6, in which the bin 50 is presumed full and a verification timer is started. At step S29-7, the illumination cycle continues, and the thresholds remain the same, set to a less sensitive level, or decaying slowly. At step S29-8, it is determined whether the received signals are greater than the set of thresholds (e.g., all sensors continue to read more than 80% of a full dark level). If one of the received signals fails the threshold test, the process may return to S29-2 to restart the check process (i.e., the stability test fails, and the entire check restarts, including the "first" detection of all sensors almost dark).

Alternatively, the process returns to S29-7 rather than S29-2, i.e., the stability test is set to register a bin full after a continuous detection of almost full over a certain period time for all the sensors. In this case, rather than restarting the check for a "first" bin full detection, the verify timer may be restarted in step S29-6 when transient non-full conditions are detected. A bin-full state is notified after a consistent full condition is detected.

In either case, after the bin 50 (e.g. each side of the bin 50) has registered an almost full dark condition for the specified verify timer period, checked in step S29-9, a bin-full notification is turned on at step S29-10 in order to indicate to the user that the bin is full. Optionally, at step S29-11, the illumination cycle may be altered or changed, in order to reduce power consumption or to check for an emptied bin 50 more or less often than a full bin 50.

The thresholds for the verification steps are set at step S29-12. The thresholds may be set to a dark level that is less dark than previously employed. The verify level in step S29-12 is not the same as the verification timer of steps S29-6 or S29-9, and in this case is a verification that the bin 50 has not yet been emptied. This level is set to, e.g., 50% of the full dark score, to detect an emptied condition when either sides of the bin 50 has a sufficient increase in detected illumination. A significant amount of material must be removed from the bin 50 for either side to reach a level where a sensor receives, e.g., 50% of illumination received in an unobstructed condition, or 50% greater illumination than when the sensors are in an absolute dark level condition. The thresholds are calibrated or set at step S29-13 on every cycle, e.g., the dark level is set with reference to a no-illumination state. If it is determined at step S29-14 that one received signals is less than the new thresholds (e.g., that all of the sensors no longer register an almost or 80% of dark condition, and at least one of them registers a partially illuminated or 50% dark condition), notification is turned off at step S29-15.

Figure 30:
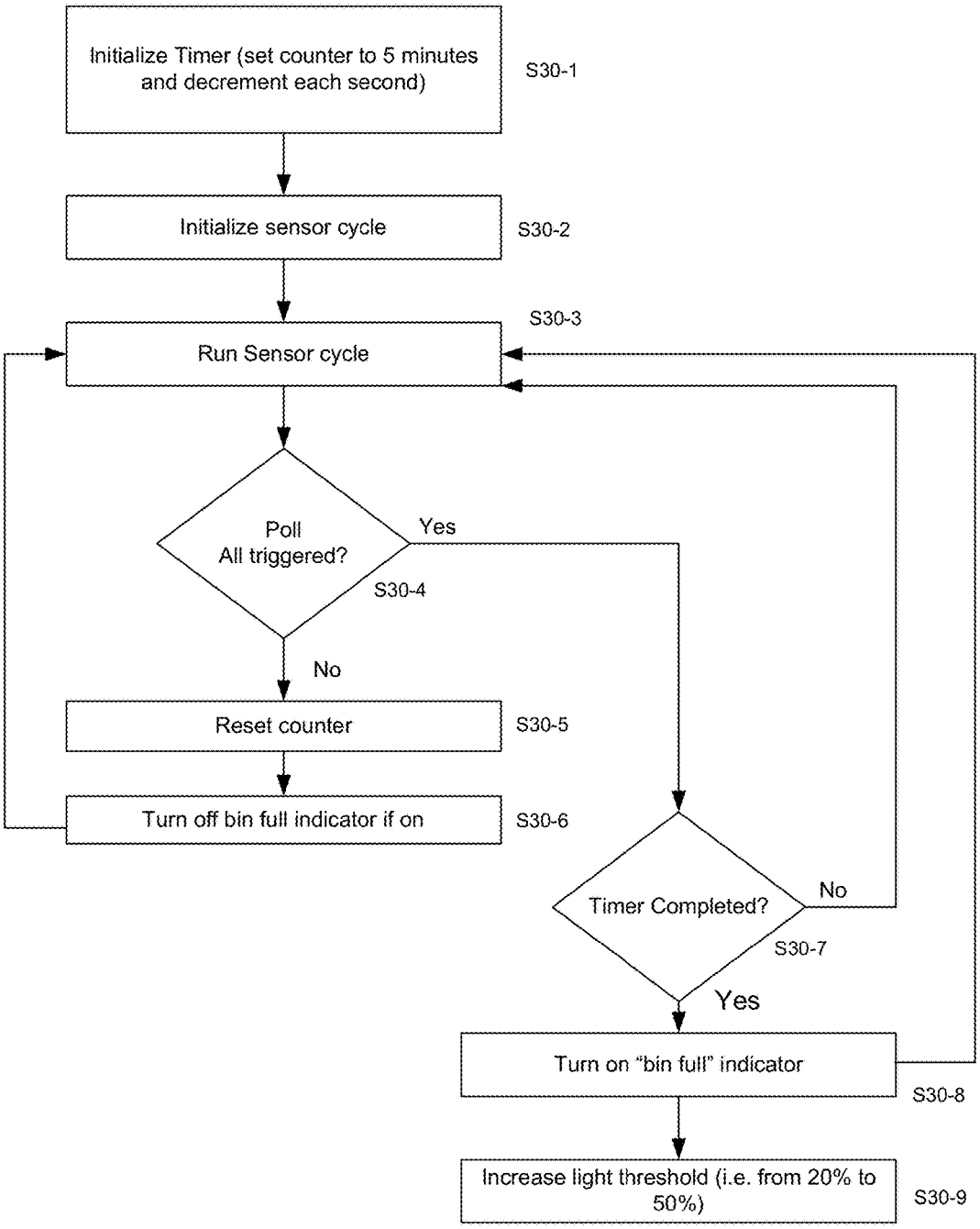

FIG. 30 illustrates a routine for operating transducers, determining the bin-full status of the bin, and turning the bin-full indicators on or off. At step S30-1, a timer is initiated by setting a counter to an initial interval (for example, 5 minutes=300 seconds) and decrementing the counter once each second (or other periodic schedule). At step S30-2, an initial sensor cycle is run to calibrate the thresholds. A main sensor cycle is run at step S30-3, in which each transducer is polled for received illumination signals, and any flags, such as a flag indicating that the bin 50 was sensed as full, are considered. At step S30-4, it is determined whether the bin-full flags have been triggered. If not, the counter is reset at step S30-5, the bin-full notification is turned off at step S30-6, and the routine returns to step S30-3. If the result of step S30-4 is positive, then it is determined at step S30-7 whether the timer has completed. If not, the routine returns to step S30-3; otherwise, the routine proceeds to step S30-8, at which the bin-full notification is turned on. The light threshold may then be increased or decreased, as appropriate, at step S30-9, for example, the light threshold may be increased from 20% to 50%, and the routine then returns to step S30-3.

By increasing the light threshold for comparison with the received illumination signal from the transducers, the sensitivity for turning the bin-full indicators on or off is decreased. The bin-full notification therefore becomes less likely to be turned off, because a more substantial change in the received illumination signal of the transducers is necessary to exceed the increased threshold. As a result, rapid shifting of the bin-full notification from on to off and back again may be avoided.

Figure 31:
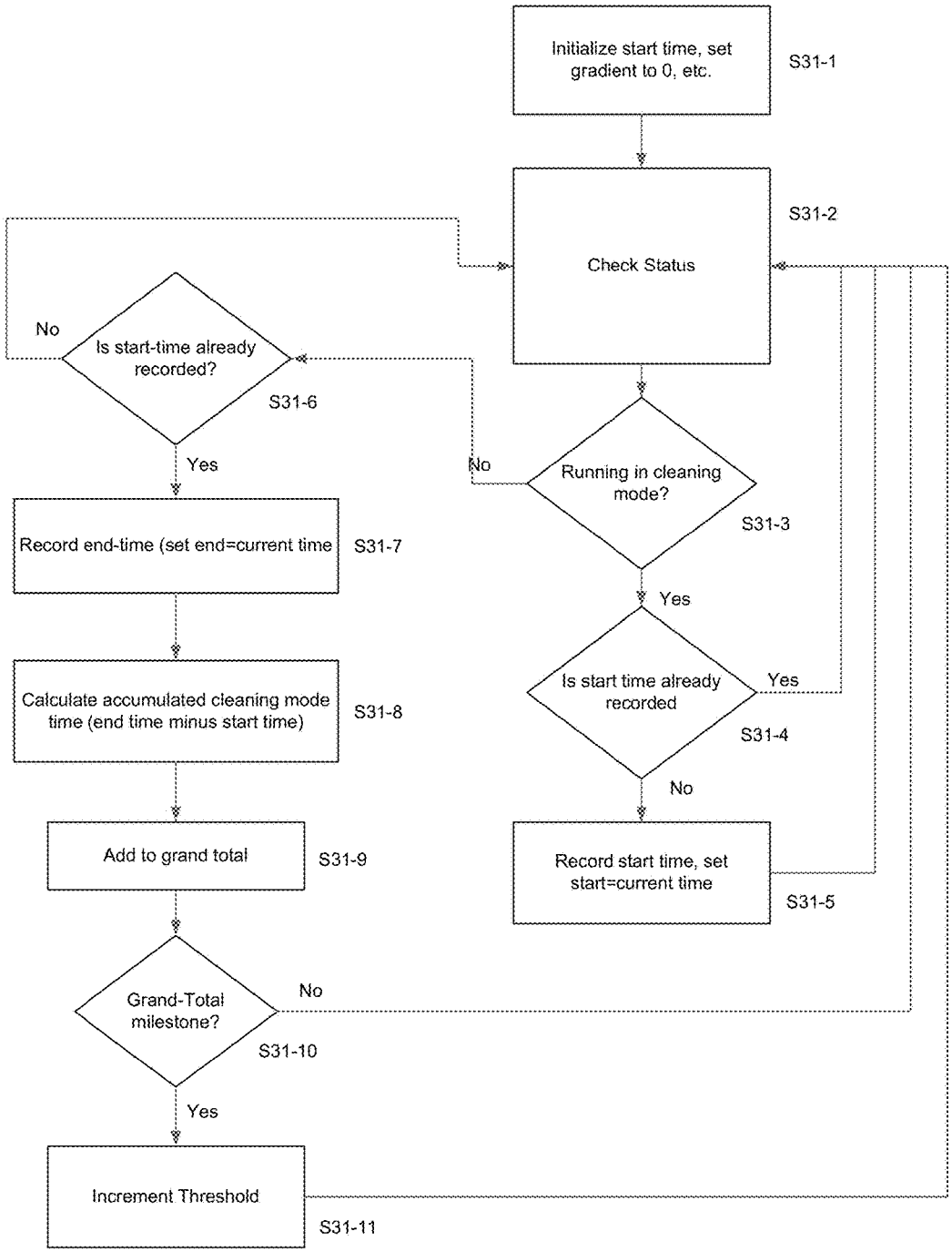

FIG. 31 illustrates another example of a control routine for the robot 11 and the bin 50. At step S31-1, the variables start_time and grand_total (e.g. a total accumulation of time spent running a cleaning mode) are set to zero (or otherwise set to predetermined initial value). At step S31-2, status is checked for each of the variables, and it is determined at step S31-3 whether the robot 11 is running in a cleaning mode. If the robot 11 is running in the cleaning mode, it is then determined whether the variable start_time has already been recorded (e.g. whether start_time has been assigned a value different from its initialization value). If so, the process returns to step S31-2; otherwise, the process proceeds to step S31-5, and records the current time to the variable start_time before returning to step S31-2. If the result of step S31-3 is negative, it is then determined at step S31-6 whether start_time was already recorded. If not, the routine returns to step S31-2; otherwise, at step S31-7, the current time is recorded as a variable end_time. At step S31-8, the accumulated cleaning mode time is calculated by subtracting the value of the variable start_time from the value of the variable end_time. At step S31-9, the accumulated cleaning time is then added to the variable grand_total. The variable grand_total represents the total amount of time the robot 11 has spent in cleaning mode since the most recent system reset.

At step S31-10, it is determined whether grand_total is greater than a milestone value. The milestone may represent a predetermined time period that may be significant, or the milestone may correspond to an arbitrarily chosen time period, for example. If the result of step S31-10 is negative, the routine returns to step S31-2; otherwise, the illumination threshold is incremented at step S31-11 in order to desensitize measurement of the polled transducer values at step S31-11, before the routine returns to step S31-2.

The sensitivity of the illumination thresholds for the transducers may be changed or modified based not only on the total amount of time the robot 11 has spent turned on, but instead, in proportion to the amount of time the robot 11 has spent in the cleaning mode. Furthermore, the criteria of whether the robot 11 is in cleaning mode or not can be defined such that the cleaning mode corresponds to times when a high level of debris intake is detected; or simply when the vacuum or sweeper motors are turned on, for example. False bin-full conditions may arise in situations where the robot 11 traverses a large (but relatively clean) area and therefore does not pick up much debris, or where the robot 11 is turned on for a long period time but does not pick up much debris. The false bin-full conditions may be avoided by focusing on the cleaning mode status rather than general run time.

FIG. 32 illustrates a process of determining bin-fullness in a cleaning bin 50. The robot 11 is active in step S32-1 and resets the bin microprocessor 217 in step S32-2. If the robot 11 is active (e.g. cleaning) in step S32-3, the bin microprocessor 217 reads the bin sensor system 700 (which may have one or more sensor pairs) in step S32-4; otherwise, the bin microprocessor 217 checks if a bin full flag is set in step S32-18. In step S32-5, the bin microprocessor 217 compares a current sensor reading with a previous sensor reading. If the current sensor reading is much greater than (by a predetermined amount) the previous sensor reading, the bin microprocessor 217 assumes the bin 50 is empty and calibrates the sensor system 700 in step S33-6 and proceeds to step S32-7; otherwise, the bin microprocessor 217 just proceeds to step S32-7. In step S32-7, the bin microprocessor 217 determines if the robot 11 is active (e.g. cleaning). If the robot 11 is not active, the bin microprocessor 217 checks if a bin full flag is set in step S32-18. If the robot 11 is active, the bin microprocessor 217 proceeds to step S32-8 to set a timer for a predetermined amount of time. The bin microprocessor 217 periodically (or continuously) checks for expiration of the timer. If the timer has not expired, the bin microprocessor 217 proceeds back to step S32-7 to check for robot activity (without resetting the timer). If the timer has expired, the bin microprocessor 217 checks if a bin full flag is set in step S32-9. If the bin full flag is set in step S32-9, the bin microprocessor 217 updates the indicator 1130 to notify a robot user that the bin 50 is full and proceeds back to step S32-7 to check for robot activity. If the bin full flag is not set in step S32-9, the bin microprocessor 217 reads the bin sensor system 700 in step S32-11 and sends the current sensor reading through a low pass filter in step S32-12. In step S32-13, the bin microprocessor 217 checks if a debris level has charged based on the current sensor reading and adjusts the threshold parameters accordingly. The threshold parameters are set in step S32-14. If the current sensor reading is greater than the threshold in step S32-15, the bin microprocessor 217 checks if multiple readings exceed the threshold parameters in step S32-16. If current sensor reading and subsequent multiple samplings exceed the threshold parameters, the bin full flag is set in step S32-17 and the bin processor 217 proceeds back to step S32-7; otherwise, the bin processor 217 does not set the bin full flag and just proceeds back to step S32-7. In step S32-7, if the robot 11 is no longer active, the bin processor 217 proceeds to step S32-18, where it checks if the bin full flag is set. If the flag is not set, the robot 11 may proceed to a sleep mode in step S32-22. If the flag is set, the bin microprocessor 217 updates the indicator 1130 (which may flash, chirp, etc.) to notify a robot user that the bin 50 is full. In step S32-20, if the bin 50 is moved by the user, the bin full flag is cleared in step S32-21 and the robot 11 proceeds to the sleep mode in step S32-22; otherwise, the flag is not cleared and the robot 11 just proceeds to the sleep mode in step S32-23.

Other details and features combinable with those described herein may be found in the following U.S. patent applications filed concurrently herewith, entitled "CLEANING ROBOT ROLLER PROCESSING" having assigned Ser. No. 11/751,413; and "REMOVING DEBRIS FROM CLEANING ROBOTS" having assigned Ser. No. 11/751,470, the entire contents of the aforementioned applications are hereby incorporated by reference.

A number of implementations have been described. Nevertheless, it will be understood that various modifications may be made without departing from the spirit and scope of the disclosure. Accordingly, other implementations are within the scope of the following claims.

What is claimed is:

1. A coverage robot system comprising:

a cleaning bin configured to be received by a cleaning robot;

a bin capacity sensor system comprising:

a signal emitter proximate a first side of an opening in the cleaning bin;

a first signal detector proximate the first side of the opening in the cleaning bin, the first signal detector configured to receive a signal emitted by the signal emitter, the signal emitter and the first signal detector being disposed proximate to one another; and a second signal detector proximate a second side of the opening in the cleaning bin, the second side opposite the first side, the second signal detector configured to receive a signal emitted by the signal emitter; and a controller configured to monitor a signal from the first signal detector and the second signal detector and determine a cleaning service requirement, and transmit a third signal having information about the cleaning service requirement.

2. The coverage robot system of claim 1 in which the controller is configured to provide a determined cleaning service requirement to a remote indicator, wherein the remote indicator is configured to display a user-detectable indication of the determined cleaning service requirement.

3. The coverage robot system of claim 1, wherein the signal emitter, the first signal detector and the second signal detector are disposed such that a threshold level of accumulation of debris in the cleaning bin attenuates emissions from the signal emitter received by the first signal detector and the second signal detector.

4. The coverage robot system of claim 1, wherein the cleaning service requirement determined by the controller includes a bin-full status.

5. The coverage robot system of claim 1, wherein the signal emitter comprises an infrared light emitter.

6. The coverage robot system of claim 2, wherein the remote indicator appears on a screen of a device configured to be held by a user.

7. The coverage robot system of claim 6, wherein the device held by the user is a telephone.

8. The coverage robot system of claim 2, wherein the controller is configured to determine a robot stuck condition and communicates the robot stuck condition to the remote indicator.

9. The coverage robot system of claim 2, wherein the controller is configured to receive commands from the remote indicator.

10. The coverage robot system of claim 1, wherein the controller of the bin capacity sensor system communicates with a controller of the robot.

11. The coverage robot system of claim 1, wherein the cleaning bin defines a sweeper bin portion and a vacuum bin portion.

12. The coverage robot system of claim 11, wherein the cleaning bin further comprises a vacuum assembly housed by the vacuum bin portion.

13. An autonomous coverage robot comprising:

a chassis;

a drive system mounted on the chassis and configured to maneuver the robot;

a cleaning assembly carried by the chassis and comprising:

a cleaning assembly housing; and at least one driven sweeper coupled to the cleaning assembly housing;

a controller carried by the chassis;

a removable bin attached to the chassis and configured to receive debris agitated by the driven sweeper;

an emitter proximate a first side of an opening in the removable bin;

a first detector proximate the first side of the opening in the removable bin, the first detector configured to receive a signal emitted by the emitter, the emitter and the first detector disposed such that a threshold level of accumulation of debris in the removable bin attenuates emissions received by the first detector from the emitter;

a second detector proximate a second side of the opening in the removable bin, the second side opposite the first side, the second detector configured to receive a signal emitted by the emitter; and a bin controller configured to monitor a signal from the first detector and from the second detector and determine a bin-full status.

14. The autonomous coverage robot of claim 13 in which the controller is configured to provide a determined cleaning service requirement to a remote indicator, wherein the remote indicator is configured to output a user-detectable indication of the determined cleaning service requirement.

15. The autonomous coverage robot of claim 14, wherein the user-detectable indication of the determined cleaning service requirement comprises an optical or audio signal.

16. The autonomous coverage robot of claim 14, wherein the remote indicator is configured to be held by or worn by a user.

17. An autonomous coverage robot comprising:

a chassis;

a drive system mounted on the chassis and configured to maneuver the robot;

at least one driven sweeper carried by the chassis;

a bin attached to the chassis and configured to receive debris agitated by the driven sweeper;

an emitter proximate a first side of an opening in the bin;

a first detector proximate the first side of the opening in the bin, the first detector configured to receive a signal emitted by the emitter, the emitter and the first detector being disposed proximate to one another such that the first detector is configured to receive a reflected emitter signal;

a second detector proximate a second side of the opening in the bin, the second side opposite the first side, the second detector configured to receive a transmitted emitter signal; and a controller carried by the chassis, the controller configured to monitor a signal from the first detector and from the second detector and initiate a bin full routine upon determining a bin debris accumulation level requiring service.

18. The autonomous coverage robot of claim 17 in which the controller is configured to send an indication that autonomous operation may be interrupted for bin servicing to a human perceptible indicator, wherein the human perceptible indicator is configured to output a user-detectable indication that autonomous operation may be interrupted for bin servicing.

19. The autonomous coverage robot of claim 18, wherein the controller is configured to send the indication to a remote indicator as part of the bin full routine.

20. The autonomous coverage robot of claim 18, wherein the user-detectable indication appears on a screen of a device configured to be held by a user.

21. The coverage robot system of claim 17, wherein the emitter, the first detector, and the second detector are disposed such that a threshold level of accumulation of debris in the bin attenuates emissions from the emitter received by the first detector and the second detector.

22. The autonomous coverage robot of claim 17, further comprising a diffuser positioned over the emitter to diffuse the emitted signal, the first detector and the second detector receiving the diffused emissions, wherein accumulation of debris in the bin at least partially blocks the diffused emissions from being received by the first detector and the second detector.

23. The autonomous coverage robot of claim 22, wherein the emitter comprises an infrared light emitter diffused by a translucent plastic sheet.

* * * * *